US007071464B2

(12) United States Patent
Reinhold

(10) Patent No.: US 7,071,464 B2
(45) Date of Patent: Jul. 4, 2006

(54) MASS SPECTROSCOPY SYSTEM

(75) Inventor: Bruce Reinhold, Sudbury, MA (US)

(73) Assignee: Dana-Farber Cancer Institute, Inc., Boston, MA (US)

( * ) Notice: Subject to any disclaimer, the term of this patent is extended or adjusted under 35 U.S.C. 154(b) by 76 days.

(21) Appl. No.: 10/806,933

(22) Filed: Mar. 22, 2004

(65) Prior Publication Data

US 2004/0245455 A1 Dec. 9, 2004

Related U.S. Application Data

(60) Provisional application No. 60/456,849, filed on Mar. 21, 2003.

(51) Int. Cl.
*H01J 49/00* (2006.01)

(52) U.S. Cl. ..... 250/282; 250/281; 250/288; 250/292; 250/293

(58) Field of Classification Search ..... None
See application file for complete search history.

(56) References Cited

U.S. PATENT DOCUMENTS

| | | | | |
|---|---|---|---|---|
| 4,540,884 | A | 9/1985 | Stafford et al. | 250/282 |
| 4,982,088 | A | 1/1991 | Weitekamp et al. | 250/291 |
| RE34,000 | E | 7/1992 | Syka et al. | 250/292 |
| 5,179,278 | A | 1/1993 | Douglas | 250/290 |
| 5,420,425 | A | 5/1995 | Bier et al. | 250/292 |
| 5,420,549 | A | 5/1995 | Prestage | 331/94.1 |
| 5,517,025 | A | 5/1996 | Wells et al. | 250/282 |
| 6,177,668 | B1 | 1/2001 | Hager | 250/282 |
| 2004/0222369 | A1 * | 11/2004 | Makarov et al. | 250/281 |

FOREIGN PATENT DOCUMENTS

WO WO 01/15201 A2 3/2001

* cited by examiner

*Primary Examiner*—Nikita Wells

(57) ABSTRACT

The invention features a method including: i) confining ions to stable trajectories within an ion trap; ii) exciting a subset of the ions along at least one transverse coordinate; iii) rotating the transverse excitation into an excitation along an axial coordinate; and iv) transferring at least some of the axially excited ions from the ion trap along the axial coordinate. For example, the ions may be transferred to an ion detector or to a subsequent ion trap.

87 Claims, 24 Drawing Sheets

A1-A8: 8 VDC
B1-B8: 5 VDC
C1-C8: 8 VDC
G1-G8: 6.25 VDC
B1, B8: +0.5 V @ 223700 Hz
B4, B5: -0.5 V @ 223700 Hz
m/z 500

A1-A8: 0 VDC
B1-B8: 5 VDC
C1-C8: 8 VDC
G1-G8: 6.25 VDC
m/z 500
m/z 501
z position
time

MASS SPECTROSCOPY SYSTEM

CROSS-REFERENCE TO RELATED APPLICATIONS

This application claims priority to U.S. Provisional Patent Application Ser. No. 60/456,849 entitled "MASS SPECTROSCOPY SYSTEM" filed Mar. 21, 2003, the contents of which are incorporated herein by reference.

STATEMENT REGARDING FEDERALLY SPONSORED RESEARCH OR DEVELOPMENT

The research described in this application was supported in part by a grant (DBI-9987124) from the National Science Foundation. Thus the government has certain rights in the invention.

TECHNICAL FIELD

The invention relates to a mass spectroscopy system such as those that use radio frequency ion traps.

BACKGROUND

Mass spectroscopy is an analytical technique used to identify the mass-to-charge (m/Z) ratio of ions and ion fragments produced when a sample is ionized and parent ions are sufficiently energized to fragment. Identifying the mass-to-charge ratio of the ion fragments provides information about the parent ion. Mass spectroscopy systems use electric and/or magnetic fields to guide the ions fragments along trajectories that depend on their mass-to-charge ratios. Many systems include "ion guides" and "ion traps," in which the ion trajectories are stable along some or all coordinate directions only for a selected range of mass-to-charge ratios.

Many ion traps, such as quadrupole ion traps, apply a combination of radio-frequency (RF) and direct-current (DC) voltages to electrodes to form the trapping fields. The relative magnitude of the RF and DC voltages determine the range of mass-to-charge ratios that correspond to stable trajectories. Those ions that are stable undergo oscillations within the trap at frequencies that depend on their mass-to-charge ratio. In some cases, the ion trap may further apply an alternating-current (AC) voltage to the electrodes to induce resonant excitation of a selected subset of the trapped ions, for the purpose of either inducing collisions that dissociate those ions or ejecting them from the trap.

One common ion trap configuration is a three-dimensional quadrupole trap (3D-IT), which involves a ring electrode and two end cap electrodes. Most commonly, an RF potential is applied to the ring electrode with the end cap electrodes held at ground to generate the trapping fields. Another configuration is a linear ion trap (LIT), which involves an extended set of electrodes to transversely confine ions and electrostatic "plugs" at opposite ends of the trap to axially confine the ions. RF potentials are applied to the extended set of electrodes to generate quadrupole-type trapping fields along the transverse coordinates and DC potentials at the ends to prevent ions from diffusing out either end of the trap. The volume in which the ions are significantly influenced by the DC end potentials is generally a small fraction of the volume ions occupy in the LIT so that the ion's trapping motion is described by the transverse coordinates alone and the LIT is therefore also denoted a two-dimensional ion trap. Combining the transverse RF quadrupolar potential with an additional DC potential that is applied between electrodes in different axial regions to produce a static harmonic trapping potential along the axial coordinate generates another three-dimensional trap, referred to as a harmonic linear trap (HLT). Examples of prior art for the HLT are Prestage et al., J. Applied Phys. 66, 1013 (1989) and Raizen et al., Phys. Rev. A 45, 6493 (1992). As a technical aside, almost all physical LITs are in fact HLTs with very weak quadratic potentials.

Details of such radio-frequency ion traps are well known in the art. See, for example, U.S. Pat. No. 4,540,884 to Stafford et al., U.S. Pat. No. 5,420,425 to Bier et al., and U.S. Pat. No. 5,179,278 to Douglas.

To provide additional information about a parent ion, it may be preferable to perform multiple stages of isolating ions having a selected mass-to-charge ratio and fragmenting those ions. For example, a first stage of mass spectrometry may be used to select a primary ion of interest, for example, a molecular ion of a particular biomolecular compound such as a peptide, and that ion is caused to fragment by increasing its internal energy, for example, by colliding the ion with a neutral molecule. A second stage of mass spectrometry may then be used to analyze the mass-to-charge ratios of the fragment ions. Often the structure of the primary ion can be determined by interpreting the fragmentation pattern. This process is typically referred to as an MS/MS analysis. The MS/MS analysis improves the recognition of a compound with a known pattern of fragmentation and also improves specificity of detection in complex mixtures, where different components give overlapping peaks in a single stage of MS.

Further information about the parent ion may be determined by implementing additional stages of mass-to-charge isolation and fragmentation, something that is typically referred to as $MS^{(N)}$ analysis. $MS^{(N)}$ analysis is commonly used with 3D quadrupole or ion cyclotron resonance traps. A specific ion fragment is first isolated in the trap by ejecting all other ion fragment m/Z values and the isolated ion is then induced to fragment. The process is repeated with a loss of ions associated with the ejection of ion fragments that are not being selected at a particular stage of the $MS^{(N)}$ analysis. The loss of ions results in a corresponding loss of information about the parent ion which may otherwise be derived from those other ion fragments. To retain ion fragments not selected at a particular stage of the $MS^{(N)}$ analysis for use at other stages of the $MS^{(N)}$ analysis, a multiple stage mass spectrometer may be used. Such a spectrometer is described in PCT Publication WO 01/15201 A2 by Reinhold and Verentchikov, the contents of which are incorporated herein by reference.

$MS^{(N)}$ analysis may be particularly useful in drug metabolism studies and organism-scale protein characterization or recognition (e.g., proteome) studies. To implement such analysis, a liquid chromatograph (LC) is sometimes used to provide a preliminary fractionation for a continuous flow of sample ions. Primary functions of the LC are to simplify the mass spectrum observed at a given (retention) time so that a single molecular species can be mass-selected for ion fragmentation analysis and to concentrate the molecular species so that during the elution window the component's ion signature rises above the background and can be automatically selected by the mass spectrometer software for ion fragmentation.

SUMMARY

Among other embodiments, the invention features a multiple stage mass spectroscopy system that provides large charge capacity, high-resolution isolation of selected mass-to-charge ratios, and $MS^{(N)}$ analytical capability without the ion losses associated with an ejection-based selection process. In some embodiments, the system shares the feature of combining multiple dynamically assigned ion traps and ion guides coupled within a single high voltage RF trapping field with the $MS^{(N)}$ spectrometer described in PCT Publication WO 01/15201 A2 by Reinhold and Verentchikov. In these embodiments, the invention features methods and apparatus for improving the mass resolution and dynamic range of a coupled-trap mass spectrometer system, while retaining the $MS^{(N)}$ analytical capacity without the ion losses of ejection-based selection. The system may be especially suitable for the detection of target biological molecules in complex matrices, a feature important in both biomarker and proteome studies.

The system includes a high-resolution subsection including a series of axially aligned harmonic linear trapping regions (HLTs), each of which is configured to excite a selected subset of ions trapped therein along a transverse coordinate, and then rotate the transverse excitation into an axial excitation. The axially excited ions may then be ejected to an adjacent or distant trapping region or ejected out of the RF field to a detector, including another m/Z-resolving detector, while those ions that were not transversely excited remain trapped.

The significance of the rotation is many-fold. First, the mass-to-charge (m/Z) specificity of transverse excitation in an HLT is much greater than that for axial excitation, thus the rotation transfers the m/Z-specificity of the transverse excitation to an axial excitation of equally high m/Z-specificity. The axial excitation may then be used to eject the selected subset of ions to a different trapping region for a particular stage of MS(N) analyses, while retaining the non-excited ions in the initial region for subsequent stages of the analysis. Finally, the rotation tends to "cool" the selected subset of ions so that they are not ejected with excess kinetic energy that might otherwise limit their manipulation in the subsequent trapping region. This cooling occurs because the rotation transfers energy from the transversely excited ions to the electric fields associated with the rotation.

The system further includes at its input a large multiple pole ion trap (also referred to herein as a multipole accumulation trap or multipole trap) to provide a large charge capacity ion reservoir for the overall system. To couple ions from the multipole accumulation trap to the high-resolution subsection, the system further includes a low-resolution subsection including a series of ion guiding regions, two-dimensional ion trapping regions and regions in which the high voltage RF field that provides overall radial confinement of the ions is modified in axially localized regions by axially localized variations in the shape of the electrodes. The low-resolution subsection fractionates ions sampled from the accumulation ion trap into different m/Z ranges that are subsequently transferred to the high-resolution subsection. Moreover, the low-resolution subsection can operate with a high charge density, feeding the high-resolution subsection with ions at a level sufficiently low to minimize Coulombic coupling that might otherwise degrade the ion manipulation therein but narrow enough in m/Z range so that there is a significant number of the target ions transferred from the accumulation trap for the high resolution ion fragmentation analysis.

Among other embodiments, the system may be configured so that the axially aligned series of linear traps, ion guides, RF field modifications and harmonic linear traps in the low- and high-resolution subsections share a common high voltage RF source. In preferred embodiments the trap and guide regions are dynamically assigned by computer control of DC potentials applied to the low voltage electrodes during the $MS^{(N)}$ analyses and the ions may remain interior to a single-sourced high voltage RF field during the m/Z-selective transfers. Manipulating ions within a single RF trapping field reduces costs associated with the RF power supplies and serves also to minimize ion transmission losses and ion heating that would be associated with injection in and out of RF trapping fields.

Finally, when the system is used in the analyses of complex mixtures, it need not include a liquid chromatograph (LC) for pre-fractionating the initial sample mixture. The identification of molecular components in the mixture will be through the analysis of fragmentation hierarchies ($MS^{(N)}$) and will not require the m/Z isolation of the parent molecular ion.

We now summarize particular aspects and features of the invention.

In general, in one aspect, the invention features a method including: i) confining ions to stable trajectories within at least one ion trapping region; ii) exciting a subset of the ions along at least one transverse coordinate; iii) rotating the transverse excitation into an excitation along an axial coordinate; and iv) transferring at least some of the axially excited ions from the ion trapping region along the axial coordinate.

Embodiments of the method may have any of the following features.

The confined ions may have a mass-to-charge ratio within a specified range.

The confining of the ions may include generating electric fields within the ion trap. For example, the electric fields may be produced by a superposition of fields generated by multiple sets of electrodes. Also, the electric fields may produce linear dynamics for the ions in at least a central region of the ion trapping region. For example, the electric fields may generate a linear restoring force along the axial coordinate with respect to an origin in the central region of the ion trap. Also, the electric fields may generate a time-dependent restoring force of the form $P_r(t)r$ along each transverse coordinate with respect to an origin centered in an ion trapping region, where r denotes the transverse coordinate, t denotes time, and where $P_r(t)$ satisfies $P_r(t)=P_r(t+T)$ for some time interval T. For example, the restoring force along each transverse coordinate may be the same. Furthermore, the electric fields may generate a linear restoring force along the axial coordinate with respect to an origin in the central region of the ion trap.

The exciting of the subset of ions may include generating a time-dependent electric field along the transverse coordinate. For example, the subset of ions may include ions having a selected mass-to-charge ratio. Moreover, the time-dependent electric field may resonantly excite the ions having the selected mass-to-charge ratio.

The rotating of the transverse excitation may include generating an electric field that couples the transverse excitation to ion motion along the axial coordinate. For example, the electric field that couples the transverse excitation to the ion motion along the axial coordinate may correspond to an electric potential in a central volume of the ion trapping region, the electric potential including a spatial dependence of the form $(\alpha x+\beta y)\,z$ with respect to an origin in the central volume, where $\alpha$ and $\beta$ are constants, at least one of which is non-zero, x and y are the transverse coordinates, and z is the axial coordinate. Also, the electric field may include a frequency component equal to an absolute difference between a frequency of the transverse excitation and a frequency for axial motion in the ion trap for the transversely excited subset of ions. Furthermore, the electric field may be maintained for a time sufficient to rotate the transverse excitation to the axial excitation.

The transferred ions may include ions having a selected mass-to-charge ratio.

The transfer of at least some of the axially excited ions may include changing a gate potential at one or both ends of the ion trapping region. For example, the changed gate potential may prevent the confined ions other than the axially excited ions from escaping the ion trapping region through either end.

The method may further include confining the transferred ions in a second ion trapping region. Also, the invention may further include fragmenting at least some of the ions confined in the second trapping region. For example, the fragmenting may include electromagnetically exciting the ions in the second trapping region.

The ion trapping regions may be extended along the axial coordinate relative to the transverse coordinate.

The trajectory of each of the confined ions may define a frequency spectrum for each of the axial and transverse coordinates and each spectrum may include at least one spectral peak at a frequency $\omega_{j,(m/Z)}$ that varies with the mass-to-charge ratio m/Z of the confined ion, where the index j denotes a particular one of the axial and transverse coordinates. For example, $$\left|\frac{\partial \omega_{r,(m/Z)}}{\partial (m/Z)}\right|$$

may be greater than $$\left|\frac{\partial \omega_{z,(m/Z)}}{\partial (m/Z)}\right|$$

for the subset of transversely excited ions, where the index r denotes either of the transverse coordinates and the index z denotes the axial coordinate. Moreover, $$\left|\frac{\partial \omega_{r,(m/Z)}}{\partial (m/Z)}\right|$$

may be greater than ten times $$\left|\frac{\partial \omega_{z,(m/Z)}}{\partial (m/Z)}\right|$$

for the subset of transversely excited ions. Furthermore, the exciting of the subset of ions may include generating an additional electric field along the transverse coordinate, wherein the additional electric field is time-dependent and has spectral intensity at the transverse spectral peak frequency corresponding to a selected mass-to-charge ratio. In addition, the subset of ions may include the ions having the selected mass-to-charge ratio. Also, the rotating of the transverse excitation may include generating an additional electric field that couples the transverse excitation to ion motion along the axial coordinate, wherein the additional electric field is time-dependent and has spectral intensity at a frequency equal to $|\omega_{r,(m/Z)}-\omega_{z,(m/Z)}|$ for a mass-to-charge ratio corresponding to at least some of the ions in the subset of transversely excited ions. Furthermore, the first additional electric field may terminate before the generation of the second additional electric field. Also, the second additional electric field may be maintained for a time sufficient to rotate the transverse excitation to the axial excitation. Furthermore, the transfer may include changing gate potentials at one or both ends of the ion trapping region to transfer at least some of the axially excited ions having the selected mass-to-charge ratio and to not transfer other ions. Also, the method may further include confining the transferred ions in a second ion trapping region and fragmenting at least some of the ions confined in a second trapping region.

In general, in another aspect, the invention features an apparatus including: i) a housing including a chamber for receiving ions and multiple electrodes surrounding the chamber, wherein the multiple electrodes define transverse and axial coordinates for ion motion within the chamber; ii) a set of power supplies coupled to the multiple electrodes; and iii) an electronic controller coupled to the set of power supplies. During operation the electronic controller causes the set of power supplies to generate a series of electric fields in the chamber that: i) confines ions to stable trajectories within one or more regions in the chamber; ii) excites a subset of the ions along at least one of the transverse coordinates in one or more regions of the chamber; iii) rotates the transverse excitation into an excitation along the axial coordinate in one or more regions of the chamber; iv) transfers at least some of the axially excited ions from one or more regions of the chamber into other regions of the chamber along the axial coordinate; and v) ejects ions from one or more regions of the chamber for detection.

Embodiments of the apparatus may include any of the following features.

The power supplies may include radio frequency (RF) and direct current (DC) sources for confining the ions to the stable trajectories in one or more regions of the chamber. The power supplies may further include at least one alternating current (AC) source for exciting the subset of ions along the transverse coordinate and the rotating the transverse excitation to the axial excitation. Also, the electrodes coupled to the RF source may be isolated from the electrodes coupled to any of the AC and DC sources.

During operation the electronic controller may cause the electrodes surrounding one or more regions of the chamber to define a harmonic linear trap.

The housing may be extended along the axial coordinate relative to the transverse coordinate.

The apparatus may further include features corresponding to those described above in connection with the first-mentioned method.

In general, in another aspect, the invention features an apparatus including: i) a housing including a chamber for receiving ions and multiple electrodes surrounding the chamber, wherein the multiple electrodes define transverse and axial coordinates for ion motion within the chamber; ii) a set of power supplies coupled to the multiple electrodes; and iii) a electronic controller coupled to the set of power supplies, wherein during operation the electronic controller is configured to cause the set of power supplies to generate a time-dependent electric field along at least one of the transverse coordinates in one or more regions of the chamber, and further configured to cause the set of power supplies to generate a time-dependent electric field that couples the axial coordinate to the transverse coordinate.

Embodiments of the apparatus may include any of the following features.

The set power supplies may be configured to generate the transverse time-dependent electric field at a first frequency selected by the electronic controller and generate the coupling time-dependent electric field at a second frequency (different from the first frequency) selected by the electronic controller.

The electric field that couples the transverse excitation to the axial coordinate may correspond to an electric potential in a central region of the chamber, the electric potential including a spatial dependence of the form $(\alpha x+\beta y)$ z with respect to an origin in the central region, where $\alpha$ and $\beta$ are constants, at least one of which is non-zero, x and y are the transverse coordinates, and z is the axial coordinate.

The housing may be extended along the axial coordinate relative to the transverse coordinate.

The electronic controller may be further configured to cause the power supplies to generate electric fields in the chamber that define a harmonic linear trap.

The apparatus may further include features corresponding to those described above in connection with the first-mentioned method or the first mentioned apparatus.

In another aspect, for a specific embodiment, the invention features a method including: i) confining ions to a first ion trapping region; ii) generating an extended (in axial coordinate) RF trapping field to transversely confine the ions and DC potentials to control the axial motion of the ions; iii) generating a spatially localized (in axial coordinate) modification in the extended RF trapping field wherein the localized RF field modification imparts an axial force on ions incident to the region of RF field modification and wherein the axial force varies with the mass-to-charge ratio of the incident ion; iv) combining the RF field modification with DC potentials to add an axial force that is independent of mass-to-charge ratio; and v) directing the ions from the first trapping region toward the spatially localized RF field modification to allow some of the ions to penetrate through it and not others. The combination of RF field modification and DC potentials localized in an axial region interior to the extended RF trapping field acts as mass-selective gate and will be denoted in the following as an 'm/Z gate'.

More generally, with respect to same aspect, the invention features a method including: (i) generating an axially extended RF trapping field to transversely confine ions; (ii) providing a spatially localized modification in the extended RF trapping field, wherein the modification imparts an axial force on incident ions that varies with a mass-to-charge ratio of each incident ion; and (iii) directing ions from a first trapping region to the spatially localized modification to allow some of the ions from the first trapping region to penetrate though the spatially localized modification and not others.

Embodiments of the method may include any of the following features.

The directing of the ions may include imparting kinetic energy to the ions in the direction of the m/Z gate. For example, imparting the kinetic energy may include setting an electrostatic potential difference between the ion trapping region and the m/Z gate region.

The method may further include confining the ions that penetrate through the m/Z gate modification in a second ion trapping region distinct in axial position from the m/Z gate. For example, the first and second ion trap may be linear ion traps that are axially aligned with one another and share a single RF potential source. For another example, the first ion trap may be the multipole accumulation trap and the second trap may be a linear ion trap where the m/Z gate and the linear ion trap share a common RF potential source.

The axial force repelling ions incident to the m/Z gate may increase as the mass-to-charge ratio decreases. The ions that penetrate through the spatially localized m/Z gate may have a mass-to-charge ratio above a threshold value. The m/Z gate may have the feature that the RF field does not significantly vanish on the center axis (r=0) for a localized range of z values. The RF field amplitude on the center axis may be set so that axial ion velocities required for transmission through the m/Z gate are appropriate for subsequent MS(N) analyses.

The method may further include directing the ions in the second ion trapping region back to the m/Z gate to allow some of the ions from the second ion trapping region to penetrate through it and others of the ions to reflect from it and remain confined in the second ion trapping region. Furthermore, the directing of the ions from the first trapping region to the m/Z gate may include imparting a first amount of kinetic energy to the ions in the direction of the m/Z gate and wherein the directing of the ions from the second trap to the barrier region may include imparting a second amount of kinetic energy to the ions in the direction of the m/Z gate. The first and second amounts may differ. The method may further include adjusting the strength of the repulsive RF force prior to directing the ions in the second trapping region back to the first trapping region. Also, the first amount of kinetic energy may cause ions having a mass-to-charge ratio above a first threshold to penetrate through the m/Z gate, the second amount of kinetic energy may cause ions having a mass-to-charge ratio above a second threshold greater than the first threshold to penetrate through the m/Z gate, and the ions remaining in the second ion trapping region may have mass-to-charge ratios between the first and second thresholds.

Generating the spatially localized RF field modification or m/Z gate may include introducing holes or gaps to the electrodes in the region of the m/Z gate. Generating the m/Z gate may further include applying an RF potential to additional electrodes surrounding regions extending transversely from the m/Z gate relative to an axis defined by the extended RF trapping field.

In another aspect, for a specific embodiment, the invention features an apparatus including: i) a first ion trapping region including electrodes; ii) an axially extended set of electrodes including electrodes configured to receive a high voltage RF potential to transversely confine the ions and electrodes configured to receive a DC potential to control the axial motion of the ions; iii) a radio-frequency (RF) ion gate including electrodes configured to receive an RF potential and generate a spatially localized RF field modification interior to the extended electrode set and electrodes configured to receive a DC voltage in the region of the gate ('m/Z gate'); iv) a set of power supplies including at least direct current (DC) and RF power supplies coupled to the electrodes in the first ion trap and the electrodes in the m/Z gate; and v) an electronic controller coupled to the set of power supplies. During operation the electronic controller causes the set of power supplies to: i) confine ions to the first ion trap; ii) generate the locally modified radio-frequency (RF) field combined with DC potentials to create an m/Z gate, wherein the m/Z gate imparts a repulsive axial force on ions incident on the m/Z gate from the first trap and wherein the axial force varies with the mass-to-charge ratio of the incident ion; and iii) directs the ions in the first trap toward the m/Z gate to allow some of the ions to penetrate through it and not others.

More generally, with respect to the same aspect, the invention features an apparatus including: (i) electrodes configured to produce an axially extended RF trapping field that transversely confines ions, wherein the electrodes are modified to produce a spatially localized region in the axially extend RF trapping field that imparts an axial force on incident ions that varies with a mass-to-charge ratio of each incident ion; (ii) a set of power supplies including at least direct current (DC) and RF power supplies coupled to the electrodes; and (iii) an electronic controller coupled to the set of power supplies. During operation the electronic controller causes the set of power supplies to: i) generate the axially extended RF trapping field and the spatially localized region in the axially extended RF trapping field; and ii) direct ions from a first trapping region to the spatially localized region to allow some of the ions from the first trapping region to penetrate though the spatially localized region and not others.

The apparatus may further include features corresponding to those described above in connection with the second-mentioned method aspect.

In another aspect, for a specific embodiment, the invention features a method including: i) generating an extended (in axial coordinate) RF trapping field to transversely confine the ions and DC potentials to control the axial motion of the ions; ii) confining ions to stable trajectories within a first ion trapping region; iii) generating a spatially localized (in axial coordinate) modification interior to the extended RF trapping field wherein the localized RF field modification imparts an axial force on ions incident to the region of RF field modification and wherein the modified RF field causes an axial force to vary with transverse displacement of the incident ion; iv) increasing the transverse oscillation amplitude of a subset of the ions in the first ion trapping region, wherein the subset of ions includes ions having a selected mass-to-charge ratio; and v) directing the ions toward the RF field modification to cause some of the ions to penetrate through it and not others. The transmission through the axially localized RF field modification of this method depends on the ion's transverse oscillation amplitude so that the axially localized RF field modification acts as an 'excitation gate' and RF field modifications in combination with DC potentials exhibiting this property will be denoted as 'excitation gates' in the following.

More generally, with respect to the same aspect, the invention features a method including: (i) generating an axially extended RF trapping field to transversely confine ions; (ii) providing a spatially localized modification in the extended RF trapping field, wherein the modification imparts an axial force on incident ions that varies with a transverse displacement of each incident ion; (iii) increasing the transverse oscillation amplitude of a subset of the ions from a first ion trapping region, wherein the subset of ions comprises ions having a selected mass-to-charge ratio; and (iv) directing the ions toward the spatially localized modification to cause some of the ions to penetrate through it and not others.

Embodiments of the method may further include any of the following features.

The magnitude of the repulsive force may decrease with the transverse oscillation amplitude of the incident ions, and wherein the ions that penetrate through the excitation gate may include the subset of ions whose transverse oscillation amplitude was increased.

The magnitude of the repulsive RF force may increase with the transverse oscillation amplitude of the incident ions, wherein the ions that do not penetrate through the excitation gate include the subset of ions whose transverse oscillation amplitude was increased.

The first ion trap may be a linear ion trapping region of the extended RF transverse trapping field.

The increasing of the transverse oscillation amplitude of a subset of the ions may include generating time-varying electric field along at least one of the transverse coordinates in the first ion trapping region, wherein the time-varying electric field has spectral intensity at a frequency corresponding to the stable trajectory of the ions having the selected mass-to-charge ratio along the transverse coordinate.

The directing of the ions may include imparting kinetic energy to the confined ions in the direction of the RF field modification. For example, imparting the kinetic energy may include setting a potential offset between the first ion trapping region and the excitation gate.

The method may further include confining the ions that penetrated through the excitation gate in a second ion trapping region, axially displaced from the excitation gate. For example, the first and second ion trapping regions may be two-dimensional ion traps that are axially aligned with one another and share a common RF potential source.

Generating the spatially localized RF field modification acting as an excitation gate may include breaking the z-translational symmetry of the RF trapping field. Generating the z-localized RF field modification wherein the axial force in the direction of the incident ion increases with transverse displacement may include introducing holes or gaps in the RF electrodes interior to the axially extended RF trapping field. Generating the z-dependent RF field modification wherein the axial force in the direction of the incident ion increases with transverse displacement may include a symmetric arrangement of these gaps in the RF electrodes so that the overall quadrupolar symmetry of the RF field along the z-axis is retained. Generating the z-dependent RF field modification may further include applying an RF potential to additional electrodes surrounding regions extending transversely from the spatially structured RF field relative to an axis defined by the first ion trap. Generating the z-dependent RF field modification acting as an excitation gate may further include the addition of axially localized DC potentials to block ions or pull ions without transverse oscillation amplitude from passing through the gate along the axial coordinate.

In another aspect, for a specific embodiment, the invention features an apparatus including: i) an extended set of electrodes including electrodes configured to receive a high voltage RF potential to confine the ions along the transverse coordinates, the geometry defining axial and transverse coordinates, and electrodes configured to receive a DC potential to control the axial motion of the ions; ii) a first ion trapping region interior to the extended RF field providing transverse confinement; iii) a radio-frequency (RF) gate including axially localized modifications in the extended RF electrodes, creating an axially localized RF field modification interior to the extended RF field, wherein the RF field modification causes an axial force to vary with transverse displacement of the incident ion; iv) a set of power supplies including at least direct current (DC) and RF power supplies coupled to the electrodes in the first ion trap and the electrodes in the RF gate; and v) an electronic controller coupled to the set of power supplies. During operation the electronic controller causes the set of power supplies to: i)

confine ions to stable trajectories within the first ion trapping region; ii) generate the spatially localized RF field modification, wherein the RF field modification imparts a repulsive or attractive axial force to ions incident on the RF field modification from the first trap, and wherein the RF field modification includes a transverse spatial variation in the RF field that causes the axial force to vary with transverse oscillation amplitude of the incident ion so that the RF field modification, in combination with DC potentials assigned by the controller, either specifically transmits or reflects ions with transverse amplitude and therefore acts as an excitation gate; iii) increase the amplitude of the transverse oscillations of a subset of the ions, wherein the subset of ions includes ions having a selected mass-to-charge ratio; and iv) direct the ions toward the axially localized RF field modification to cause some of the ions to penetrate through it and not others, depending on the transverse oscillation amplitude.

More generally, with respect to the same aspect, the invention features an apparatus including: (i) electrodes configured to produce an axially extended RF trapping field that transversely confines ions, wherein the electrodes are modified to produce a spatially localized region in the axially extended RF trapping field that imparts an axial force on incident ions that varies with a transverse displacement of each incident ion; (ii) a set of power supplies including at least direct current (DC) and RF power supplies coupled to the electrodes; and (iii) an electronic controller coupled to the set of power supplies. During operation the electronic controller causes the set of power supplies to: i) generate the axially extended RF trapping field and the spatially localized region in the axially extended RF trapping field; ii) increase the transverse kinetic energy of a subset of the ions from a first ion trapping region, wherein the subset of ions comprises ions having a selected mass-to-charge ratio; and iii) direct the ions toward the spatially localized modification to cause some of the ions to penetrate through it and not others.

The apparatus may further include features corresponding to those described above in connection with the third-mentioned method aspect.

In another aspect, for a specific embodiment, the invention features an apparatus including: i) an axially extended set of electrodes configured to receive an RF potential and provide transverse confinement of the ions and electrodes configured to receive a DC potential to control the axial motion of the ions; ii) a first ion trapping region; iii) a second ion trapping region, wherein the first and second ion trapping regions are aligned with one another along an axial coordinate and are interior to the axially extended RF confining field; iv) a radio-frequency (RF) excitation gate including electrodes configured to receive an RF potential and electrodes configured to receive a DC potential and wherein the combination generates an excitation gate between the first and second ion trapping regions; and iv) a set of power supplies including at least one radio frequency (RF) source coupled to the RF electrodes and a DC source coupled to the DC electrodes.

Embodiments of the apparatus may include any of the following features.

The first and second ion trapping regions may be linear ion traps (LITs).

The RF gate electrodes may include electrodes on at least opposite sides of the axial localized RF field modification. Furthermore, the RF gate electrodes may further include electrodes surrounding regions extending transversely from the axial localized RF field modification relative to an axis defined by the first and second ion traps. The RF and DC gate electrodes may generate an electric field that operates both as an m/Z gate and as an excitation gate as disclosed in the methods above.

More generally, with respect to the same aspect, the invention features an apparatus including: (i) electrodes configured to produce an axially extended RF trapping field that transversely confines ions, wherein the electrodes are modified to produce a spatially localized region within the axially extended RF trapping field that imparts an axial force on incident ions, wherein the axial force varies with a mass-to-charge ratio of each incident ion; and (ii) a set of power supplies including at least direct current (DC) and RF power supplies coupled to the electrodes.

Embodiments of the apparatus may include any of the following features.

The axial force may also vary with a transverse displacement of each incident ion The electrodes may further define first and second ion trapping regions on opposite sides of the spatially localized modifications, wherein the first and second trapping regions are linear ion traps (LITs).

The spatially localized modification may involve electrodes on at least opposite sides of the spatially localized modification and additional electrodes surrounding regions extending transversely from the spatially localized modification relative to an axis defined by the axially extended RF trapping field.

The spatially localized modification may involve holes in axially extended electrodes used to generate the RF trapping field.

The spatially localized modification may involve deformations (e.g., bumps) in axially extended electrodes used to generate the RF trapping field. For example, the deformations may extend inwardly toward the RF trapping field.

The apparatus may further include features corresponding to those described above in connection with the third-mentioned method aspect.

Unless otherwise defined, all technical and scientific terms used herein have the same meaning as commonly understood by one of ordinary skill in the art to which this invention belongs. In case of conflict with publications, patent applications, patents, and other references incorporated herein by reference, the present specification, including definitions, will control.

The details of one or more embodiments of the invention are set forth in the accompanying drawings and the description below. Other features, objects, and advantages of the invention will be apparent from the description and drawings, and from the claims.

DESCRIPTION OF DRAWINGS

The invention will now be further described merely by way of example with reference to the accompanying drawings in which:

FIGS. 19*a* and 19*b* are schematic diagrams of the electrode arrangement for the RF gate, and FIG. 19*c* is a diagram illustrating the RF field lines in the RF gate.

Like reference symbols in the various drawings indicate like elements.

DETAILED DESCRIPTION

Figure 1:
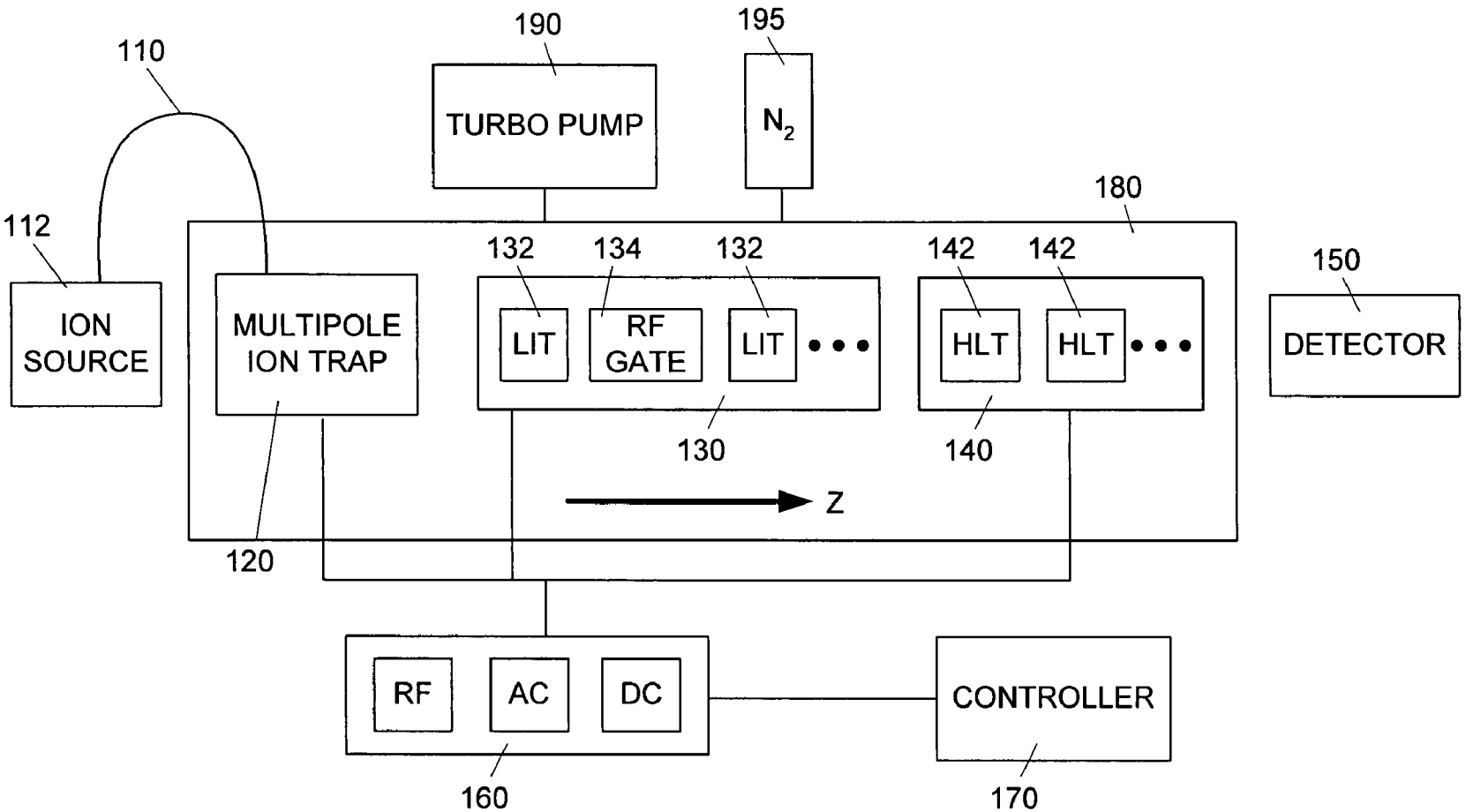
FIG. 1 is a schematic diagram of a mass spectroscopy system.

FIG. 1 shows a schematic diagram of a mass spectroscopy system 100, which includes an ion accumulation section 110, a low-resolution mass-fractionation subsection 130, a high-resolution mass-fractionation subsection 140, a detector section 150, a set of power supplies 160, and an electronic controller 170. The ion accumulation section, the low-resolution subsection, and the high-resolution subsection are aligned with one another to define a nominal propagation direction for the ions being analyzed. This nominal propagation direction is referred to herein as the axial coordinate and is designated by the "z"-coordinate in any Cartesian coordinate system used to describe particular components of the system.

Ion accumulation section includes an ion source 112 and a large multipole ion trap 120. Power supplies 160 include high-voltage radio frequency (RF), low voltage alternating current (AC), and direct current (DC) sources and are coupled to electrodes in multipole ion trap 120, low-resolution subsection 130, and high-resolution subsection 140. Electronic controller 170 controls how the set of power supplies address the different electrodes in the system. Electronic controller 170 further provides a user interface for controlling the system and running automated sequences for mass analysis of the ions produced by the ion source, including $MS^{(N)}$. The multipole trap, the low-resolution subsection, and the high-resolution subsection may reside in a common vacuum housing 180, which is coupled to high-vacuum pump 190 capable of generating pressures low enough for ion manipulation (e.g., a turbo pump). A source 195 of cold inert gas (e.g., nitrogen) is coupled to housing 180 to introduce the inert gas. The inert gas is used to collisionally cool the ions trapped in any of the multiple pole trap, the low-resolution subsection, or the high-resolution subsection, and/or to facilitate the fragmentation of trapped ions that are translationally excited and induced to dissociate by collisional activation (collision-activated dissociation, CAD).

Ion source 112 ionizes the sample to be analyzed, and an electrostatic potential draws the ions produced by the source into multiple pole trap 120. In a preferred embodiment for atmospheric pressure ion sources, after the multipole trap is filled with ions, a mechanical gate valve seals the multiple pole trap from the ion source.

During the mass analysis, low-resolution subsection 130 transfers a subset of the trapped ions falling within a selected range of mass-to-charge ratios to the high-resolution subsection 140. As will be described in greater detail below, preferred embodiments of the low-resolution subsection include a series of linear ion trapping regions (LITs) 132 connected by radio-frequency (RF) gate regions 134 that generate structured RF fields to provide low-resolution, but high charge capacity, mass selectivity.

High-resolution subsection 140 includes a series of harmonic linear trapping regions (HLTs) 142 configured to produce both transverse excitation (dipolar or quadrupolar) and rotation fields that selectively excite and then rotate transversely excited ions into an axial excitation used to selectively eject ions into the subsequent trap or detector. The different trapping regions in the high-resolution subsection may also be used to perform the $MS^{(N)}$ analysis using CAD with either resonant excitation or DC offsets coupled with gas pulses. Ions that are transferred may then be dissociated in the adjacent trap, ions not transferred can be targeted for later $MS^{(N)}$ analyses. The high-resolution subsection ultimately transfers a subset of ions to detector section 150, which generates a signal indicative of the number and, in certain embodiments, the m/Z, of such ions.

Furthermore, the detector section may provide the ability to generate ion 'scans' in which a broad range of m/Z values can be rapidly scanned for signal. For example, detector section 150 may include an external mass spectrometer, such as a high-resolution Paul ion trap, a Fourier transform ion cyclotron resonance mass spectrometer (FT-ICR), a fringe-field ejecting linear ion trap or a time-of-flight of mass spectrometer (TOF).

Figure 2:
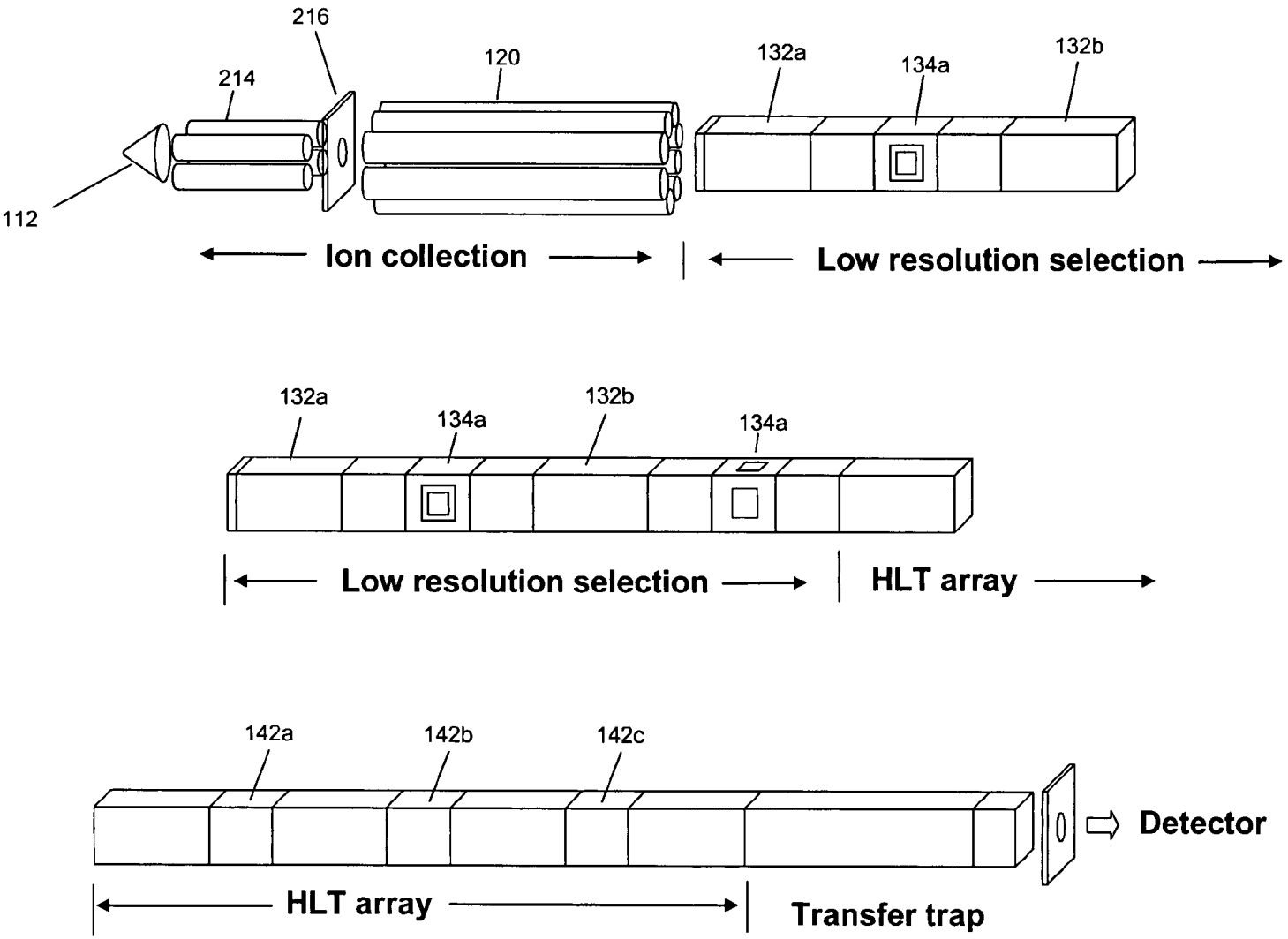
FIG. 2 is a schematic diagram of a particular set of ion optical components for the mass spectroscopy system of FIG. 1.

Ion source 112 may include any of the standard continuous or pulsed ionization methods, e.g., electron impact (EI), electrospray (ESI), atmospheric pressure chemical ionization (APCI), and/or an intrinsically pulsed (MALDI) source. Because ions are stored in the multiple pole trap and the low- and high-resolution subsections can subsequently select different subsets of the stored ions for analysis, the continuous ion sources do not need to operate and hence consume sample during the analysis stage, improving overall sensitivity. The combination of high resolution m/Z transfer and $MS^{(N)}$ operation with retention of intermediate ion fragments allows the characterization of individual molecular species by a fragmentation hierarchy without the need for m/Z isolation of the parent molecular ion. As a result, mixtures of ions may be analyzed by simple nano-electrospray without LC, improving sensitivity, flexibility in the algorithms for fragmentation analysis (no time constraint associated with the elution window) and decreasing the cost of the total analytical instrument. FIG. 2 shows a schematic diagram of a particular embodiment of the ion accumulation section, the low-resolution subsection, the high-resolution subsection, and the detector section of system 100.

A preferred embodiment is shown in FIG. 2, where ion accumulation section 110 includes ion source 112, a quadrupole filter 214, a mechanical valve 216, and multiple trap 120. Quadrupole filter 214 is an RF-only quadrupole rod set that forms a high pass m/Z filter for ions produced by source 112. Ions having an m/Z value below a threshold set by the RF amplitude do not have stable transverse trajectories within the filter, and thus cannot pass through valve 216 and into multipole trap 120. The presence of the quadrupole filter prevents low m/Z fragments such as ionized water or methanol from being stored in the multiple trap. Such low m/Z ions are generally not useful in any $MS^{(N)}$ analysis. A single DC offset applied to the valve 216 and all the electrodes of the multipole trap (not shown in FIG. 2) draws ions that can pass through filter 214 into multipole trap 120. After a sufficient number of ions are drawn into multipole trap 120, valve 216 seals the multipole trap.

A higher-order multipole ion trap is used because of its large charge capacity, minimal RF heating and reduced m/Z stratification compared with a quadrupole trap and it provides a reservoir of ions derived from the test sample at the ion source. Such ions can then be sequentially and selectively analyzed (including an $MS^{(N)}$ analysis) in the downstream components of system 100. Pulses of cold inert gas from source 195 (not shown in FIG. 2) into the multipole trap cools the stored ions. DC barriers produced by a common offset voltage on the rods of the multipole trap 120 axially confine the stored ions. Additional information describe such multipole traps is disclosed in "Ion traps for large storage capacity" by D. J. Wineland, in Proc. of the Cooling, Condensation, and Storage of Hydrogen Ions Workshop, SRI, Menlo Park, Calif., January 1987, ed. By J. T. Bahns, p 181.

Referring still to FIG. 2, the low and high-resolution subsections share a common high voltage RF potential source for transverse confinement and this is applied directly to all the RF electrodes of the coupled trap array without switching RF or the deliberate introduction of inductive, capacitive or resistive couplings between different high voltage RF electrodes. This decreases the overall load on the RF power supply and therefore the cost of the system. Ion manipulation inside and between the low and high-resolution subsections is carried out interior to a common, single-phase RF field and is driven by low voltage RF or DC signals applied to electrodes that are electrically isolated from the high voltage RF. This simplifies the electrical design of the system. Ions are not ejected out of and into high voltage RF fields during the m/Z selection and dissociation steps in $MS^{(N)}$ analyses as is the practice in the tandem alignment of RF quadrupoles, linear ion traps or ions guides. Ion heating and transmission losses associated with passing through RF fringe fields are minimized. The RF field modifications associated with the m/Z and excitation RF gates can be designed on a continuum from no modifications to a complete break in the trapping RF field, depending on the specific objectives.

Referring still to FIG. 2., low-resolution subsection 130 includes three linear ion trapping regions 132*a*, 132*b*, and 132*c* and two RF gate regions 134*a* and 134*b*, with trapping regions 132*a* and 132*b* surrounding RF gate 134*a*, an 'm/Z gate' (as disclosed in the summary above), and trapping regions 132*b* and 132*c* surrounding RF gate 134*b*, an 'excitation gate' (as disclosed in the summary above). Each linear ion trapping region includes an axially extended trapping region surrounded at opposite ends by DC gate regions. All the linear trapping regions 132*a, b* and *c* are configured to receive RF voltages sufficient to transversely confine the ions and various gate segments have DC offset voltages sufficient to axially confine ions to the trapping region during the trapping step and to impart appropriate z velocity to the ions as they enter the RF gates for m/Z selection. The linear traps are configured as a series of axially aligned, hollow parallelpiped structures each having a plurality of electrodes coupled to the set of power supplies for generating electric fields within the structures for ion manipulation. The RF gates are likewise configured as hollow structures that are axially coupled to the linear traps to define the nominal propagation path for the ions to be analyzed. Also, each RF gates includes a plurality of electrodes coupled to the set of power supplies for generating structured RF fields therein, details of which are described further below.

Referring still to FIG. 2, the high-resolution subsection includes an axially aligned series of three harmonic linear trapping regions (HLTs) 142*a*, 142*b*, and 142*c*, each of which includes a trapping cell and gate regions at opposite ends thereof. The harmonic linear traps are configured as a series of axially aligned, hollow parallelpiped structures further defining the nominal propagation path for the ions being analyzed. Each harmonic linear trap has a plurality of electrodes coupled to the set of power supplies for generating electric fields within the structures for ion manipulation.

Referring still to FIG. 2, the detector section includes a final linear ion trap 252, mechanical valve 256, and an external detector (e.g., an orthogonal injection time-of-flight mass spectrometer (oTOF)). Trap 252 includes a gate region 253 configured to receive a DC offset voltage and selectively confine ions within trap 252 or eject them through valve 256 into the oTOF. The valve 256 is typically closed only during the ion accumulation step and serves to protect the vacuum of the TOF region from the higher pressures in the upstream ion accumulation and manipulation region during the filling of the multipole trap.

During operation, the low-resolution subsection transfers a selected subset of ions from the multiple pole ion trap to the high-resolution subsection. In particular, the low-resolution subsection provides a low-resolution m/Z fractionation of the ions, so that the ions transferred to the high-resolution subsection already fall within a pre-selected window of m/Z values. Details of the RF gates and the low-resolution mass fractionation process are described in greater detail further below. Before that, we turn to a discussion of the rotation operation used in each HLT and the $MS^{(N)}$ analysis of the high-resolution subsection as a whole.

Electrodes in each of the HLTs are configured to generate the following electromagnetic potentials in at least a central region of the trap:

$$\Phi_T(x, y, z) = V_T\left(\delta + \frac{\alpha}{2d^2}(2z^2 - x^2 - y^2)\right), \tag{1}$$

$$\Phi_{RF}(x, y, z, t) = V_{RF}(t)\left(\frac{\beta}{2d^2}(x^2 - y^2)\right), \tag{2}$$

where $\Phi_T$ is a DC potential driven with an amplitude $V_T$ and $\Phi_{RF}$ is an RF potential with an amplitude $V_{RF}$. The parameter d is a distance corresponding to the size of the trap, and $\alpha$ and $\beta$ are parameters associated with the geometry of the trap for the DC and RF potentials, respectively. The parameter $\delta$ is a DC offset potential for the entire trapping region and has no dynamical significance interior to this region. The coordinates x, y, z define a Cartesian coordinate system with respect to an origin in the central region of the trap, with the z-coordinate corresponding to the axial direction of the trap and the x- and y-coordinates corresponding to directions transverse to the axial direction.

In the presence of both DC and RF potentials, an ion having mass m and charge Z is subject to the following forces along x, y, and z coordinates, respectively:

$$\frac{d^2x}{dt^2} = -\frac{Z}{md}(\alpha V_T + \beta V_{RF}(t))x, \tag{3}$$

$$\frac{d^2y}{dt^2} = -\frac{Z}{md}(\alpha V_T - \beta V_{RF}(t))y, \tag{4}$$

$$\frac{d^2z}{dt^2} = -\frac{Z\alpha}{md}(2V_T)z. \tag{5}$$

Figure 3:
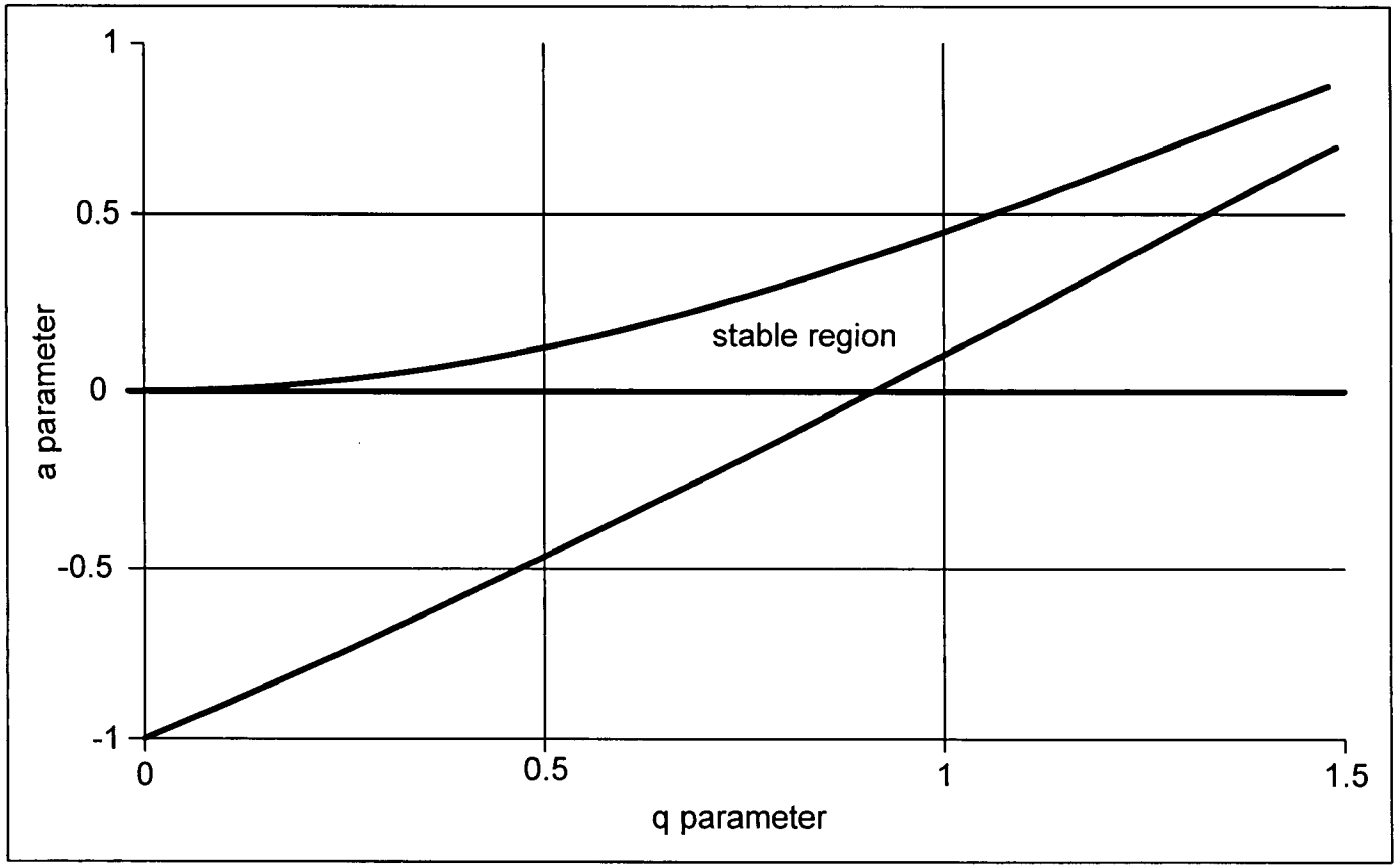
FIG. 3 is a stability graph for a radio-frequency (RF) harmonic linear trap.

Differential equations (3) and (4) describing the forces along the transverse coordinates are standard for RF quadrupolar trapping fields and with a harmonic time-dependence for $V_{RF}(t)$ are known as Mathieu equations. More generally, if $V_{RF}(t)$ is periodic they are known as Hill's equation. Stable solutions to the combined equations (3), (4) and (5) can be expressed by a stability graph, such as that shown in FIG. 3, when equations (3) and (4) are Mathieu, which encloses a region of values for parameters "a" and "q" that correspond to stable solutions for the HLT. The parameters "a" and "q" are conventionally defined for Mathieu systems and are related to the linearized potentials of (1) and (2) as follows:

$$a = \frac{Z\alpha V_T}{md^2\omega_{RF}^2} \text{ and } q = \frac{Z\beta V_{RF}}{md^2\omega_{RF}^2}, \tag{6}$$

where $\omega_{RF}$ is the angular frequency of the RF field. Thus, for a given set of parameters, ions that have a mass-to-charge ratio (m/Z) that causes the "a" and "q" parameters to fall inside the stability graph have stable trajectories within the trap. Stability of the z-coordinate is governed by a simple harmonic oscillator equation, (5), and requires that the z-potential increase with displacement (a>0), i.e., the ion sits in a harmonic well, not on top of a harmonic hill. Other ions are not stable and at the very least exit the region where these equations apply. As is apparent from Eq. 6, ions with low m/Z values lead to large values of the "a" and "q" parameters, which correspond to unstable trajectories. As a result, the trapping fields have a low-mass cut-off. This is the reason why, for example, the quadrupole rod set in quadrupole filter 214 described above can be used as a high-pass m/Z filter in the ion accumulation section.

Stable solutions to the Mathieu equations are constrained to a bounded orbit with respect to the origin (a practical, not mathematical, statement of stability). Although the orbit is generally aperiodic, its frequency spectrum exhibits a secular frequency $\omega_{r,(m/z)}$ that depends on the m/Z values of the ion in question, where the subscript r denotes a transverse coordinate. Differential equation (5) describing the force along the axial z-coordinate is a standard harmonic oscillator equation, which has a sinusoidal solution at a frequency $\omega_{z,(m/Z)}$ that scales inversely with the square root of the m/Z value of the ion in question, where the subscript z denotes the axial coordinate. Ions having a selected m/Z value can be resonantly excited, along either a transverse coordinate or the axial coordinate, by applying, in addition to the trapping fields, an alternating-current (AC) field along the respective coordinate at a frequency corresponding to that of the trapped ion.

Notably, when using parameters typical for RF quadrupole-type traps, the following inequality holds:

$$\left|\frac{\partial\omega_{r,(m/Z)}}{\partial(m/Z)}\right| >> \left|\frac{\partial\omega_{z,(m/Z)}}{\partial(m/Z)}\right|. \tag{7}$$

In other words, for an ion trapped in an HLT, the frequency of its transverse trajectory is much more sensitive to its m/Z value than is the frequency of its axial trajectory. Thus, a resonant excitation along a transverse coordinate will have greater mass-to-charge specificity than that of a resonant excitation along the axial coordinate. On the other hand, excitation along the axial coordinate of ions having a selected mass-to-charge ratio allows those ions to be selectively ejected to a subsequent axially aligned trap or detector.

To enjoy the benefit of both the high-resolution mass specificity of a transverse excitation and the utility of axial ejection, each of the HLTs in system 100 implements a rotation operation to convert a transverse excitation of ions having a selected mass-to-charge ratio to an axial excitation. The rotation operation generates an electric field in the trap that resonantly couples a transverse excitation to an axial excitation for ions having a specified m/Z value. Such ions will then exhibit oscillations along the axial coordinate at amplitudes greater than that of non-excited ions. As a result, they can be selectively ejected from the trap along the axial coordinate by lowering a gate potential at one (or both) ends of the trap.

The sequence is as follows. First, ions are confined in the HLT by generating DC and RF potentials corresponding to Eqs. (1) and (2). Next, an AC potential is applied to the electrodes to generate an oscillating electric field along a transverse coordinate (e.g., a dipolar field along the x-axis, the y-axis, or some superposition thereof), and the frequency of the AC potential is selected to resonantly excite ions at having a selected m/Z value. For example, if the selected mass-to-charge ratio is $(m/Z)_1$, then the AC potential is selected to have spectral intensity at $\omega_{r,(m/Z)_1}$. After the transverse excitation has reached sufficient amplitude, the AC potential along the transverse coordinate is terminated. The rotation operation is then applied. The rotation operator is generated by applying an AC potential to the HLT electrodes whose spatial dependence couples the transverse coordinate corresponding to the transverse excitation to the axial coordinate and whose temporal dependence couples the resonant frequency along the transverse coordinate of ions having the selected mass-to-charge ratio to the resonant frequency along the axial coordinate of the ions. For example, in the vicinity of the origin, the rotation potential $V_{ROT}(t)$ takes the following form:

$$V_{ROT}(t)=A\sin[(\omega_{r,(m/Z)_1}-\omega_{z,(m/Z)_1})t]rz \quad (8),$$

where r designates the particular transverse coordinate selected for the transverse excitation. For example, that transverse coordinate may be expressed as r=mx+ny, where m and n are constants, at least one of which is non-zero.

The rotation potential causes the transverse excitation to couple with an axial excitation, thereby driving the selected ions to have axial oscillations with increasing amplitude, while decreasing the amplitude of the transverse oscillations of the selected ions. The amplitude of the axial oscillations is maximized when that of the transverse oscillations is minimized (e.g., negligible), at which point the rotation potential is terminated. If not terminated, the situation reverses and the rotation potential causes the axial oscillations to couple back to the transverse oscillations, i.e., the amplitude of the axial oscillations begin to decrease and that of the transverse oscillations begin to increase. This process may repeat, as the rotation operation causes the ion excitation to oscillate between a purely transverse excitation and a purely axial excitation. The period of this rotation depends generally on the amplitude A of the rotation potential but is independent of the initial amplitudes of the transverse or axial oscillation.

Figure 4A:
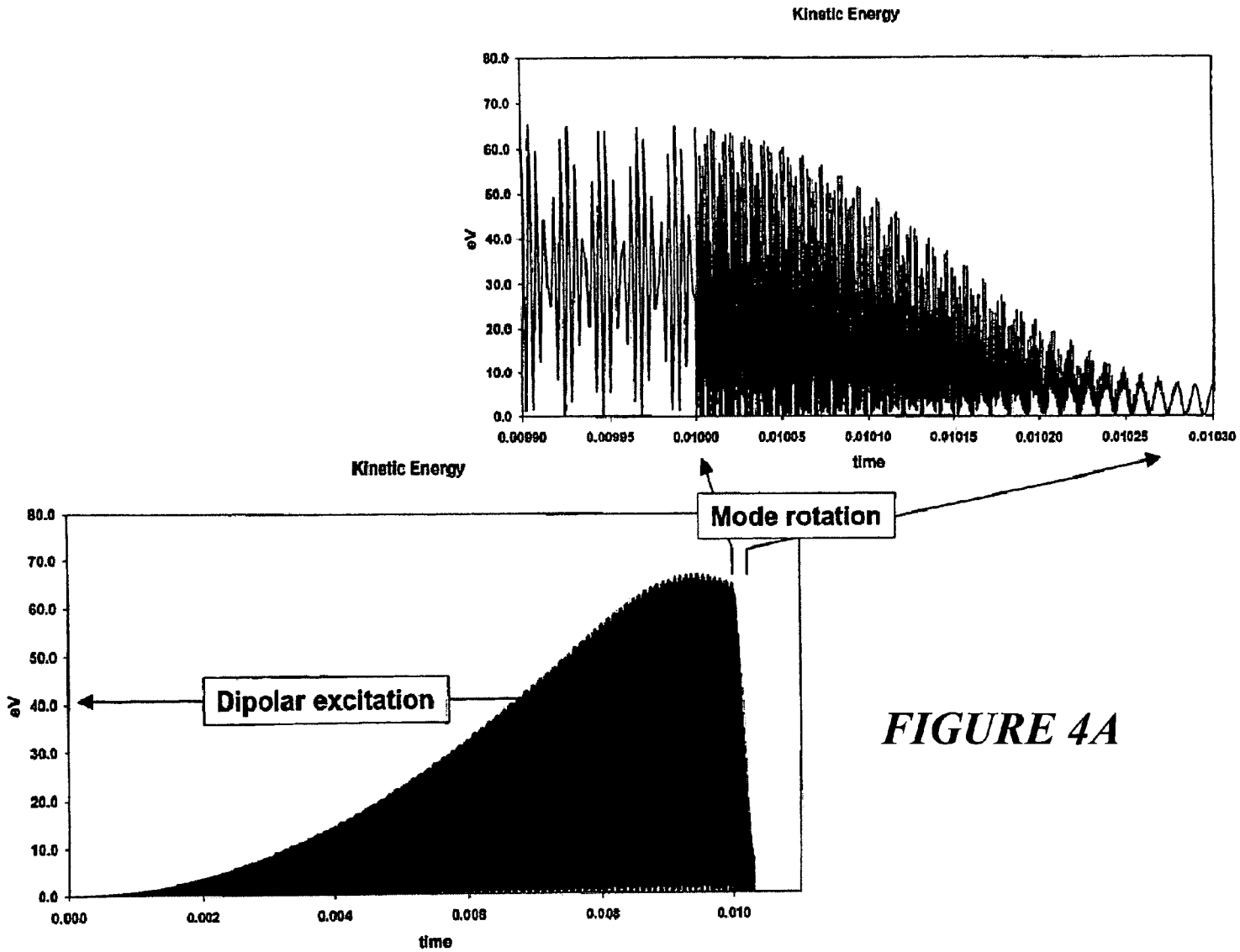
FIGS. 4*a*, 4*b*, 4*c*, and 4*d* are graphs that illustrate the motional dynamics (e.g., kinetic energy, trajectory) of a representative one of selected ions during part of the m/Z-selection sequence involving a dipolar excitation followed by a rotation operation.
Figure 4C:
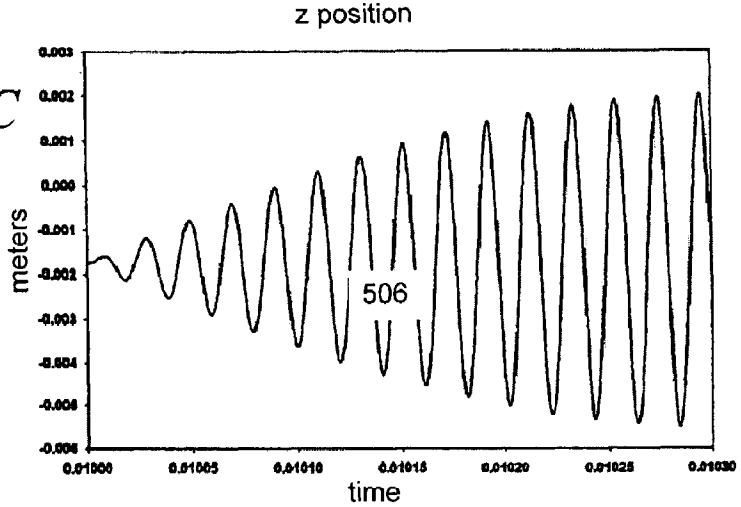
Figure 4D:
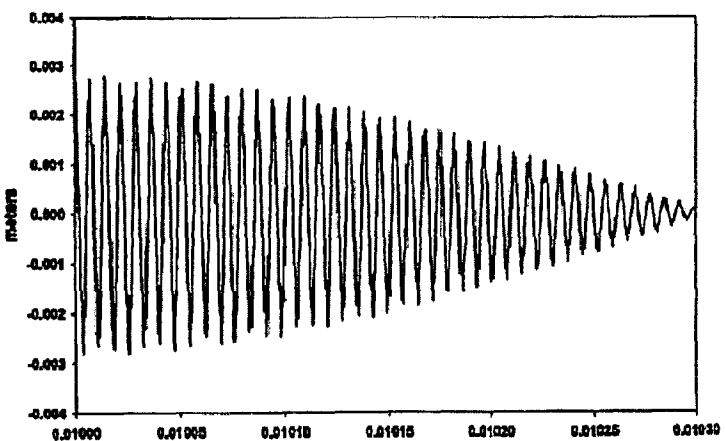
Figure 4B:
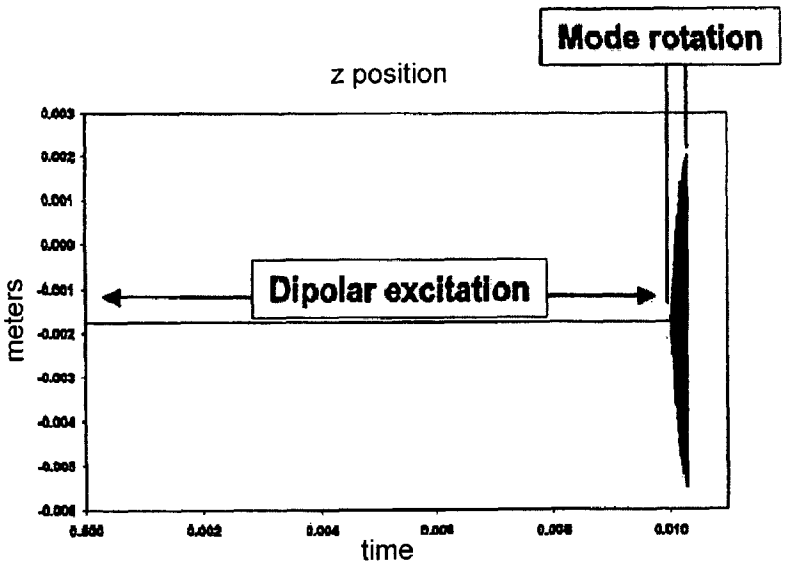

FIGS. 4*a*, 4*b*, 4*c*, and 4*d* are graphs that illustrate the trajectory of a representative one of the selected ions during the sequence. FIG. 4*a* is a graph showing the kinetic energy of the ion during the transverse excitation and the rotation operation. The rotation operation takes place only near the end of the sequence, and this time period is shown in greater detail in the inset of the graph. FIG. 4*b* shows the axial coordinate of the ion during the sequence. FIG. 4*c* shows with greater detail the axial coordinate of the ion during the rotation operation part of the sequence. Likewise, FIG. 4*d* shows the transverse coordinate of ion during the rotation operation part of the sequence.

In addition to illustrating the rotation from the transverse excitation to the axial excitation, the graphs in FIGS. 4*a*–4*d* show that the rotation operator does not conserve the energy of the ion. In particular, during the rotation from the transverse excitation to the axial excitation, the ion transfers energy to the rotation field. In other words, the rotation operator not only rotates the transverse excitation to the axial coordinate, but also quenches kinetic energy produced by the highly m/Z-specific transverse excitation. This can be advantageous because it means that the rotation operation preserves the m/Z-specificity of the transverse excitation without producing overly energized ions along the axial coordinate, which might otherwise complicate the subsequent manipulation of the ions and require collisional cooling of the translational motion with inert gases that could also lead to fragmentation. In addition the rotation operation will cool the translational motion of ions of m/Z values that are close to the specific m/Z value being transferred but are not transferred. Resonant excitation of the target m/Z will also off-resonant excite the transverse motion of neighboring m/Z ions which could complicate their subsequent manipulation. The rotation operation will also cool the transverse motion of neighboring m/Z ions.

Figure 5:
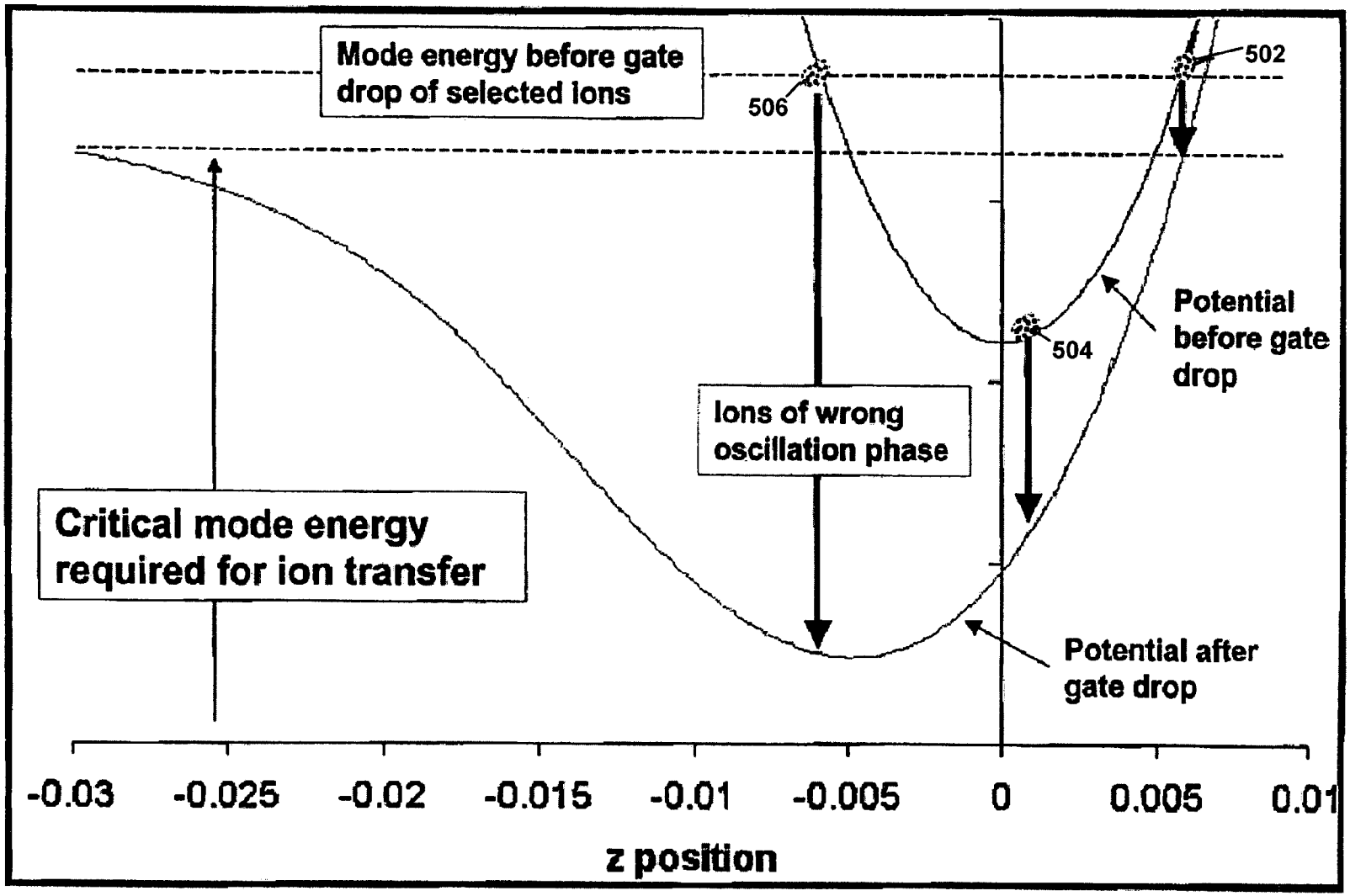
FIG. 5 is a graph showing the static or axial potential along the z-axis (x,y=0) before and after a gate drop and the affect of such a gate drop on the potential of axially excited ions.

Following the rotation operation, the selected ions oscillate within the harmonic potential along the axial coordinate with amplitude greater than that of the non-selected ions. The harmonic potential is then adjusted to lower the energy required to transfer from a selected end of the trap to an amount less than the mode energy of the selected ions but less than the mode energy of the non-selected ions. As a result, at least some of the selected ions, but none of the non-selected ions, can be selectively transferred from the ion trap along the axial coordinate. This is illustrated by the potential diagram of FIG. 5, which shows the axial potential before and after the adjustment (e.g., a DC gate drop at one end relative to the other). The energy of one of the selected ions in the new potential depends on its initial position in the new potential and on its kinetic energy just prior to the adjustment of the potential. As shown in FIG. 5, whether or not a particular one of the selected ions has sufficient energy to transfer depends in part on its phase just prior to the gate drop. For example, ions 502 and 504 in the figure will transfer, but not ion 506. The fraction of selected ions that are transferred may be optimized by adjusting the relative asymmetry of the harmonic potential before and after the gate drop and increasing the relative mode energy of the selected ions. Within the axial oscillation period there is an optimal phase to drop the gate for a single ion but with an ensemble of ions charge coupling and ion-neutral collisions lead to phase spreading. These questions are addressed in detailed numerical models, e.g., those of FIG. 8. In any case, the sequence described above causes ions having a highly-resolved mass-to-charge ratio to be selectively transferred from the HLT.

Figure 6:
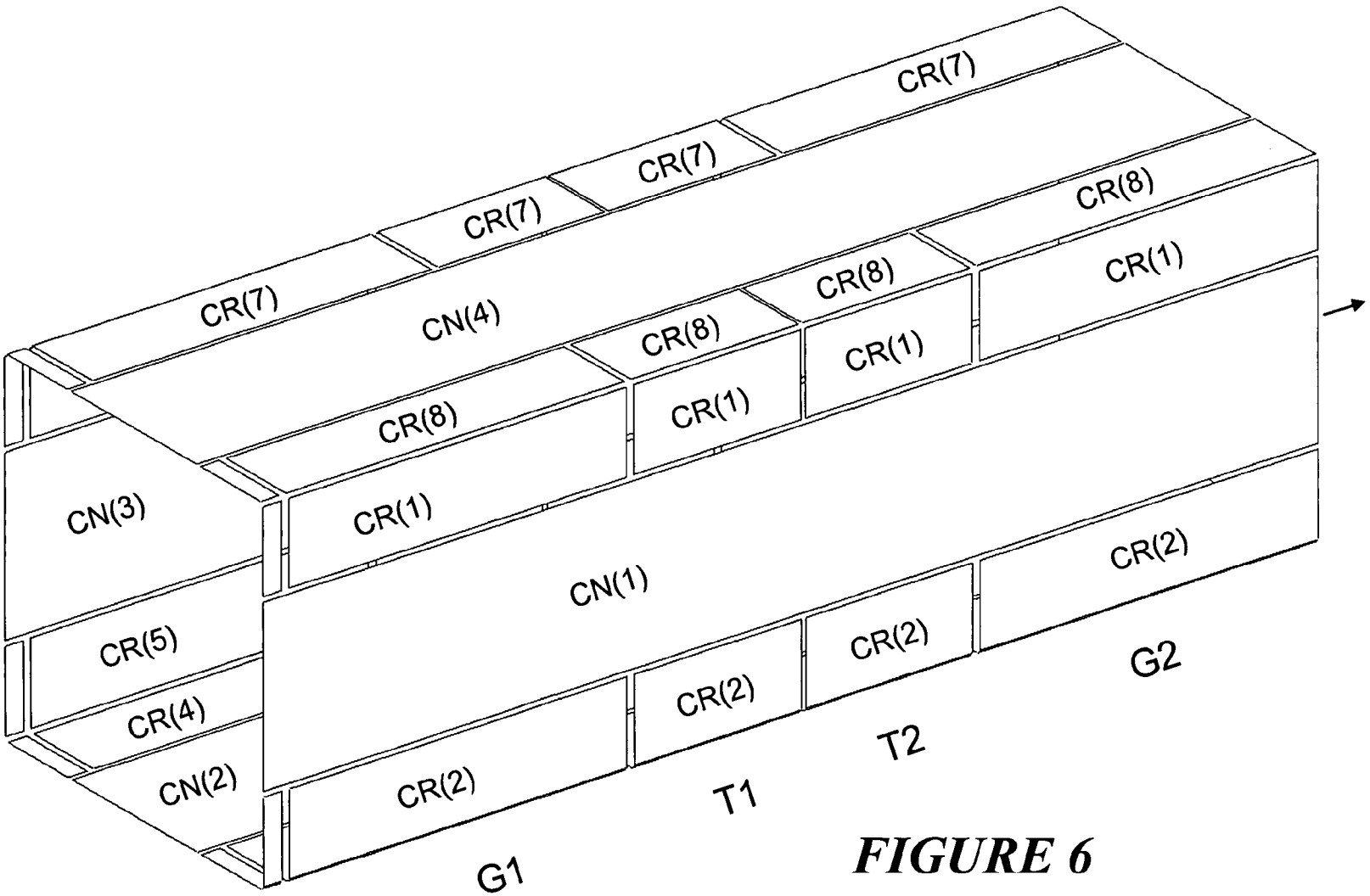
FIG. 6 is a schematic diagram showing a suitable arrangement of electrodes for generating an HLT in a neighborhood of an origin (which lies on the z axis, in the mid-plane between T1 and T2).

FIG. 6 shows a suitable arrangement of electrodes on an HLT 600 for generating the potentials and fields described in the sequence above. HLT 600 has a hollow, parallelpiped structure extending along the axial direction (i.e., along the z-coordinate), which is segmented into a pair of trapping cells T1 and T2 sandwiched by a pair of gate cells G1 and G2. Each cell includes a central electrode and two corner electrodes on each of its sides, for a total of four central electrodes and eight corner electrodes. In what follows, the symbol $V_{M,N(P)}$ indicates the voltage applied to each electrode, where the subscript M specifies the particular cell (e.g., T1, T2, G1, or G2), N specifies whether the electrode is a corner electrode (denoted by CR) or a central electrode (denoted by CN), and P is a number specifying the particular corner electrode (numbers 1 through 8) or central electrode (numbers 1 through 4) in question. The numbering is done clockwise based on viewing the structure from the negative end of the z-axis and is specified in FIG. 6 to label the electrodes visible therein.

The central electrodes are used to generate RF trapping fields and are isolated from the DC and AC sources. The RF potentials applied to the central electrodes are as follows:

$$V^{RF}_{M,CN(P)}=\begin{Bmatrix} V_{RF}(t),\ P=2,4 \text{ and all } M \\ -V_{RF}(t),\ P=1,3 \text{ and all } M \end{Bmatrix}. \quad (9)$$

These RF potentials are maintained throughout the sequence. Typical parameters for $V_{RF}(t)$ include amplitudes in the range of about 1 to 10 kV and frequencies in the range of about 300 KHz to 3 MHz. The isolation of the RF electrodes from the AC and DC electrodes and the maintenance of the RF field parameters throughout the sequence simplify the associate RF power circuitry.

To generate the DC potential for the trapping field the following potentials are applied to the corner electrodes:

$$V_{M,CN(P)}^{DC} = \begin{Bmatrix} V_T,\ M = G1,\ G2 \text{ and all } P \\ -0,\ M = T1,\ T2 \text{ and all } P \end{Bmatrix}. \tag{10}$$

These DC potentials are maintained throughout the entire sequence until they are adjusted (as described below) to transfer the selected ions.

To generate the potentials for the transverse excitation, an additional potential, an AC potential, is applied to the corner electrodes on the T1 and T2 center cells as follows, where, in this particular embodiment, the transverse coordinate selected for the excitation is $\hat{r}=(\hat{x}+\hat{y})/\sqrt{2}$:

$$V_{M,CR(P)}^{AC} = \begin{Bmatrix} (V_{AC}/2)\sin(\omega_{r,(m/Z)_1} t),\ P = 1, 2, 3, 4 \text{ for } M = T1, T2 \\ -(V_{AC}/2)\sin(\omega_{r,(m/Z)_1} t),\ P = 5, 6, 7, 8 \text{ for } M = T1, T2 \end{Bmatrix}. \tag{11}$$

After the selected ions have been sufficiently excited along the transverse coordinate, the transverse excitation potential given by Eq. (11) is terminated, and another set of AC potentials are applied to the corner electrodes to generate the rotation fields. The AC rotation potentials are as follows:

$$V_{M,CR(P)}^{AC} = \begin{Bmatrix} (V_{AC}^{Rot}/2)\sin[(\omega_{r,(m/Z)_1} - \omega_{z,(m/Z)_1})t],\ P = 1, 2, 3, 4 \text{ and } M = T1, G1 \\ -(V_{AC}^{Rot}/2)\sin[(\omega_{r,(m/Z)_1} - \omega_{z,(m/Z)_1})t],\ P = 5, 6, 7, 8 \text{ and } M = T1, G1 \\ (V_{AC}^{Rot}/2)\sin[(\omega_{r,(m/Z)_1} - \omega_{z,(m/Z)_1})t],\ P = 5, 6, 7, 8 \text{ and } M = T2, G2 \\ -(V_{AC}^{Rot}/2)\sin[(\omega_{r,(m/Z)_1} - \omega_{z,(m/Z)_1})t],\ P = 1, 2, 3, 4 \text{ and } M = T2, G2 \end{Bmatrix}. \tag{12}$$

Figure 7:
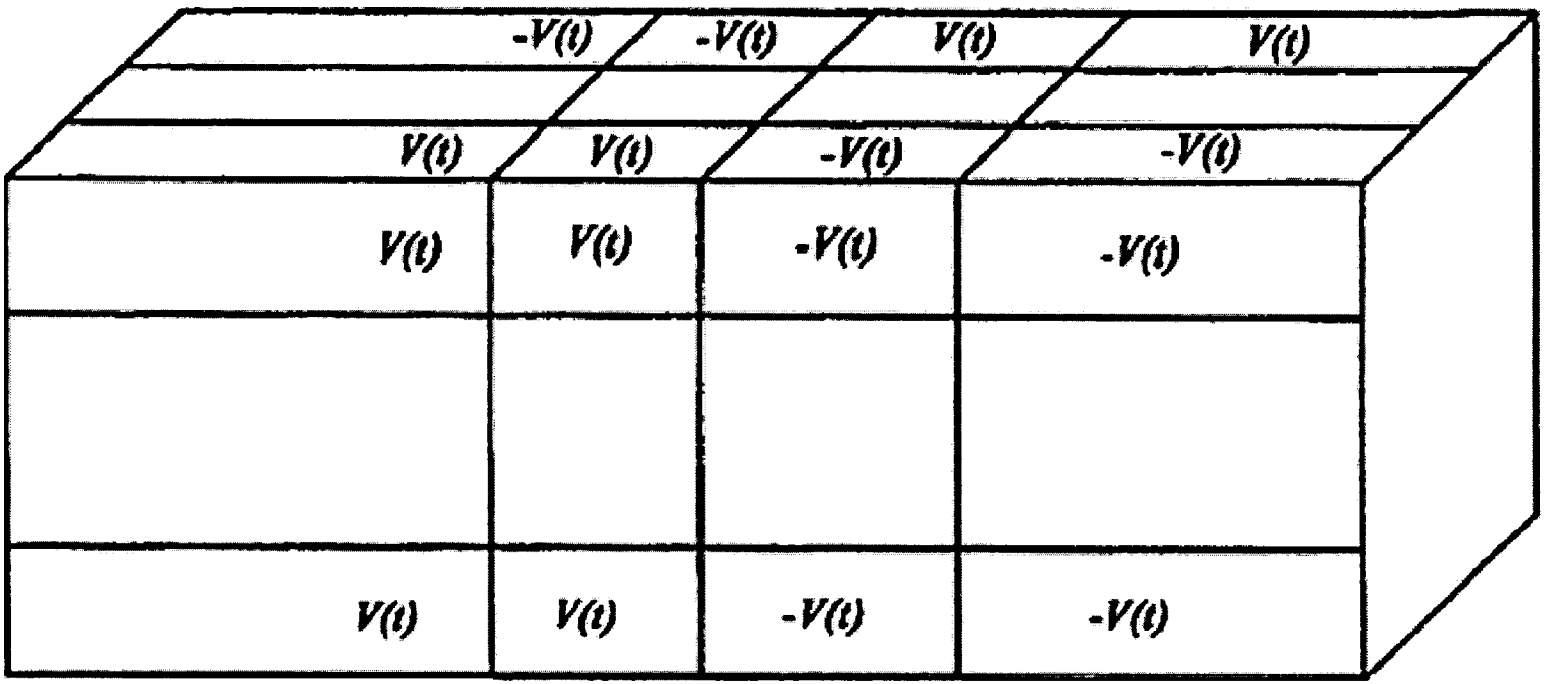
FIG. 7 is a schematic diagram of an HLT segment showing suitable AC potentials applied to the corner electrodes for generating the rotation operation.

FIG. 7 illustrates the application of the AC potential to the corner electrodes to produce the rotation field. In another, preferred embodiment, the rotation potential is only applied to the corner electrodes of the center two cells (M=T1, T2 but not G1 and G2) but with the same voltage distribution on the T1, T2 corner electrodes as shown in (12). This leads to a simpler switching circuit.

After the rotation potential rotates the transverse excitation to an axial excitation, the AC potential to the corner electrodes is terminated, and the ions that were selectively excited can be ejected from the trap by adjusting the DC potentials described in Eq. (10). For example, to eject the selected ions, the DC potentials may be adjusted as follows:

$$V_{M,CR(P)}^{DC} = \begin{Bmatrix} V_T, M = G1 \text{ and all } P \\ V_T' < V_T,\ M = G2 \text{ and all } P \\ 0,\ M = T1, T2 \text{ and all } P \end{Bmatrix}. \tag{13}$$

We note that the amplitude VT of Eqns. (13) is generally less than what is applied during the transverse excitation and rotation operations and $V_T'$ smaller still—in order to direct the ions through the G2, and not the G1, gate. Directing ions in the +z direction, as opposed to the −z direction, is also possible by selecting the proper phase of the z oscillation when lowering the gate potentials. Moreover, an adjustment to one of both of T1 and T2 may also be used during the transfer step. Obviously, in other embodiments, a transverse coordinate different from that defined in Eq. (11) may be used, in which case the deployment of the rotation potential to the different corner electrodes described in Eq. (12) is changed accordingly. In general, the transverse excitation may be with respect to a transverse coordinate that is a superposition of x and y, in which case the transverse excitation generally leads to an elliptical orbit for the selected ions in the x-y plane.

Figure 8A:
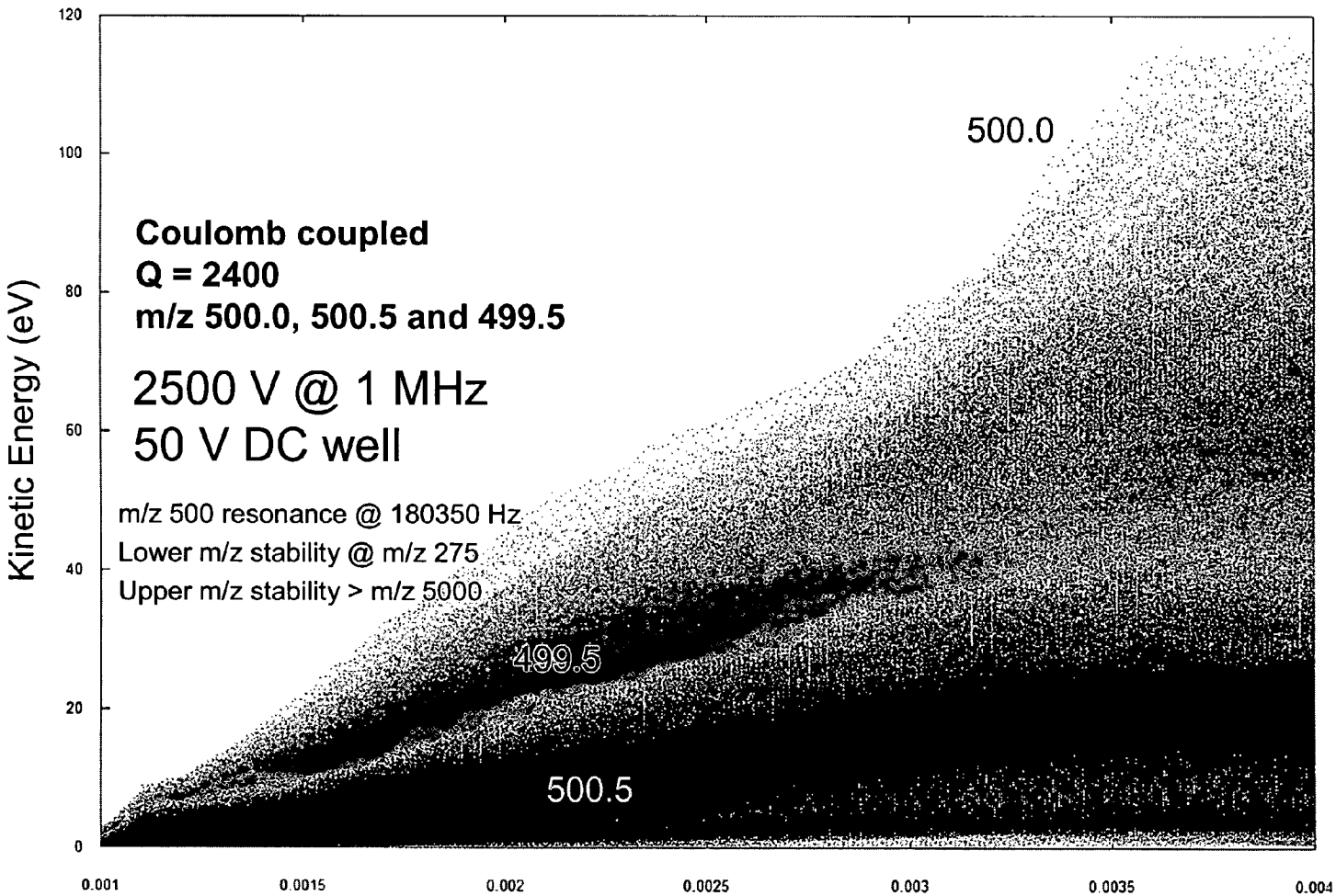
FIGS. 8*a* and 8*b* are graphs showing the results of a computer simulation illustrating the resolution of the rotation operation described herein.
Figure 8B:
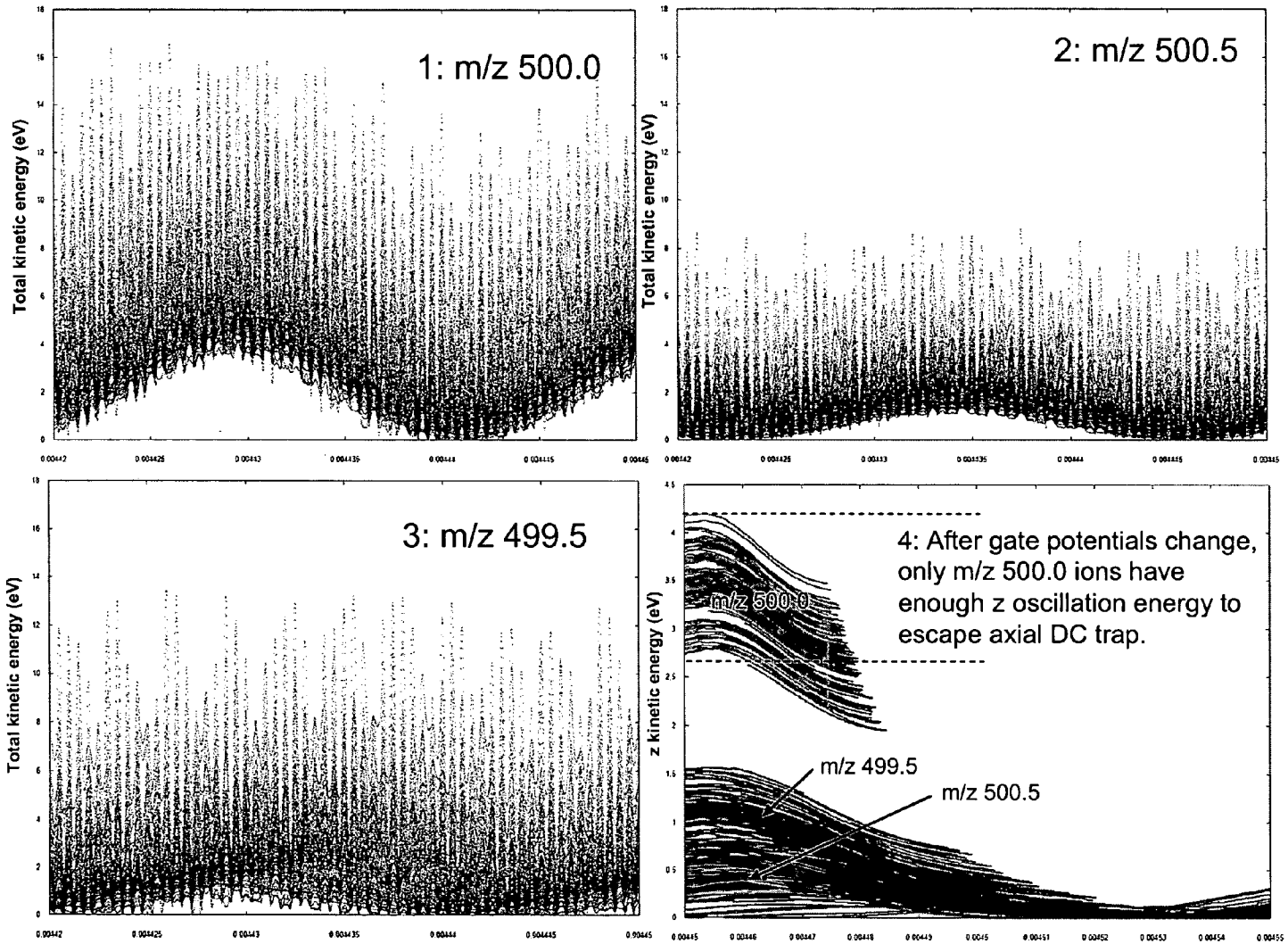

FIGS. 8*a,b* are graphs showing the results of a computer simulation illustrating the resolution of the rotation operation described above. The simulation calculates the electric fields by a highly accurate boundary element method and incorporates both ion-neutral collisions and space charge interaction during the trajectory evolution. The simulation tracks an ensemble of doubly-charged ions having a mass-to-charge ratio (m/Z) of 499.5, 500 and 500.5 Th (mass 999.0, 1000.0 and 1001 amu). The ions are trapped in the HLT with $1\times10^4$ torr of helium at 323 K as a background gas. The ensemble is first collisionally equilibrated at high pressure ($1\times10^{-3}$ torr of nitrogen at 323 K) to prepare starting conditions and then further equilibrated for $1\times10^{-3}$ s at $1\times10^{-4}$ torr of helium before starting the dipolar excitation. The parameters of the simulation are as follows. The trap had a rectangular cross-section of 2 cm by 2 cm. The DC trapping field was set to 50 V on the corner electrodes CR(1)–CR(8) of gate cells G1 and G2 of FIG. 6. The RF trapping field was set to 2.5 kVop at 1 MHz. The transverse dipolar excitation was set at a frequency of 180.350 kHz and applied for $1\times10^{-4}$ s at an amplitude of 2.0 V on the corner electrodes of T1 and T2 (as described in equation 11 above) and then the voltage was reduced to 0.5 V for $2.9\times10^{-3}$ s. FIG. 8*a* shows the m/Z-specific increase in the Mathieu oscillations (by plotting ion kinetic energy as a function of time) during the dipolar excitation. The rotation voltage was then set to 8 V (on CR electrodes of T1 and T2 as shown in equation 12 above) at 158.8 kHz and applied for 0.00045 s. FIG. 8*b* 1–3 shows the total kinetic of the ions during the last 30 microseconds of the rotation. The high frequency motion ('micromotion') at the main RF drive frequency of 1 MHz sits on top of the lower frequency axial oscillations and these plots show both the specific transfer of radial to axial excitation and the reduction in the total ion kinetic energy. After 0.00045 s the DC gate potentials were then lowered to 2 V (from 50 V) and FIG. 8*b* 4 shows just the kinetic energy in the z motion for the ion ensemble for a short time following the lowering of the DC gate potential. Each line in the graph of FIG. 8*b* 4 shows the z-coordinate of one of the ions as a function of time following the lowering of the DC gate potential. FIG. 8*b* 4 shows that all of the ions having the m/Z of 500 have z kinetic energy in the range from 2.5 to 4 eV and would therefore transfer from the trap, whereas all of the ions having m/Z of 499.5 and 500.5 have z kinetic energy less than 1.6 eV and would remained confined within the axial DC potential of the HLT.

In yet further embodiments, the rotation operation may be used in traps for which the linear dynamics near the origin are not explicity described by Eqs. (3–5). For example, the axial trapping dynamics may be different from that of the harmonic oscillator dynamics corresponding to Eq. (5). Axial trapping dynamics may also involve an RF trapping field and take a form described by the Hill Equation. In any such embodiments, the rotation operation is generally useful for high mass-specificity when Eq. (7) is applicable and axial transfer of the selected ions is preferred. Furthermore, in yet additional embodiments, the symmetry with respect to the transverse coordinates may be broken.

The electrode structure and applied potentials in the presently described embodiment produce the linearized ion dynamics described by Eqs. (3–5) in the central region of the trap. They also produce the fields required for the high-resolution axial transfer of ions having a selected m/Z value. For example, the electrode structure and applied potentials can produce the rotation potential described by Eq. (8) in the central region of the trap. The fact that such linearized dynamics and high-resolution manipulation are possible is a direct consequence of the electric field's symmetry and the fact that the ions remain near the center axis of the trap during the all of the m/Z-selective transfer steps. In particular, there is a central point in the trap wherein the trapping electric field vanishes, this point we define as the origin. In the vicinity of the origin, the ion dynamics are effectively described by linear operators, including the dynamics associated with the forces used to transversely excite and rotate the selected ions. Accordingly, embodiments of the invention relating to the use of the rotation operation for high-resolution mass-selection may include many concrete arrangements of electrodes and trap structures that are different from the embodiment described above. What is important is that whatever arrangement is used permits the ion manipulation in which motion in one oscillating linear mode r(t) with a significant Fourier amplitude at $\omega_1$ can be converted into motion in another oscillating linear mode z(t) with significant Fourier amplitude at $\omega_2$ by a linear operator (representing an electric force) with an electric potential having a $\omega_1-\omega_2$ time-dependence (or at least a significant Fourier amplitude at $\omega_1-\omega_2$) and a r*z spatial dependence near the origin (e.g., Eqn. (8)). The mode conversion can be used when the dynamical objective is to put amplitude into one (target) oscillatory mode of the ion with high m/Z specificity and this cannot be done by direct inhomogeneous or parametric forcing of the mode. Where it is possible to excite another mode with high m/Z-specificity this mode can first be excited and the mode amplitude can be converted into the target oscillatory mode by the rotation operation as was described above.

We also note that to the extent the transverse excitation and/or rotation operation drive the selected ions to regions of the trap where the dynamics start becoming non-linear, the frequency of the respective AC potentials may be varied in such a way as to remain resonant with any changes in $\omega_{r,(m/Z)_1}$ and $\omega_{z,(m/z)_1}$ caused by such non-linear regions.

As described above, the series of HLTs in the high-resolution subsection may used to perform an $MS^{(N)}$ analysis. Such an analysis is now described.

Figure 9:
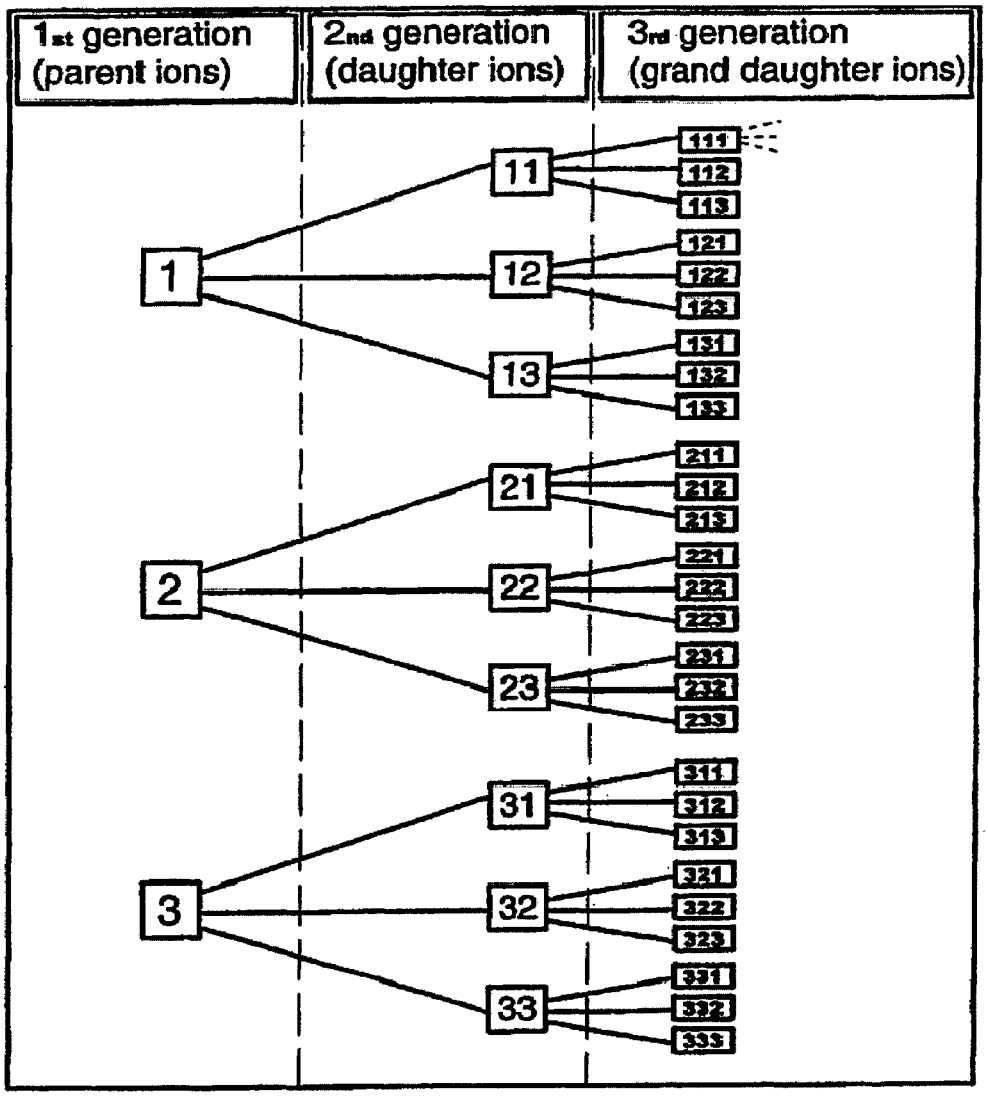
FIG. 9 is a schematic diagram showing a branched $MS^3$ analysis.

Referring to FIG. 9, a "branched $MS^3$" method is illustrated using a flow chart showing all the possible fragmentation channels for a hypothetical mixture of three molecular ions. The primary mixture represents the first generation of ions, annotated by numbers (1), (2) and (3), and shown in the first column. Dissociation products of these ions ($MS^2$) are shown in the next column and connecting lines show the relation between parent and product ions. Here it is assumed (for simplicity) each molecular ion generates three fragments. Numbers also track the relation between parent and product ions, e.g., two fragments of ion (1) are annotated as (11) and (12). The second generation of fragments may also undergo fragmentation to produce ions of the third generation ($MS^3$). The fragments of ion (11) are shown as a mixture of (111), (112) and (113). The chart shows the "genealogy" of three generations and tracks channels of individual ion formation. In practice, it is possible that multiple members of the fragment ions forming the chart will be chemically identical; however, since they are formed via different fragmentation channels isolating and analyzing each separately will yield additional useful analytical information. The method can be extended by adding extra cells and all subsequent (higher order $MS^{(N)}$) generations of fragments can be similarly tracked by adding to the annotation of digits.

TABLE 1

| Step Name | Ion Types in cell 142a | Ion Types in cell 142b | Ion types in cell 142c | |
|---|---|---|---|---|
| 1. Ion injection | 1, 2, 3 | 0 | 0 | |
| 2. Partial non selective a to b | 1, 2, 3 | 1, 2, 3 | 0 | |
| 3. Non selective b to c | 1, 2, 3 | 0 | 1, 2, 3 | |
| 4. Eject/mass analyze c | 1, 2, 3 | 0 | 0 | (→$MS^1$) |
| 5. Selective a to b | 2, 3 | 1 | 0 | |
| 5. Fragmentation in b | 2, 3 | 11, 12, 13 | 0 | |
| 7. Partial non selective b to c | 2, 3 | 11, 12, 13 | 11, 12, 13 | |
| 8. Eject/mass analyze c | 2, 3 | 11, 12, 13 | 0 | (→$MS^2$) |
| 9. Selective b to c | 2, 3 | 12, 13 | 11 | |
| 10. Fragmentation in c | 2, 3 | 12, 13 | 111, 112, 113 | |
| 11. Eject/mass analyze c | 2, 3 | 12, 13 | 0 | (→$MS^3$ of ion 1 starts) |
| 12. Selective b to c | 2, 3 | 13 | 12 | |
| 13. Fragmentation in c | 2, 3 | 13 | 121, 122, 123 | |
| 14. Eject/mass analyze c | 2, 3 | 13 | 0 | (→$MS^3$ of ion 1) |
| 15. Selective b to c | 2, 3 | 0 | 13 | |
| 16. Fragmentation in c | 2, 3 | 0 | 131, 132, 133 | |
| 17. Eject/mass analyze c | 2, 3 | 0 | 0 | (→$MS^3$ of ion 1 ends) |
| steps 5–17 for ion 2 | 3 | 2 | 0 | |
| steps 5–17 for ion 3 | 0 | 3 | 0 | |

Table 1 shows an example of ion manipulation and storage for a complete $MS^3$ analysis of a single ion species from an ion packet composed of ion species 1, 2 and 3. The table explicitly illustrates only the steps for the full $MS^3$ analysis of ion 1; the analysis of 2 and 3 would be identical except for different excitation frequencies (corresponding to different m/Z values) used for selective transfer and fragmentation. The mixture of ions 1, 2, 3 is initially injected into HLT 142*a*. In the second step part of the ion packet is non-selectively transferred to the next HLT 142*b*. In the third step, the ion mixture is then non-selectively transferred to the last cell HLT 142*c*, and in the fourth step the ion content of the last cell is ejected and mass analyzed, providing information corresponding to an $MS^1$ analysis. The details of such mass analysis will be described subsequently. The cycle of the first four steps permits determination of the masses of primary ions. In step 5, ion 1 of a predetermined mass is selectively transferred from HLT 142*a* to HLT 142*b*. In step 6, the ion species 1 in HLT 142*b* is fragmented, for example, by applying a selective AC excitation. Alternatively, steps 5 and 6 can be combined if ions are accelerated by a sufficient DC offset between HLTs 142*a* and 142*b*. The masses of ion fragments are characterized in steps 7 and 8. The small portion of ion content of the HLT 142*b* is moved to HLT 142*c* and subsequently mass analyzed, thus providing information corresponding to an $MS^2$ analysis. The $MS^3$ analysis starts with steps 9, 10 and 11 in which the fragment 11 in HLT 142*b* is mass-selectively transferred to HLT 142*c* where it is dissociated and the fragments 111, 112 and 113 are ejected and mass analyzed. Then in steps 12, 13 and 14, the fragment 12 is subjected to an $MS^3$ analysis by mass-selective transfer from cell 12*b* to 12*c* where it is dissociated and the fragments 121, 122 and 123 are ejected and mass analyzed. Then in steps 15, 16 and 17, the fragment 13 in HLT 142*b* is mass-selectively transferred to HLT 12*c* where it is dissociated and the fragments 131, 132 and 133 are ejected and mass analyzed, thus completing the $MS^3$ analysis of ion 1. It is possible that ions of the sampled m/Z value will not be removed completely in the steps of selective sampling. The ions remaining in HLT 142*b* can then be ejected and mass analyzed in order to improve the signal to noise ratio of the $MS^2$ analysis previously conducted in step 8. The same protocol could then be applied to the remainder of ion species 1 in HLT 142*a* or ion species 2 and 3 in HLT 142*a*. The protocol described allows unambiguous identification of the m/Z of the parent ion of a fragment even if all the ions of a particular m/Z ratio are not selectively transferred. It remains important, however, that non-selective transfer, e.g., in the ejection for mass analysis, be complete.

Sampling a small portion of any of the HLT's content into an external mass spectrometer will allow the use of economic data dependent algorithms, in which information about fragment masses is known before the subsequent steps of selective ion sampling. For example, the ion fragments identified in the $MS^2$ spectrum of the initial samplings of the parent ion could be flagged for $MS^3$ analysis in subsequent samplings. In each of the subsequent samplings, after the known $MS^2$ fragments are transferred to HLT 142*c* and $MS^3$ analyzed, residual $MS^2$ fragments in HLT 142*b* can be ejected and mass measured to improve the $MS^2$ dynamic range. At a later point, the $MS^2$ ion fragments identified after multiple samplings of ions of a given species could then be added to the $MS^3$ list.

The branched MS/MS analysis can be used to follow all the channels of fragmentation of a particular ion using all of the ion material initially injected into the trap to thereby improve sensitivity and selectively of $MS^{(N)}$ analysis, or, if desired, the first ion sampled can be fragmented and mass analyzed and then the second ion (still resident in the first storing cell) can likewise be sampled and analyzed, and so on and so forth. The versatility and power of the branched MS/MS method can thus be appreciated.

Accordingly, the high-resolution subsection is configured and operates to select particular parent ion(s) of interest, to fragment the ions of interest, to detect the resultant product ions, and then repeat the selection/fragmentation/detection processes a number of times. Moreover, the system provides a "select and store" feature that enables a highly sensitive $MS^{(N)}$ method to be carried out in which the isolation/fragmentation sequence for a particular sampled ion may be extended by additional steps to obtain more structural information of sampled ions or in which individual constituents of a mixture may be efficiently and cost effectively analyzed. The advantages of $MS^{(N)}$ techniques, especially the additional information available to the analyst, and the various strategies that may be employed in interpreting results have been described in the literature. For example, dissociation of an ion fragment can produce new types of product ions that may not be observable in single-stage MS/MS (metastable or CID) analyses. In addition, specific structural features such as linkage types may be identified by the hierarchy of ion fragmentation, particularly when such identification is difficult to achieve by measurement of mass alone (e.g., for isobaric ion fragments).

While the particular strategy to be employed depends on the type of sample being analyzed, techniques for analyzing data and arriving at useful results are within the skill of the ordinary artisan. Guidance may also be had by referring to recent publications in this field. For example, Ngoka and Gross in J Am Soc Mass Spectrom 1999, 10, 732–746 describe strategies for $MS^{(N)}$ analysis of cyclic peptides. Lin and Glish in Analytical Chemistry, Vol. 70, No. 24, Dec. 15, 1998 disclose techniques for C-terminal peptide sequencing via multistage ($MS^{(N)}$ mass spectrometry. Also, the role of $MS^{(N)}$ in the analysis of carbohydrates, and the strategies for interpreting results, is described by Solouki et al. in Analytical Chemistry, Vol. 70, No. 5, Mar. 1, 1998.

As described above, the high-resolution subsection of mass spectroscopy system 100 provides high m/Z-specificity and $MS^{(N)}$ analytical functionality, including the advantage of retaining ions that are not be analyzed during a particular stage of the $MS^{(N)}$ analysis. However, the accuracy of the high-resolution subsection can degrade when the charge of the ions trapped therein produces Coulombic coupling forces that undermine the sequential manipulations described above for transferring ions having a selected m/Z value. The multipole accumulation trap, on the other hand, will have a charge capacity that is up to a million-fold greater than the capacity of the HLT. Assume the objective is to analyze the $MS^{(N)}$ spectra of a specified m/Z window. If the first HLT were simply filled to its charge capacity with an ion population that reflected the m/Z distribution in the accumulation trap the HLT would have few ions of the targeted m/Z unless these ions were dominant components of the ion population in the accumulation trap. Such a limitation may degrade the analysis. The low-resolution subsection addresses this issue by sequentially transferring subsets of ions from the multiple pole ion trap to the high-resolution subsection with low m/Z specificity (resolution), but maintaining this m/Z specificity with much greater charge loads.

Referring again to FIG. 2, the low-resolution subsection includes four transfer stages: i) a non-mass-specific transfer from multiple pole ion trap 120 to linear ion trapping or ion guide region 132*a*; ii) a first m/Z-specific transfer between region 132*a* and linear ion trap 132*b* via m/Z gate 134*a*; iii) a second m/Z transfer of some ions from ion trapping region 132*b* back into region 132*a* via the RF m/Z gate 134*a* (generally with different DC offsets) and iv) a second m/Z-specific transfer of ions remaining in linear ion trapping region 132*b* into linear ion trapping region 132*c* via the RF excitation gate 134*b*.

The non-mass specific transfer from multiple pole ion trap 120 into region 132*a* is accomplished by dropping a DC gate voltage. During ion accumulation in the multipole trap the DC voltage on 132*a* is held high enough to push the ions away from the RF-fringe fields between the multipole field and the quadrupole field of coupled trap array in order to avoid RF heating of the ions. For transfer the DC voltage is lowered to draw ions into 132*a*. However the fringe RF fields between the trap 120 and region 132*a* will repel ions with significant radial amplitude. Notably, however, the RF field (including the repelling fringe field) vanishes on the z-axis due to the symmetry of all multipole fields in both 120 and 132*a*. As a result, the lowering of the DC gate voltage can be selected to transfer only those ions near the center of the multiple pole ion trap. Although such ions may include a large range of m/Z values, they are not ions executing large radial trajectories in the multiple pole ion trap (which would not be near the axial center of the trap) and thus they typically have small kinetic energies when injected into the quadrupole field of region 132*a*, which makes them easier to manipulate in region 132*a*. After a time sufficient to transfer a desired amount of ions, the DC gate voltage is restored to its previous level and the entire ion population is collisionally cooled by pulsed or background neutral gas. The 132*a* region may be dynamically configured as a linear ion trap or as an ion guide region by the electronic controller. Collecting ions first in 132*a* configured as an LIT and then directing them through the m/Z gate 134*a* into LIT 132*b* will reduce the collisional broadening of the ion's z velocity incident to the m/Z gate 134*a* which may improve the m/Z resolution compared with taking the ions out of the accumulation trap 120 and directly sending them into the RF gate 134*a* with 132*a* region configured as an ion guide. However, the charge capacity would be greater when 132*a* is configured as an ion guide since only ions that pass through the m/Z gate have to be trapped in a quadrupolar field. The choice is a matter of the electronic controller program. In a preferred embodiment the entire region downstream of the RF gate 134*a* can be dynamically configured as an extended LIT by the electronic controller. This will allow collisional cooling of the z motion so that ions are not reflected back through the RF gate 134*a* by the axial DC gate terminating the LIT region. The RF excitation gate 134*b* will not influence transversely unexcited ions and can form part of the downstream LIT. After a period to allow collisional cooling the LIT region 132*b* can be dynamically configured by the controller (by assigning DC offsets) so that ions collect in just this region.

In a preferred embodiment, the electrodes for each of LIT 132*a*, 132*b*, and 132*c* are similar in cross-section (within a constant z-plane) to those described above for HLT 600 in FIG. 6. The segmentation along the z-axis is, however, different. Each trapping region and gate region includes four central electrodes (one on each face) and eight corner electrodes (two surrounding each central electrode on each face). The central electrodes are again used to generate the RF trapping fields and are isolated from the other electrodes and from the DC and AC power supplies. The RF potentials described by Eqs. (2) and (9) are applied to the central electrodes. DC potentials are applied to the corner electrodes of each region, however, the DC potential between each region typically differs, and are adjusted to either axially confine ions to a specific trap region or to transfer ions between trap regions.

The two mass-specific transfer stages in the low-resolution subsection are based on axially localized modifications in the extended RF trapping field common to the entire coupled trap array. These modifications are produced in the RF gate regions 134*a* and 134*b* by axially localized modifications in the electrodes. The function of the spatially structured RF fields is explained as follows.

Within the majority of each LIT region in the low-resolution subsection, and within the high-resolution HLT array, the RF trapping field produced by the axially extended RF electrodes does not vary with axial position. As a result, the trapping RF field does not affect the axial dynamics of the ions. On the other hand, the RF gate regions may include alterations to the RF electrodes (e.g., holes) or to the DC electrodes or additional RF and/or DC electrodes that modify the RF trapping field and introduce additional DC fields in the gate region. Although an analytical solution for the trajectories in the presence of such fields can be quite complicated, they can be determined numerically and individual electrode geometries evaluated numerically. Such an analysis can yield a multitude of embodiments, all of which involve trade-offs between mass selectivity, z-velocity, RF heating and fabrication costs, however, the fundamental concepts can be described quite generally. Below, we describe the fundamental concepts and then we provide some concrete examples.

Figure 10A:
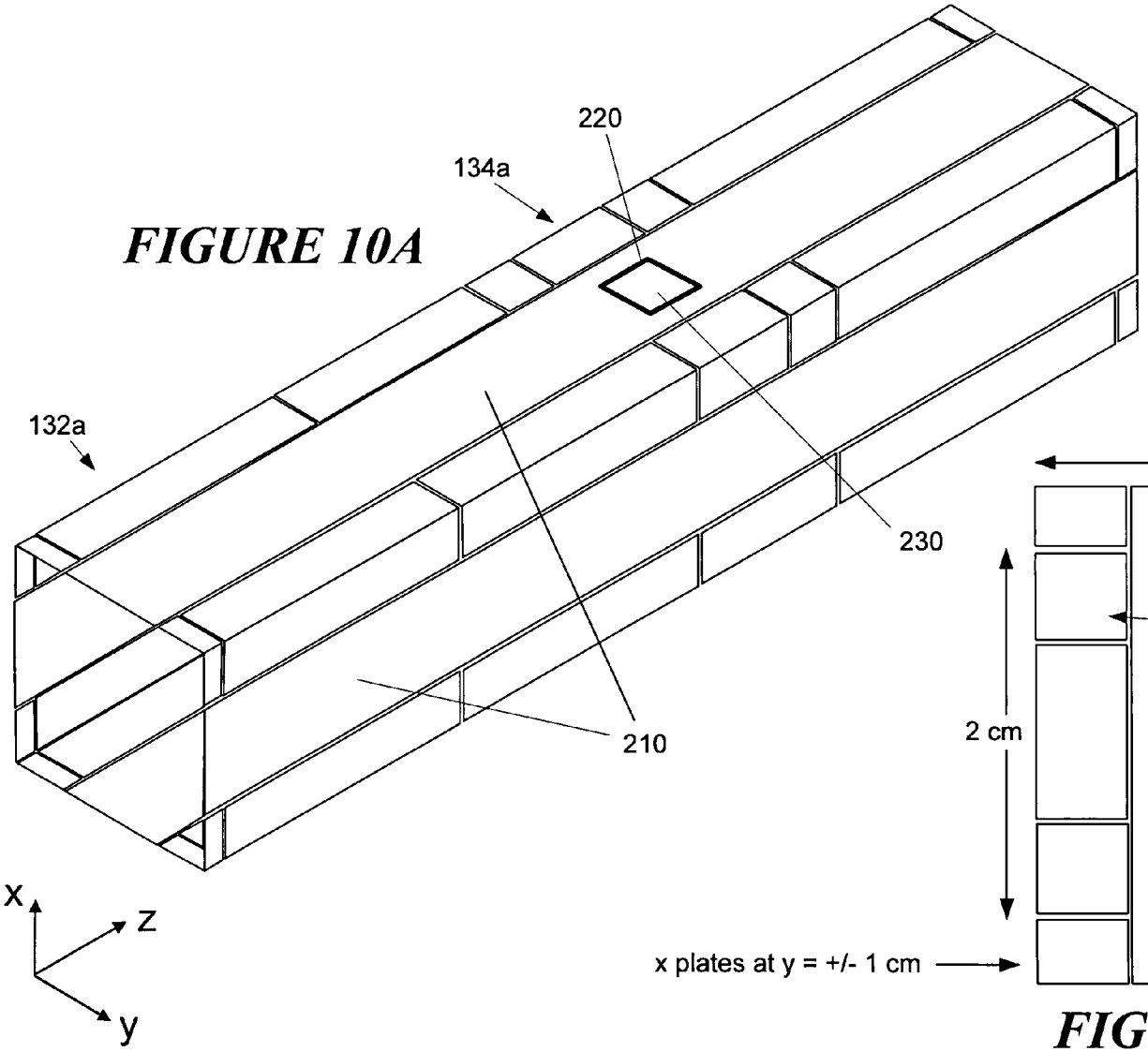
FIGS. 10*a*, 10*b*, 10*c*, and 10*d* are schematic drawings showing an electrode arrangement for an m/Z gate.

The RF field modifications disclosed in this document have been characterized as RF m/Z gates and RF excitation gates. An embodiment of m/Z gate 134*a* is illustrated in FIG. 10*a* and we will consider this device and the principles of its operation first. The introduction of holes 220 in the axially extended RF electrodes 210 on a single pair of opposed plates (e.g., the x pair) results in an oscillating (at the RF drive frequency) axial potential at the z-axis in the vicinity of the hole and interior to the transverse RF trapping field. Where the potential has a z spatial gradient there is a z component of the electric field and therefore an axial force on the ion. The axial force is oscillatory and the ions respond by oscillating in the z direction at the drive frequency. The effect of the paired holes on the RF field is localized (the 'defect region', below) and the axial electric field at the z axis first increases as the ion enters into the defect region from the uniform RF trapping field upstream or downstream of the defect region. Where the axial electric field changes with z displacement, the axial force from the positive and negative phase of the field's oscillation no longer balances. If the electric field is increasing with z, the repelling force integrated over the oscillation cycle at greater z displacement is larger than the attracting force integrated over the lesser z displacement so that the ion experiences an averaged repelling force away from the direction of increasing field strength. The magnitude of this averaged axial force is m/Z dependent. As the ion continues into the defect region (if it has sufficient initial momentum) then there is a point at which the axial force then begins to decreases with z displacement so that the averaged result becomes an attractive force into the center of the defect. If the holes are extended in the axial direction then the axial forces exist at the entrance and exit of the defect region and rapidly vanish inside. Even though the potential in the center of the defect region is oscillating (relative to some instrument ground) there is no local z spatial gradient, hence no axial electric field, hence no axial force. Inside the defect region and away from the defect boundaries there is a transverse quadrupolar field of reduced amplitude (relative to the transverse RF field outside the defect region) local to the z axis. For ions incident on the defect boundaries from inside the defect region, the axial force is again first repelling so that the entire defect region can operate as a linear ion trap with RF caps instead of DC caps. Used as an RF m/Z gate this is a problem in that some ions might become trapped inside the defect region and acquire excess internal energy (hence fragment) from RF heating. Putting an electrode interior to the holes and applying a repelling DC potential to this electrode (and no RF) reduces the likelihood ions will be trapped inside the defect region. There is a practical tradeoff in that the ions should then be given higher incident velocities to compensate for the added DC repulsion. The repulsion due to the DC potential is not m/Z-dependent and this, combined with the increased axial kinetic energy spread from collisions with background neutral gas, results in lowered m/Z resolution.

Figure 10B:
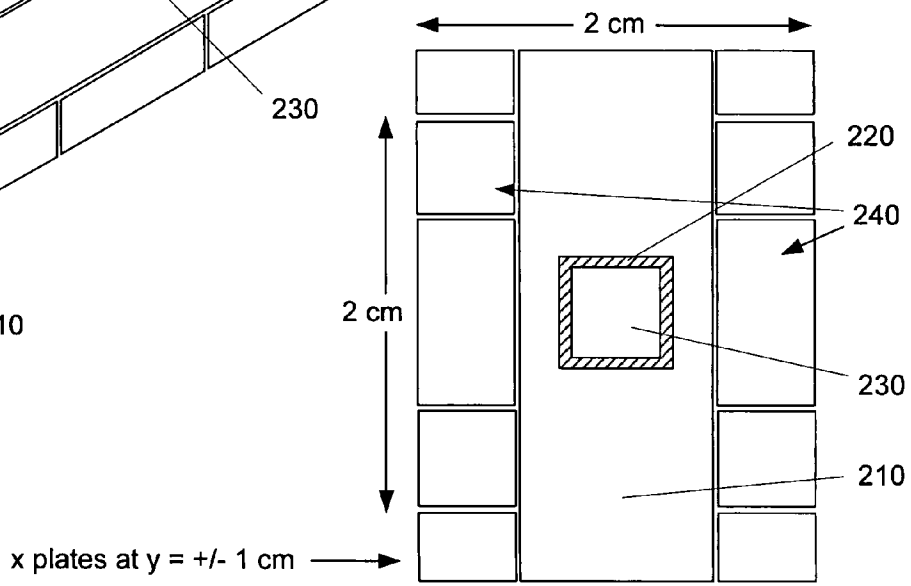
Figure 10C:
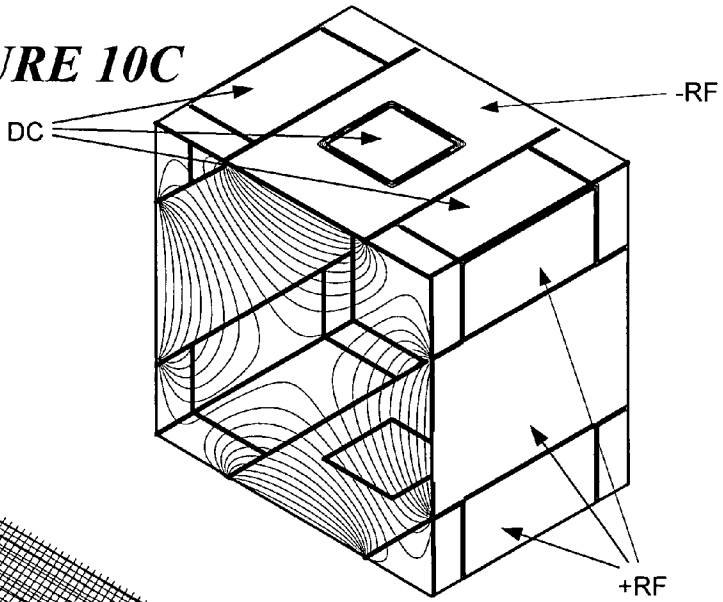
Figure 10D:
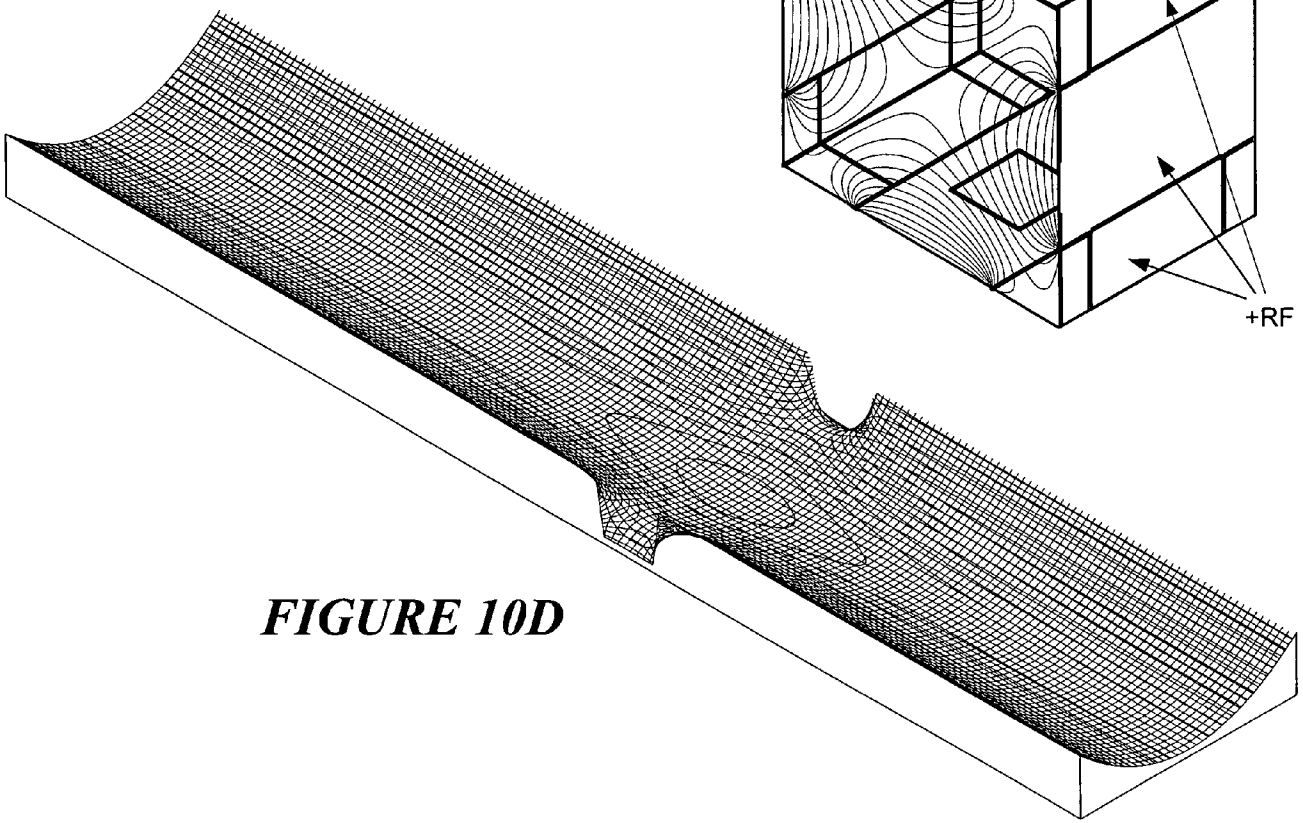

FIGS. 10*a* and *b* show the electrode structure for a preferred embodiment of the RF m/Z gate 134*a*. Referring to FIG. 10*a*, which shows a perspective view, the center regions on the four faces of the structure all function as RF electrodes, except that the RF electrode is modified at gate 134*a* to include holes 220 on x pair of opposed RF electrodes 210. The holes are replaced with separate DC electrodes 230. The corner regions are also DC electrodes and are axially segmented to provide control over the axial motion of the ions. FIG. 10*b* shows a plan view of the x-face of the electrode structure, illustrating DC electrode 230 in the hole 220 of central RF electrode 210. FIG. 10*b* also shows the segmented DC electrodes 240 at the edges of the x-face. FIG. 10*c* shows the extension of one phase of the RF potential onto the corner electrodes in the region of the gate and the exclusion of the opposite phase RF potential from the electrode centered in the hole in the opposite phase RF electrode. This creates the axial RF electric field in the center of the trap. FIG. 10*d* shows the RF potential at a fixed phase along a plane bisecting the defect holes. The ellipsoidal potential contours are the RF bump that generates the m/Z-specific axial force. FIG. 10*c* also shows that on the y-faces of the electrode structure at the axial segment corresponding to holes 220, the central RF electrodes can extend to the corners of the structures to accentuate the RF field assymmetry, thereby increasing the m/Z-specific axial force.

Figure 11:
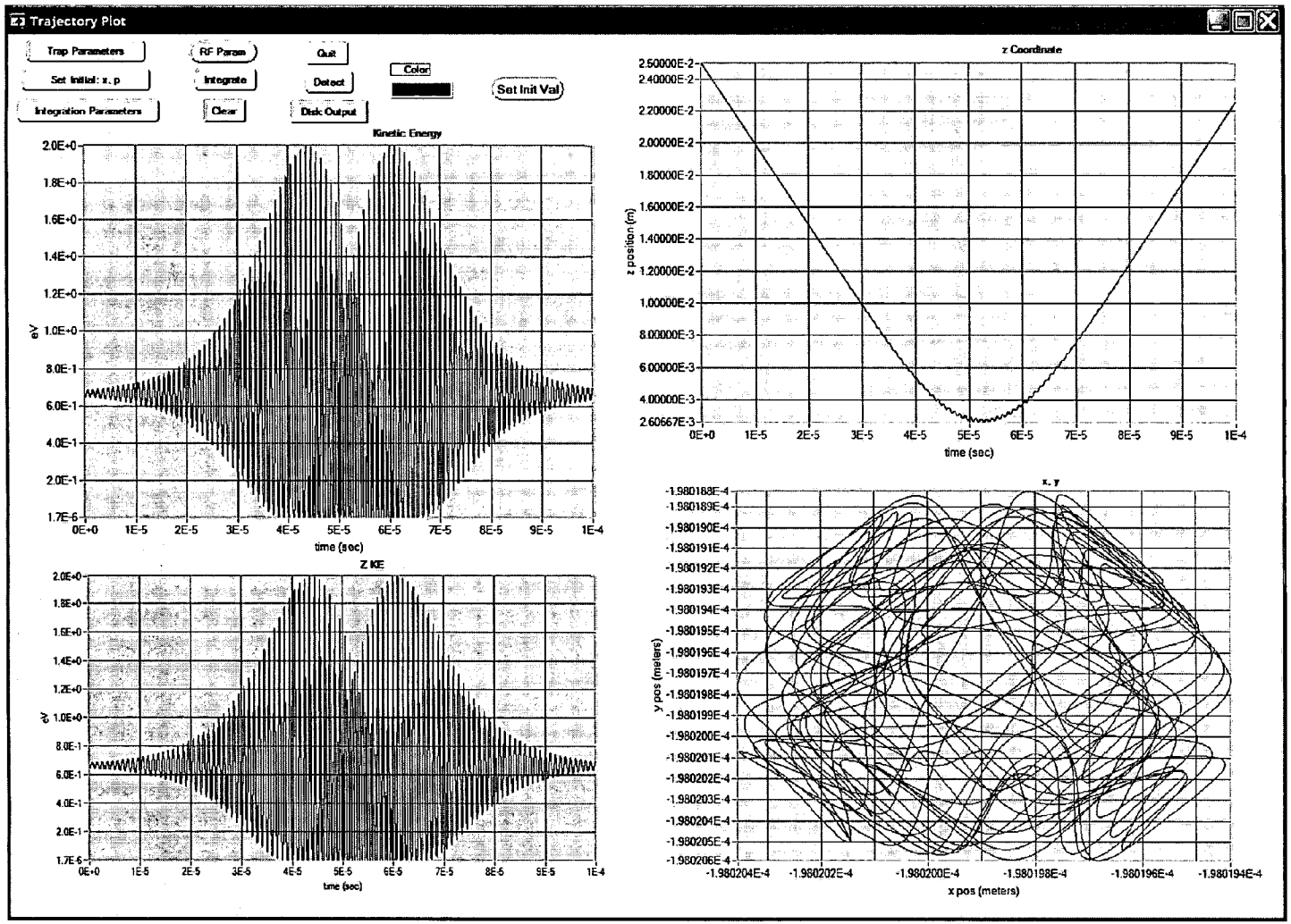
FIG. 11 shows a simulation for the trajectory of ions in the m/Z gate of FIGS. 10*a–d*. Z KE denotes kinetic energy with respect to motion along the z-coordinate and x pos denotes the value of the x-coordinate.

FIG. 11 shows a number of aspects of the trajectory corresponding to an ion that is reflected from the RF m/Z gate of FIGS. 10*a–d*. The most significant dynamical aspects are the lack of transverse excitation required for reflection and the high energy z oscillation at the drive frequency (here 1 MHz) as the ion enters the defect region. Higher incident kinetic energy or greater mass-to-charge ratio for the ion will enhance the probability of transmission through the RF m/Z gate. Transverse oscillation amplitude has little effect.

Figure 12:
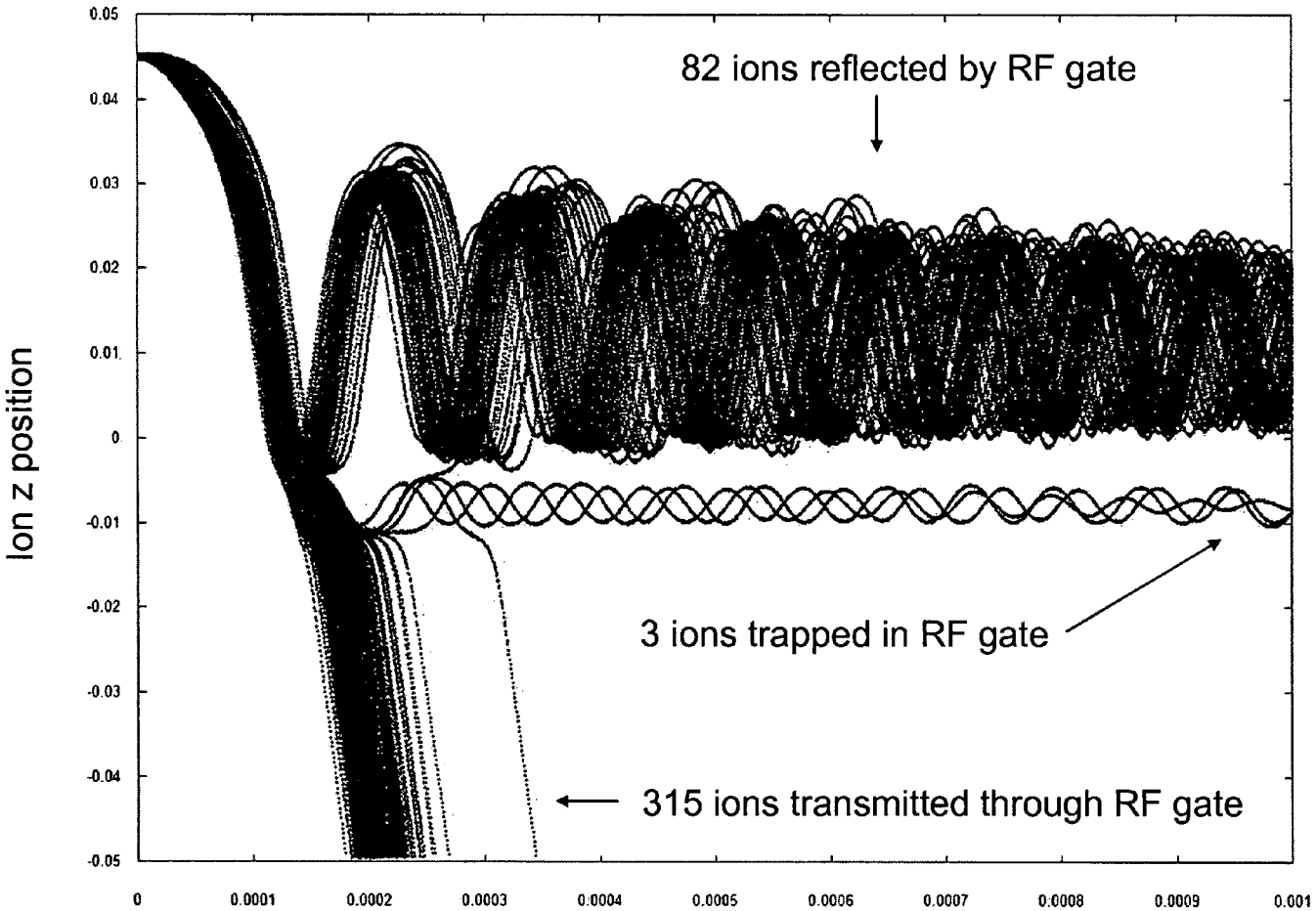
FIG. 12 is a graph showing the axial position of an ensemble of ions incident on the m/Z gate of FIGS. 10*a–d* as determined by a computer simulation.

To characterize the resolution of the RF m/Z gate the effect of the RF phase and the spread in z velocity due to ion neutral collisions need to be accounted for. Placing the ions in the uniform RF field outside the RF gate and setting a DC offset potential to all 8 corner electrodes (FIG. 10*a*) sets a z kinetic energy for ions incident on the RF m/Z gate. Setting a DC potential on the DC electrodes (FIG. 10*c*) reduces the likelihood of trapping ions inside the gate and also keeps the reflected ions away from the region of the RF gate (where they may be subjected to RF heating). FIG. 12 is a plot of the z trajectories of 400 ions incident upon the m/Z gate after starting in the region with a DC potential of 13.5 volts applied to the 8 corner electrodes (FIG. 10*a*). The neutral gas is helium at a pressure of $2\times10^{-4}$ torr and a temperature 323 K. The DC electrodes in the gate region (FIG. 10*c*) are set to 25 volts. The RF voltage is 2.5 $kV_{0p}$ at 1 MHz and the ion is singly-charged and of mass 575 amu. Slightly less than 1% of the ions are trapped in the defect field. They can be easily removed by setting the potential on the DC gate electrodes to 35 volts.

Figure 13:
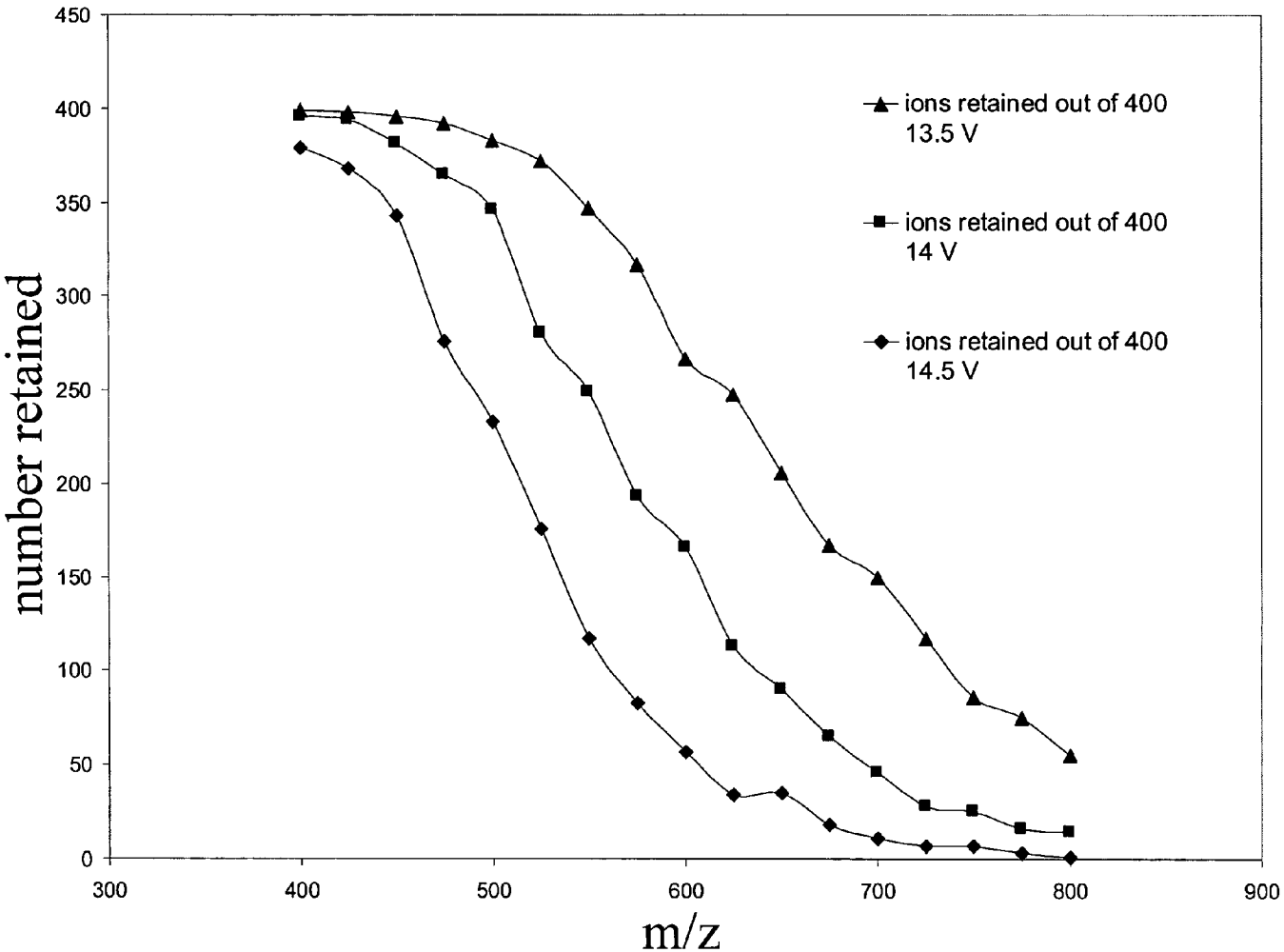
FIGS. 13 and 14 show the calculated m/Z resolution of the m/Z gate according to the simulation.
Figure 14:
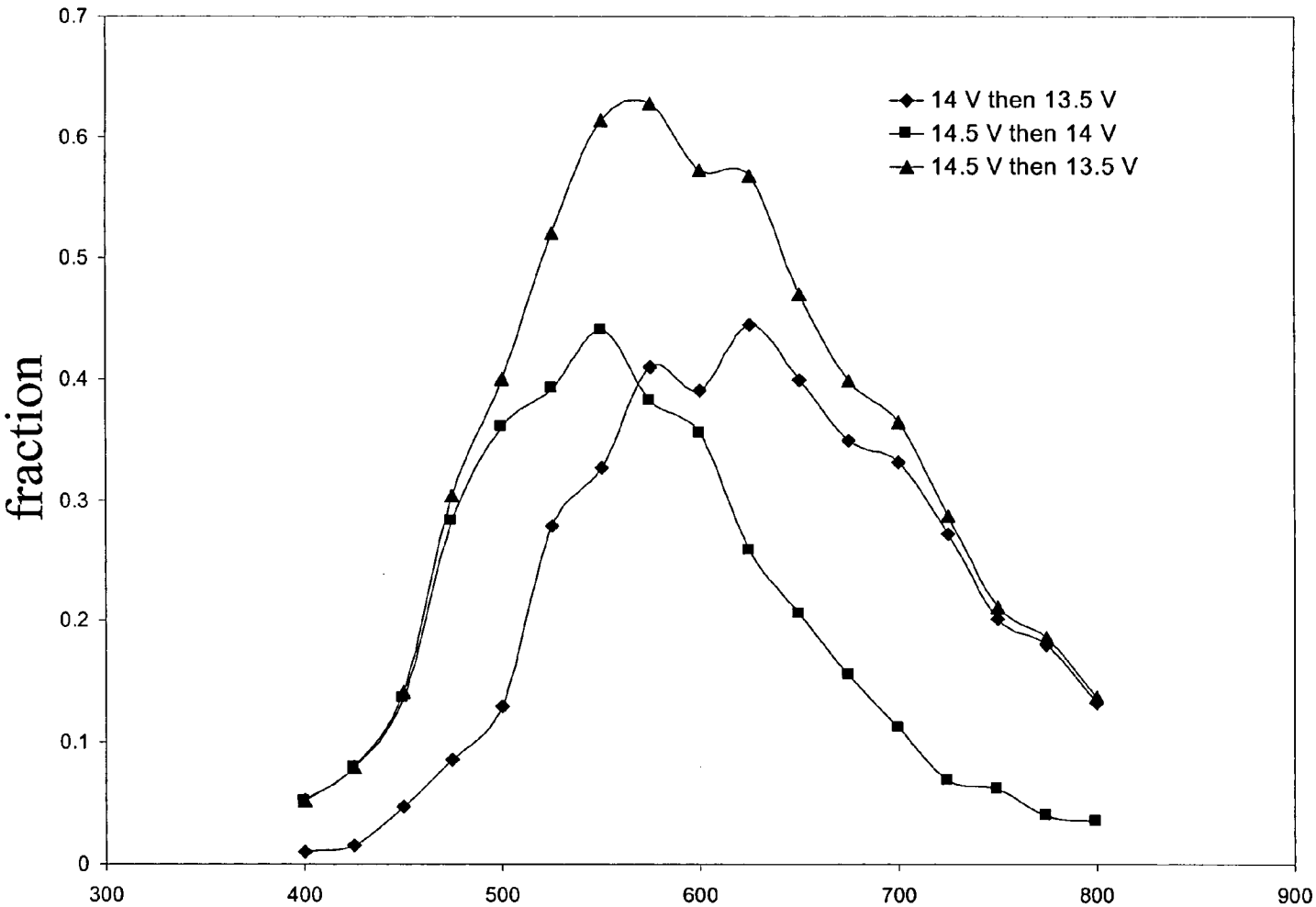

FIGS. 13 and 14 show the calculated m/Z resolution of the m/Z gate. FIG. 13 is the m/Z dependence of the transmission at different potential offsets applied to the 8 corner electrodes. In an embodiment of a method to improve the charge capacity of the coupled trap array it was disclosed (above) that directing ions into the m/Z gate at one potential offset, collecting the ions in a trapping region downstream and then directing them into the m/Z gate from the backside (the m/Z gate is completely symmetric about its z center) at a lower potential results in a narrowed m/Z range stored in the downstream trapping region. FIG. 14 is the fraction of ions retained downstream of the m/Z gate as a function of m/Z and for three DC offset pairs.

The utility of the m/Z gate method and device as a component of the overall instrument follows from the following considerations. There is no resonant excitation in this method and therefore the gate device will operate at high charge loads. As this is the first stage in the m/Z fractionation of the ion population the need for high charge capacity is highest at this stage. The translational energy of the ions remains under 5 eV (acquired as z kinetic energy in dropping off the potential plateau generated by 14.5 volts applied to the corner electrodes) hence the ions are not excessively heated in the operation. There is no ion loss associated with transit across the m/Z gate and into the various trapping regions since the ions remain interior to the extended RF trapping field. In the preferred embodiment illustrated in FIG. 10 there is very little additional mechanical or electrical cost in adding the m/Z gate. Mechanical tolerances are extremely low. The high voltage RF source will be shared with the rest of the coupled trap array and only two additional DC potentials need be defined, and only defined during the operation of the m/Z gate.

Figure 15:
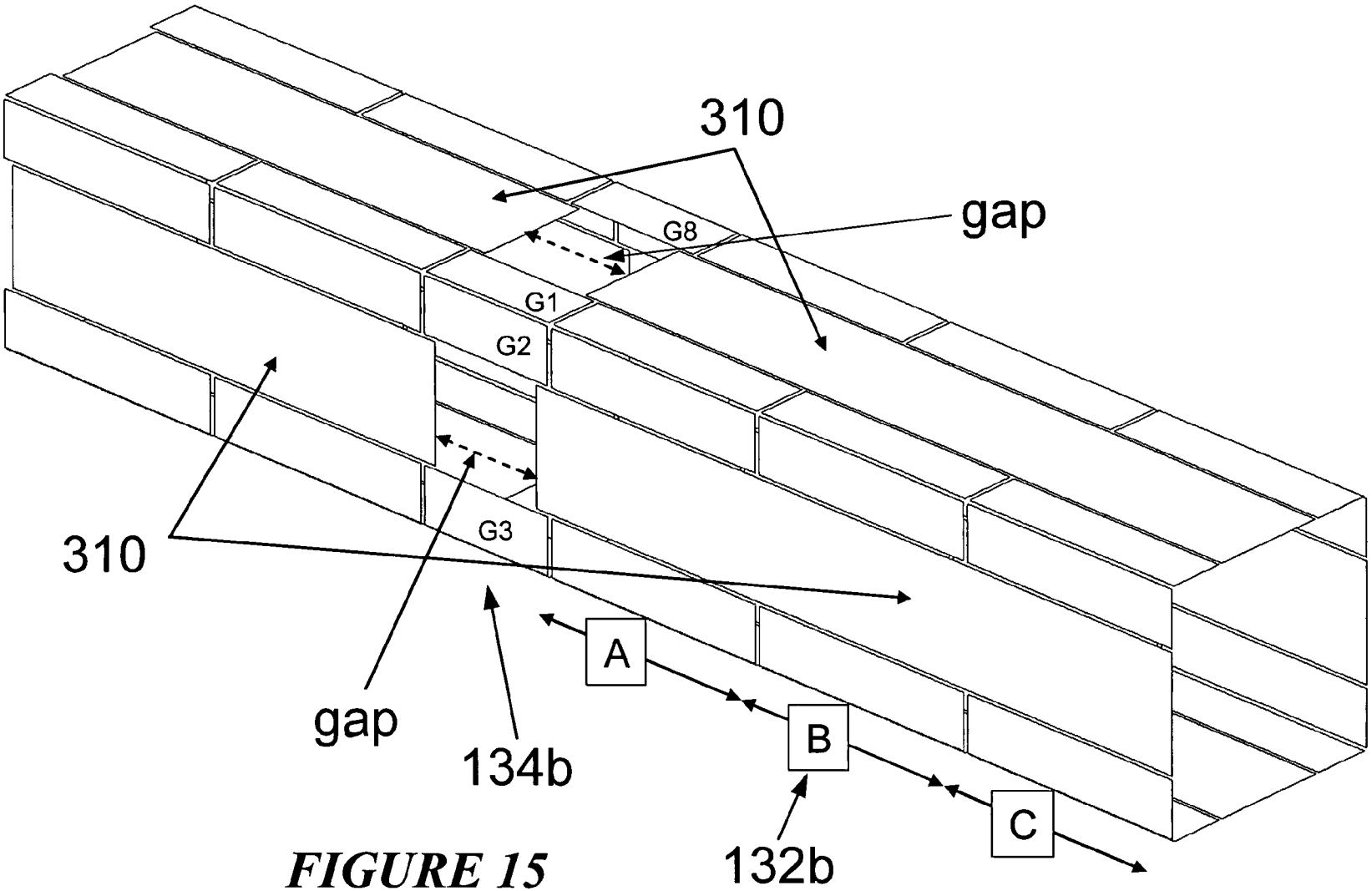
FIG. 15 is a schematic drawing of an electrode arrangement for an RF excitation gate.
Figure 16:
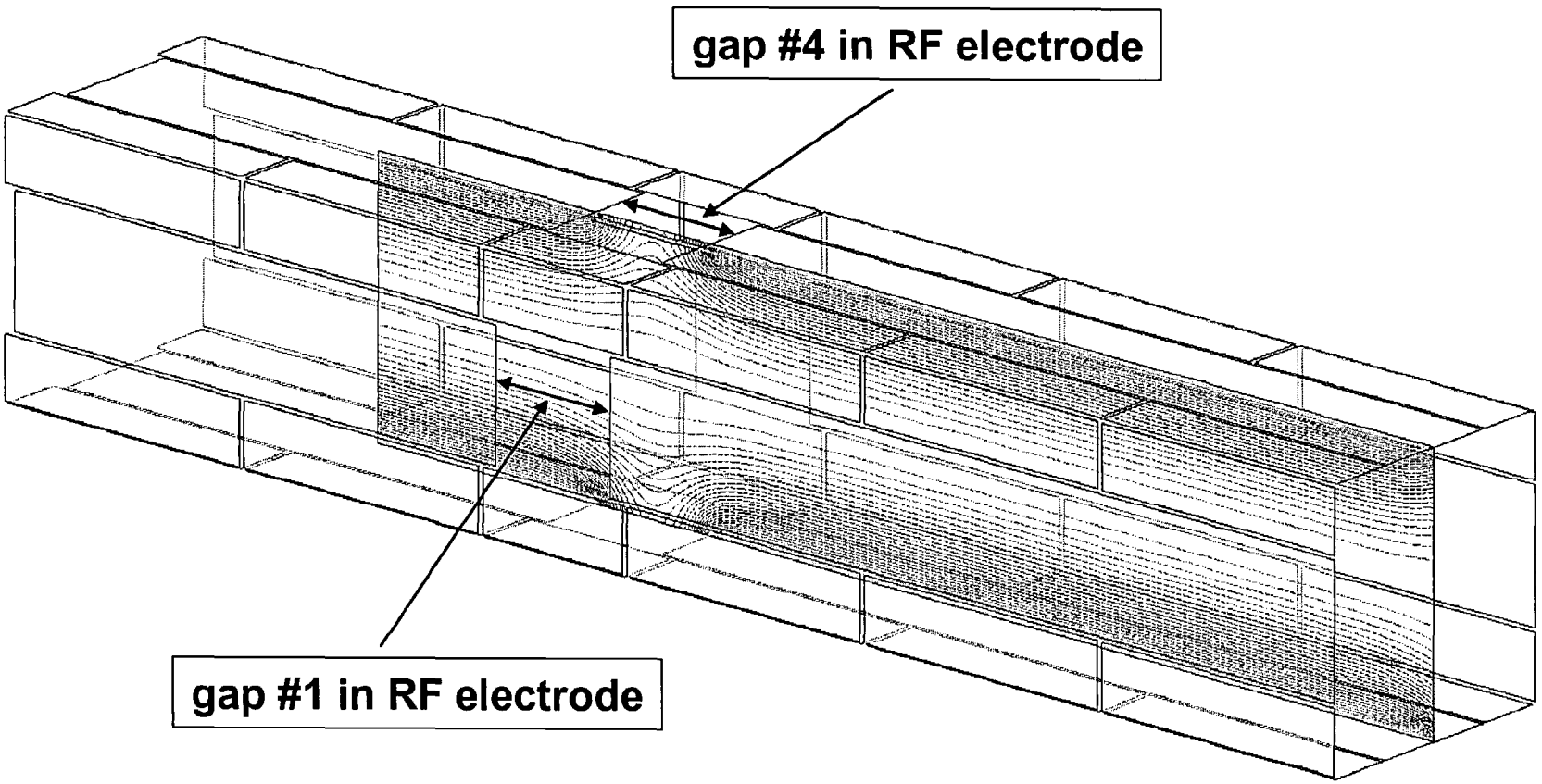
FIG. 16 shows RF amplitude field lines for the electrode arrangement of FIG. 15.

We know turn to examine the second form of RF defect which we have previously characterized as an excitation gate. In a preferred embodiment the excitation gate 134*b* is created with the same hollow, parallelpiped geometry of the HLT and the m/Z gate. The RF defect field is created by introducing holes into the RF electrodes as was done in the m/Z gate. In contrast to the m/Z gate, the holes are symmetrically placed in both the x and y RF electrodes (FIG. 15). This preserves some of the symmetries of the extended RF trapping field through the defect region; in particular, the RF field in the defect region continues to vanish on the z axis. More precisely, the fourfold symmetric placement of the holes decreases the amplitude of the RF trapping field in a z region around the holes but otherwise preserves the dominant quadrupolar symmetry of the transverse components of the RF field local to the z axis. FIG. 16 illustrates the decrease in RF amplitude in the vicinity of the holes by plotting the RF potential at a fixed phase on a bisecting plane. The magnitude of the local decrease in RF field amplitude can be controlled by adjusting the size of the holes and/or by introducing RF grounded electrodes as in the RF m/Z gate. Although the net result is an axial force on the ion, the details of the effects of the RF excitation gate on ion trajectories is markedly different from the effect of the m/Z gate.

Referring again to FIG. 15, RF excitation gate 134*b* is located where gaps (i.e., holes) are introduced between the four central RF electrodes 310. The corners regions act as DC electrodes and are again segmented axially to control the axial motion of the ions. The DC electrodes in the immediate vicinity of RF excitation gate 134*b* are typically set to a common offset. As described further below, axial segments prior to gate 134*b* are used to transversely excite ions before making them incident on gate 134*b*. For example, an AC potential can be applied to the corner electrodes of section B to transversely excite ions having a selected range of m/Z values. DC potentials provided to the corner electrodes of segments A and C are used to control when the transversely excited ions in segment B are directed to gate 134*b*.

Figure 17:
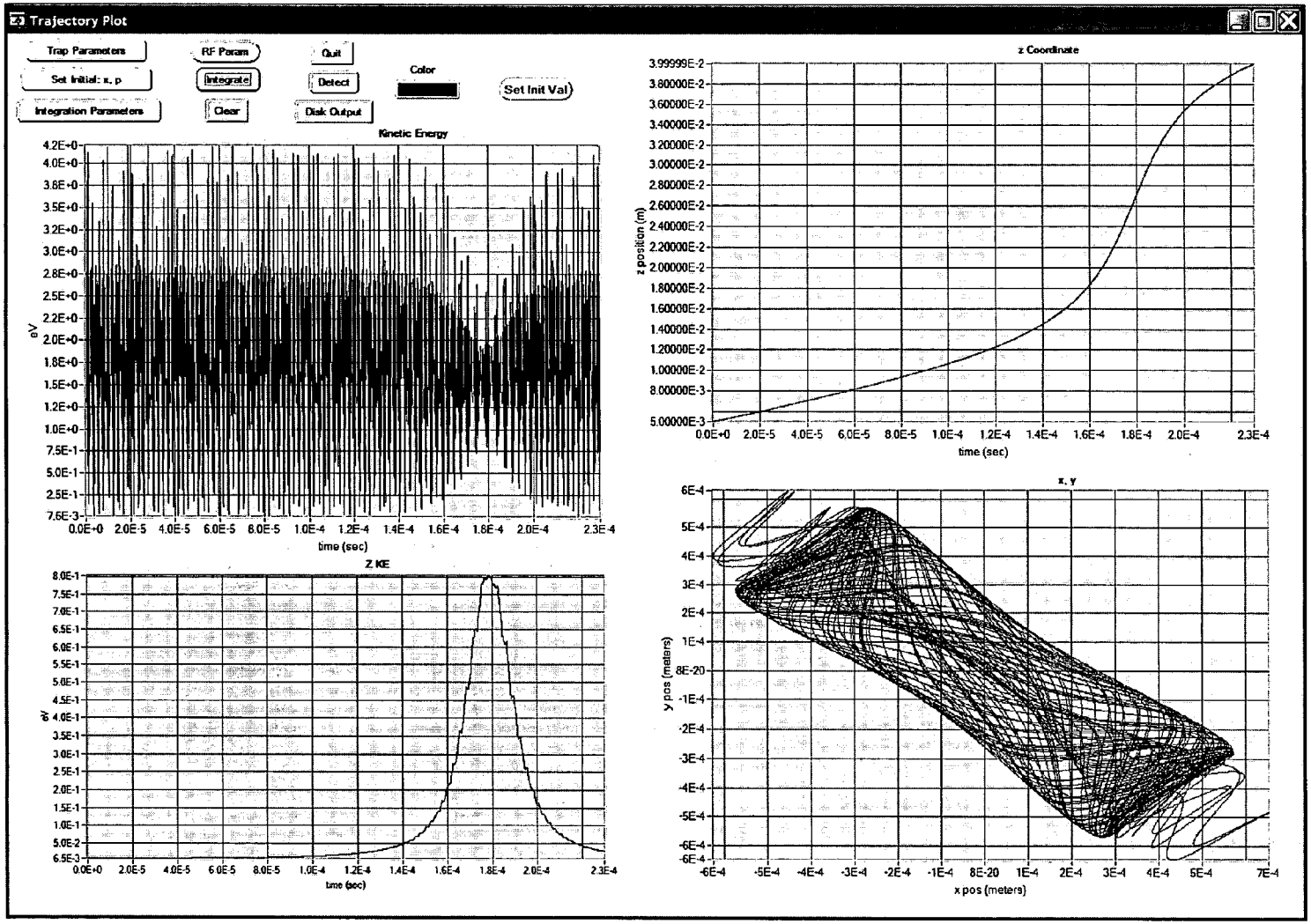
FIG. 17 shows a simulation for the trajectory of ions incident on the RF excitation gate of FIG. 15, where Z KE denotes kinetic energy with respect to motion along the z-coordinate and x pos denotes the value of the x-coordinate.

FIG. 17 shows some aspects of an ion trajectory incident on the RF defect field of the electrode geometry of FIG. 15. For this RF defect to have an effect—and in contrast to the m/Z gate—the incident ion have transverse oscillation amplitude (the RF field vanishing everywhere on the z axis) and the transverse amplitude results in the ion being pulled into and through the RF defect region. In contrast to the trajectory of the ion reflecting from the m/Z gate (FIG. 11) there is little z oscillation (FIG. 17) and the axial force pulling the ion into the defect arises from a different source than axial force imbalance between the phases of the z oscillation as we had with the m/Z gate.

In our understanding of the axial force in the excitation gate we will consider an approximate scheme in which we require the RF frequency to be high enough relative to the combination of the z-velocity of the ion and the z-gradient of the RF field so that one can effectively average over many cycles of the RF field for fixed z position. These conditions are approximately met in the embodiments disclosed herein and this scheme conveys the sense of the effect if not the quantitative detail. Quantitative detail remains the province of numerical calculation. In either case, under these conditions, the RF field produces an axial force $F_z$ that can be approximated by the negative of the derivative with respect to axial position, $\partial_z$, of the time-averaged transverse kinetic energy of the ions $\langle KE_{rad}\rangle$:

$$F_z = -\partial_z \langle KE_{\text{rad}}\rangle, \text{ where } \langle KE_{\text{rad}}\rangle = \frac{1}{T}\int_0^T \frac{m}{2}(v_x^2 + v_y^2)\,dt, \tag{14}$$

where m is the ion mass and $v_x$ and $v_y$ is the ion velocity along the x and y coordinates, respectively. Thus, one uses the axial coordinate as a parameter to calculate the average transverse oscillation energy and account for the axial dependence of the RF field, and then one calculates the axial gradient of that average transverse oscillation energy to determine the affect of the RF field on the axial ion dynamics. For example, an increase in RF magnitude tends to increase the transverse kinetic energy of a trapped ion, and thus an axial gradient of increasing RF magnitude produces a repulsive force along the axial coordinate. In the electrode geometry of FIG. 16 the transverse RF field amplitude is decreasing into the excitation gate and the incident ion of FIG. 17 experiences an attractive force. This attractive force increases as the transverse oscillation amplitude of the incident ion increases. This is a consequence of the defect field largely retaining the overall quadrupolar symmetry of the RF trapping field—again, a description that needs to hold only in a region around the z-axis.

To use the excitation gate as an m/Z-selective gate, the attractive axial force from the RF field defect is opposed by a repelling DC potential that is centered at the defect (e.g., applied to the 8 corner electrodes that are adjacent to the four holes in the RF electrodes in FIG. 15). By increasing the transverse oscillation amplitude of a subset of ions (e.g., by resonant excitation in a HLT region) and directing the entire ion population into the gate region with a common z incident kinetic energy (e.g., a kinetic energy set by a DC potential offset between the HLT region and the gate), the subset of ions with critical transverse oscillatory amplitude will have sufficient attractive force from the RF defect to counteract the repelling force of the DC potential and will cross the excitation gate. The subset of ions selected to cross is controlled by the frequency and symmetry of the excitation field in the ion trapping region.

Figures 18A, 18B:
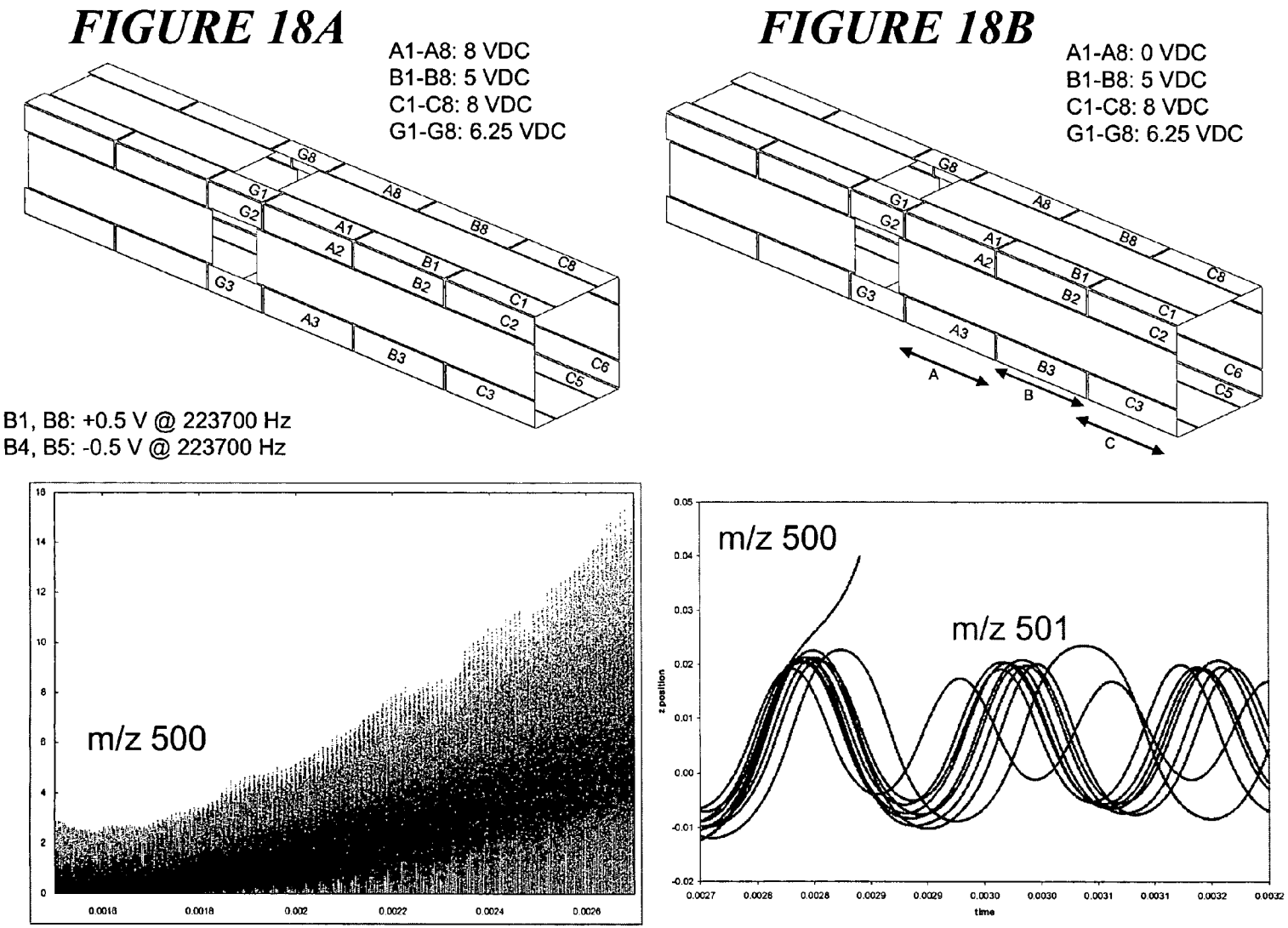
FIGS. 18*a* and 18*b* illustrate a computer simulation showing transverse excitation of ions having a selected m/Z value and the transfer of such ions through the RF excitation gate.

FIGS. 18*a* and 18*b* shows the transfer of 100% of 10 ions of m/Z 500 (singly-charged) and the transfer of only 10% of m/Z 501 in the electrode geometry of FIG. 15. Here the ions are excited near the resonance frequency of m/z 500 for about 1.2 msec (0.5 V@223.7 kHz) while trapped in region B (FIG. 18*a*). The m/Z 500 ions acquires transverse excitation amplitude of at most 15 eV before being directed toward the excitation gate; ions of other m/Z values would acquire less. Here the gate potential of 8 V applied to the corner electrodes of region A and C serves only to confine the ions during the dipolar excitation. FIG. 18*b* shows the results after the gate potential on segment A is dropped. Longer excitation regions could be used to decrease the space charge effects during dipolar excitation; some ions may then lose transverse excitation amplitude by colliding with neutral gases during diffusion out of the longer cell. Ions whose transverse amplitude was cooled by collisions may not transfer over the excitation gate but they would not be lost from the cell and could be transferred later. The simulations of FIGS. 18*a–b* had a pressure of $2\times10^{-4}$ torr He at 323 K. The excitation gate could operate at higher m/Z resolution by increasing both the excitation period together with the DC barrier centered at the gate (electrodes G1–G8, FIGS. 18*a–b*). The problem is that in contrast to the mode rotation operation disclosed above, the m/Z selection process associated with the transfer across the excitation gate does not cool the translational motion of the ions. Higher m/Z selectivity is associated with higher transverse oscillation amplitudes, hence greater kinetic energy and a greater chance of ion fragmentation. The optimal choice of resolution, transfer efficiency, charge capacity and excitation cell length are dependent of features of the analytical application and need only be defined by the operation program during the analysis. In particular the LIT region upstream of the excitation gate may contain a number of additional segments identical to A, B or C of FIGS. 18*a–b* and it is the DC applied to the eight corner electrodes that establishes the fraction of the axially extended RF field that is used as the excitation region (region 132*b*, FIG. 2).

Those m/Z-specified ions ultimately transferred to LIT 132*c* are subsequently transferred to the high-resolution subsection by adjusting the DC gate potentials between LIT 132*c* and HLT 142*a* for downstream higher resolution analysis, including, for example, $MS^{(N)}$ analysis. Following such analysis by the high-resolution subsection, the low-resolution subsection transfers additional ions to the high-resolution subsection, either with the same m/Z specificity (e.g., to provide additional ions to the high-resolution subsection for redundant analyses to improve their accuracy) or with a different, selected m/Z specificity (e.g., to provide additional information about the parent ion fragments from the sample).

In further embodiments, the RF gate and its electrode arrangement may different from those shown FIGS. 10*a–d* and 15. Many electrode configurations are possible. What is important is that the RF gate includes electrodes that generate a modification in the extended RF transverse trapping field that creates a localized axial force between a pair of ion trapping regions (or between an ion trapping region and an ion guide region). As described above, the axial gradient in the RF field associated with the axially localized field modification produces a localized axial force for ions incident on the modification. The RF force is combined with an axial DC force derived from applied DC potentials in the region of the RF gate. It is a mathematical property that the electric potential in a region without sources can be expanded in an orthogonal series of functions known as multipoles. It is a useful approximation to represent the electric potential associated with the RF transverse trapping field in the region of the field modification as a z-dependent multipole expansion. RF field modifications that produce an oscillating potential difference along the center axis generate a z-dependence in the monopole term of the multipole expansion. This is associated with an m/Z-dependent axial force. An RF field modification that creates an axial gradient in the quadrupolar component of the expansion for the transverse RF field creates a force that is both m/Z-dependent but also retains the linear increase in force amplitude that is characteristic of the quadrupolar term of the multipole expansion. This makes the axial force depend on the transverse displacement which in turn depends on the transverse oscillation amplitude which can be controlled in a highly m/Z-specific manner. This effect of the quadrupolar term and the effect of higher order terms in the z-dependent multipole expansion of the transverse trapping field are contained in expression 14 above.

Figure 19C:
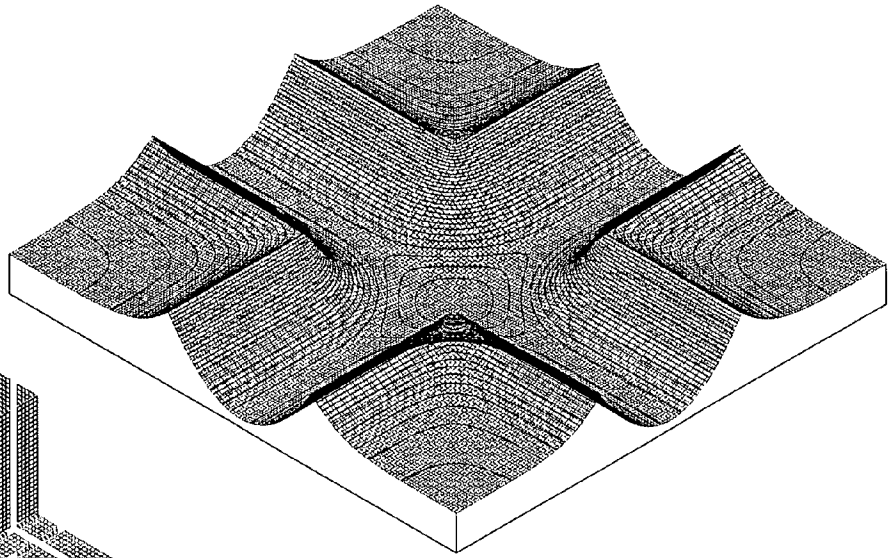
FIGS. 19*a*, 19*b*, and 19*c* relate to another embodiment of an RF gate.
Figure 19A:
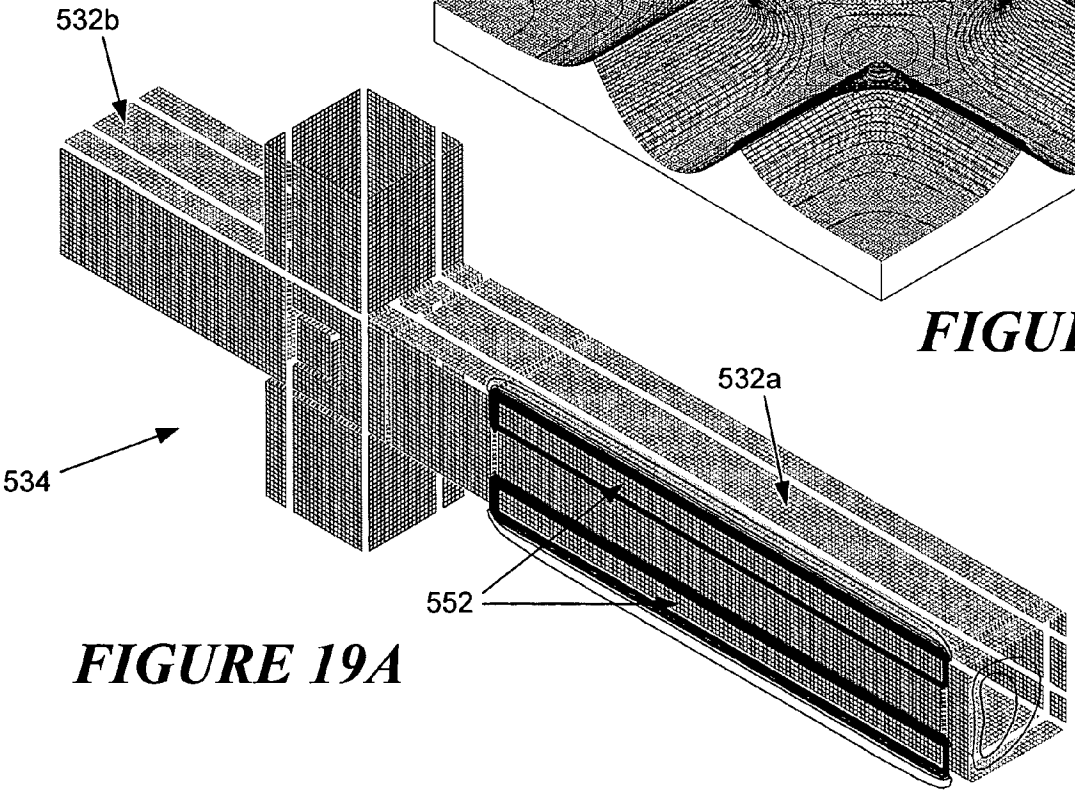
Figure 19B:
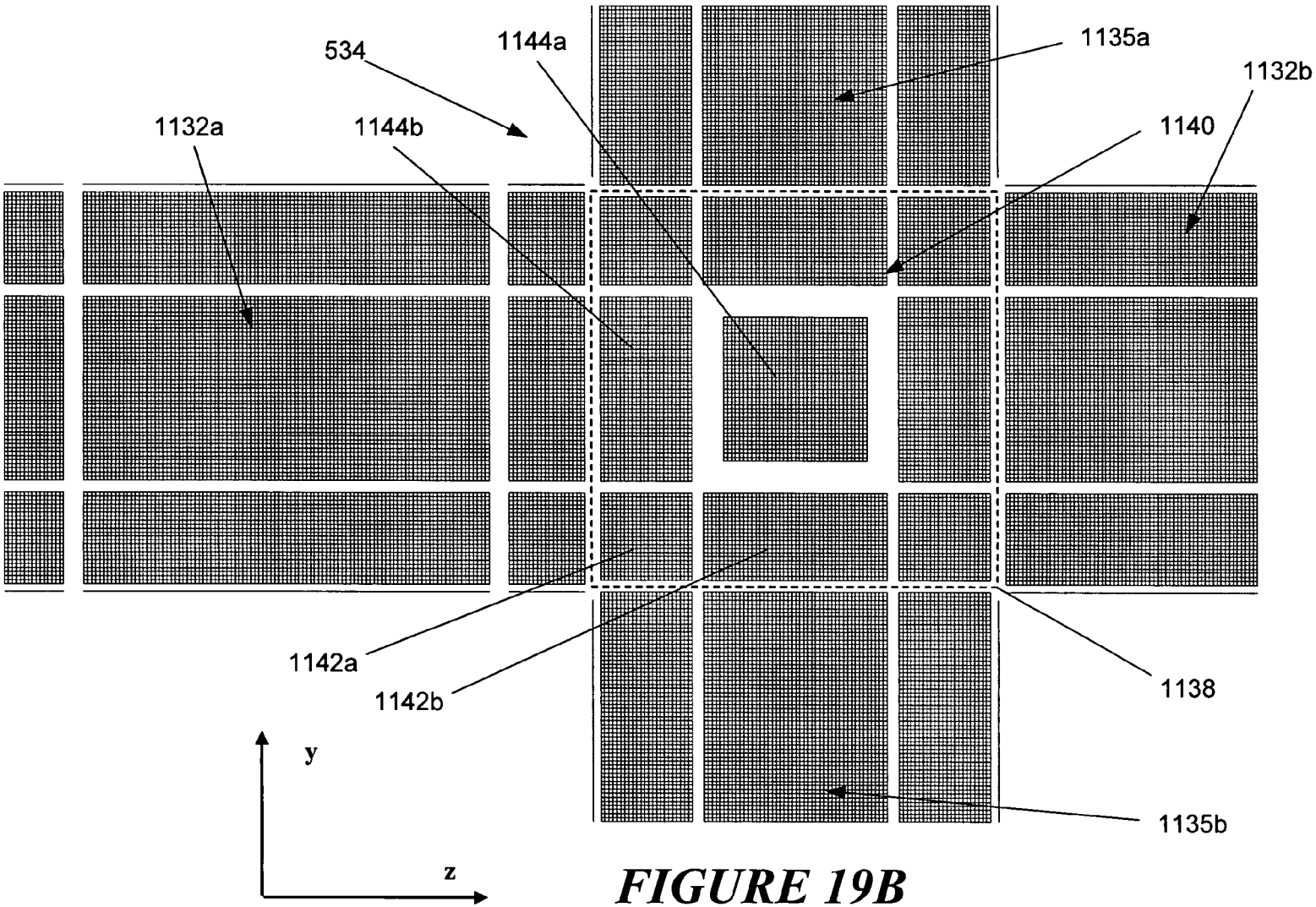

In other embodiments it is possible to generate RF field defects so that both the monopole and higher order terms have a z-dependence and the same RF gate can operate either as an m/Z gate and an excitation gate. Such an embodiment is shown in FIG. 19*a*, which includes an RF gate 534 between a first linear ion trapping region 532*a* and a second linear ion trapping region 532*b*. An AC potential can be applied to corner electrodes 552 of linear ion trapping region 532*a* to transverse excite ions when RF gate 534 is used as an excitation gate. As in other embodiments, center regions are used as RF electrodes and DC potentials are applied to axially segmented corner electrodes to control the axial motion of the ions. As in the other embodiments, RF gate 534 is formed by a modification to the axially extended RF electrodes. In this specific case, the RF gate includes regions extending transversely relative to the axis of the first ion trapping region, and those transversely extended regions are themselves surrounded by central RF electrodes. FIG. 19*b* shows the electrode arrangement along the transversely extending face of the RF gate. RF field lines for RF gate 534 are shown in FIG. 19*c*.

Referring now to both FIGS. 19*a* and 19*b*, the gate is implemented as a cross in which the transversely extended regions, denoted as electrode structures 1135*a* and 1135*b* in FIG. 19*b*, crosses the axially extended RF electrodes 1132*a* and 1132*b* of the linear ion trapping regions surrounding the RF gate so that the center line of both electrode sets (y and z-axes) intersect at 90 degrees. The intersection defines a cube in which there is a common interior volume 1138. In the cube, there are two electrode plates, top and bottom (with the top plate being shown as plate 1140 in the figure), that are perpendicular to the x-axis and will be denoted as the +/−x plates. The electrode shapes on the two x plates are the same. The other 4 faces of the common interior volume are open. The x plate electrodes do not have the common electrode cross-section of the LITs, but continue the lines of the corner and center electrodes of the LITs through the intersection on the x plate. This defines three sets of electrodes. The first set consists of four electrodes placed where the corner electrode lines of the LITs intersect (e.g., corner electrode 1142*a*). They generate the 4 corners of the x plate. The second set of electrodes consists of four electrodes in the area defined by the intersection of the center electrodes of one LIT with the corner electrodes of the perpendicular LIT and define edge electrodes of the x plate (e.g., edge electrode 1144*a*). Finally, the third set of electrodes consists of the electrode centered in the intersection of the center electrode lines of the two LITs on each of the +/−x plates (e.g., center electrode 1146*a*). Each such electrode, denoted the center electrode, is generally smaller than the area of the intersection. On the x plates the RF is only applied to the center electrodes.

The basic idea is to create a region with both an on-axis m/Z-dependent axial force and an axial force that depends on the transverse displacement of incident ions. The combination of axial forces may allow for additional flexibility in the m/Z fractionation of ions. In a specific embodiment the high m/Z fraction of the ion population may be transfered by combining broadband transverse excitation (e.g., a sweep of the excitation frequency—known in the art as a 'CHIRP') with the m/Z-dependence of the axial force. This device may be intermediate in its resolution and charge cpacity. The excitation of the transverse oscillatory motion coupled with the axial force on transversely excited ions may allow for greater m/Z resolution than the m/Z gate (monopole-dependent axial force) alone and may exhibit higher charge capacity with reduced transverse velocity than with the excitation gate (quadrupole-dependent axial force) alone.

In this embodiment the ions stored in the accumulation trap would be sequentially MSn analyzed by transferring ion fractions starting with higher m/Z and then after these ions were analyzed in the high resolution stages moving to transfer ions in the lower m/Z ranges. Not placing RF on the edge electrodes and decreasing the area of the center electrode reduces the intensity of the RF gate. This controls the magnitude of the transverse and axial energy required of the ions to cross the RF gate in the subsequent m/Z-selective steps. The balance involves a trade-off between m/Z-selectivity (generally higher barrier) and the desire to keep the ions as cool as possible (generally lower barrier). The electrodes on the x plates that are actively used are the two edge electrodes on each of the +/−x plate, (e.g., edge electrode 1144*b*) facing the upstream LIT. A DC repelling voltage is added to these edge electrodes to push ions that do not cross the RF gate away from the weak RF fringe field of the device and avoid the associated rf heating. RF voltage is also applied to the center electrodes of electrode structures 1135*a* and 1135*b*. Although the magnitude of the RF axial force can be adjusted by varying the applied RF, either amplitude or frequency, this will impact all the electrodes that carry the common RF. In a preferred embodiment the RF is held fixed and the DC offsets that control both the incident axial velocity and the common axial force in the gate region are varied. For transfers across the RF excitation gate the DC parameters can be additionally modified by the control of the dipolar excitation in the LIT region 132*a* or 132*b* (FIG. 2). In this manner different m/Z ranges can be selected. In the detailed embodiment of the RF excitation gate described above, the axial RF force attracted transversely excited ions into the field modification region.

Figure 20A:
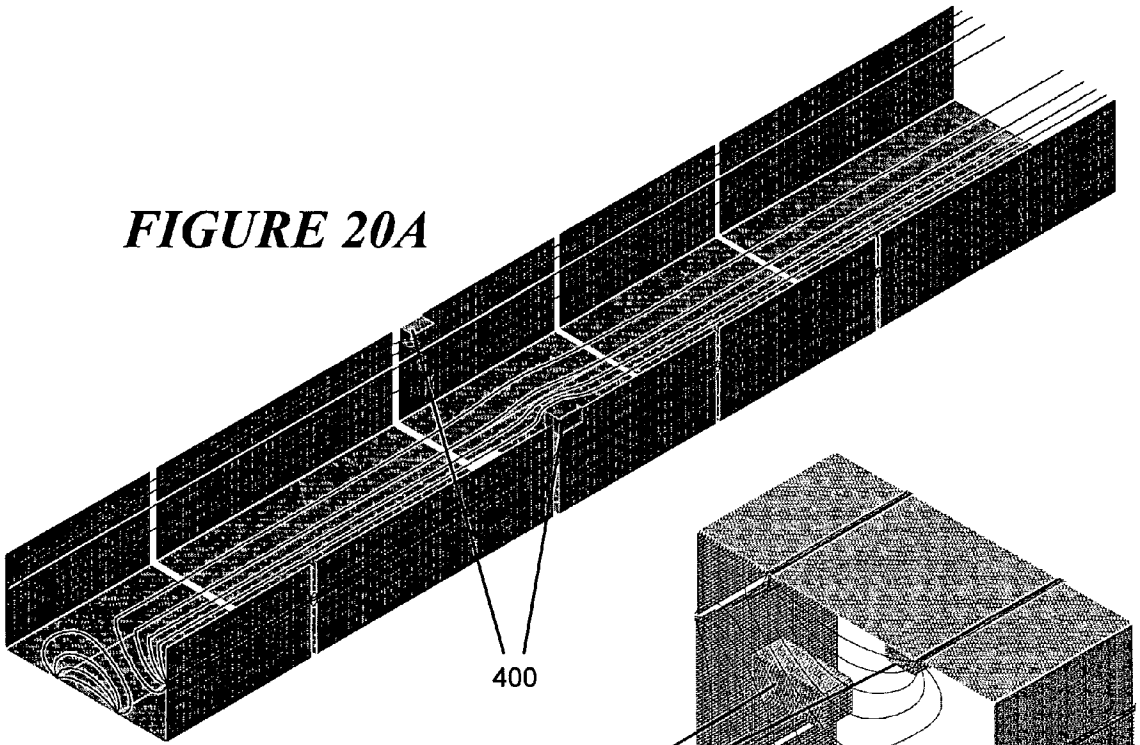
FIGS. 20*a* and 20*b* are schematic drawings of another embodiment of an RF gate based on inwardly extending deformations in the RF electrodes.
Figure 20B:
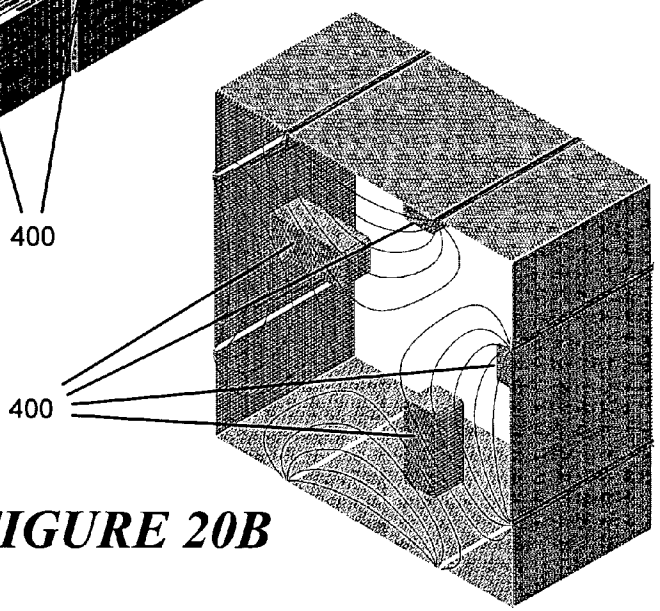

Alternatively, in other embodiments, the transverse variation in the structured RF field may be selected to cause the RF axial force to be more repulsive for the excited ions. In such cases, the relative magnitude of the RF gate increases with transverse displacement from the z-axis (at least over some range of displacements). To provide an m/Z-specific transfer in such a case, all ions in the trap may be transversely excited except ones having a selected m/Z value, and thus the non-excited ions are more likely to transfer because the RF barrier is set to be less repulsive for ions having small transverse displacements. A simple way to do this is to compress the RF field by introducing bumps in opposed electrodes extending into the interior of the cell (FIGS. 20*a, b*). Both the magnitude and the symmetry of the field defects may be modified to control the details of the axial force. FIG. 20*a* shows extended electrode segments 400 with a field defect that introduces both an m/Z-gate and an inverted excitation gate, i.e., it specifically repels transversely excited ions. FIG. 20*b* shows an inverted excitation gate resulting from the extended electrode segments. The inverted excitation gate produces a larger axial force for a given transverse excitation amplitude; the effect on unexcited ions is minimal.

The electronics necessary to control the DC, AC, and RF potentials directed to the different electrodes in the mass spectroscopy system are well know in the art. The power RF amplifier can be obtained from a standard supplier of beam quadrupole electronics such as Extrel Corporation. For example, such electronics may implement commercially available electronics modules such as PXI/CompactPCI cards from National Instruments Corporation. The controller can include hardware (e.g., a computer), software, or a combination of both to control the electronics for the power supplies and provide a user interface. The m/Z specification techniques described above can be implemented in computer programs using standard programming techniques. Such programs are designed to execute on programmable computers each comprising a processor, a data storage system (including memory and/or storage elements), at least one input device, and least one output device, such as a display or printer. Each such computer program can be implemented in a high-level procedural or object-oriented programming language, or an assembly or machine language. Furthermore, the language can be a compiled or interpreted language. Each such computer program can be stored on a computer readable storage medium (e.g., CD ROM or magnetic diskette) that when read by a computer can cause the processor in the computer to perform the analysis described herein.

Finally, we note that further embodiments of the invention implement any of the m/Z specification techniques describe herein either by themselves or in combination with one or more additional techniques. For example, the rotation operation may be implemented within only a single ion trap. Moreover, where the rotation operation is implemented within a series of ion traps, for example, that series may or may not be coupled to the low-resolution series of traps and RF traps. Furthermore, for example, the low-resolution series of traps and RF traps may be implemented on its own, with either the first transfer stage, second transfer stage, or both, or multiple such transfer stages.

A number of embodiments of the invention have been described. Nevertheless, it will be understood that various modifications may be made without departing from the spirit and scope of the invention. Accordingly, other embodiments are within the scope of the following claims.

What is claimed is:

1. A method comprising:

confining ions to stable trajectories within an ion trap;

exciting a subset of the ions along at least one transverse coordinate;

rotating the transverse excitation into an excitation along an axial coordinate; and transferring at least some of the axially excited ions from the ion trap along the axial coordinate.

2. The method of claim 1, wherein the confined ions have a mass-to-charge ratio within a specified range.

3. The method of claim 1, wherein the confining of the ions comprises generating electric fields within the ion trap.

4. The method of claim 3, wherein the electric fields are produced by a superposition of fields generated by multiple sets of electrodes.

5. The method of claim 3, wherein the electric fields produce linear dynamics for the ions in at least a central region of the ion trap.

6. The method of claim 5, wherein the electric fields generate a linear restoring force along the axial coordinate with respect to an origin in the central region of the ion trap.

7. The method of claim 5, wherein the electric fields generate a time-dependent restoring force of the form $P_r(t)$ r along each transverse coordinate with respect to an origin in the central region of the ion trap, where r denotes the transverse coordinate, t denotes time, and where $P_r(t)$ satisfies $P_r(t)=P_r(t+T)$ for some time interval T.

8. The method of claim 7, wherein the restoring force along each transverse coordinate is the same.

9. The method of claim 7, wherein the electric fields generate a linear restoring force along the axial coordinate with respect to an origin in the central region of the ion trap.

10. The method of claim 1, wherein the trajectory of each of the confined ions defines a frequency spectrum for each of the axial and transverse coordinates and each spectrum comprises at least one spectral peak at a frequency $\omega_{j,(m/Z)}$ that varies with the mass-to-charge ratio m/Z of the confined ion, where the index j denotes a particular one of the axial and transverse coordinates.

11. The method of claim 10, wherein $$\left|\frac{\partial \omega_{r,(m/Z)}}{\partial (m/Z)}\right|$$

is greater than $$\left|\frac{\partial \omega_{z,(m/Z)}}{\partial (m/Z)}\right|$$

for the subset of transversely excited ions, where the index r denotes either of the transverse coordinates and the index z denotes the axial coordinate.

12. The method of claim 11, wherein the exciting of the subset of ions comprises generating an additional electric field along the transverse coordinate, wherein the additional electric field is time-dependent and has spectral intensity at the transverse spectral peak frequency corresponding to a selected mass-to-charge ratio.

13. The method of claim 12, wherein the subset of ions comprises the ions having the selected mass-to-charge ratio.

14. The method of claim 13, wherein the rotating of the transverse excitation comprises generating a second additional electric field that couples the transverse excitation to ion motion along the axial coordinate, wherein the second additional electric field is time-dependent and has spectral intensity at a frequency equal to $|\omega_{r,(m/Z)}-\omega_{z,(m/Z)}|$ for the selected mass-to-charge ratio.

15. The method of claim 14, wherein the first additional electric field terminates before the generation of the second additional electric field.

16. The method of claim 15, wherein the second additional electric field is maintained for a time sufficient to rotate the transverse excitation to the axial excitation.

17. The method of claim 16, wherein the transferring comprises lowering a gate potential at one end of the ion trap to transfer at least some of the axially excited ions having the selected mass-to-charge ratio and to not transfer other ions.

18. The method of claim 17, further comprising confining the transferred ions in a second ion trap.

19. The method of claim 18, further comprising fragmenting at least some of the ions confined in the second trap.

20. The method of claim 11, wherein the rotating of the transverse excitation comprises generating an additional electric field that couples the transverse excitation to ion motion along the axial coordinate, wherein the additional electric field is time-dependent and has spectral intensity at a frequency equal to $|\omega_{r,(m/Z)}-\omega_{z,(m/Z)}|$ for a mass-to-charge ratio corresponding to at least some of the ions in the subset of transversely excited ions.

21. The method of claim 11, wherein $$\left|\frac{\partial\omega_{r,(m/Z)}}{\partial(m/Z)}\right|$$

is greater than ten times $$\left|\frac{\partial\omega_{z,(m/Z)}}{\partial(m/Z)}\right|$$

for the subset of transversely excited ions.

22. The method of claim 1, wherein the exciting of the subset of ions comprises generating a time-dependent electric field along the transverse coordinate.

23. The method of claim 22, wherein the subset of ions comprises ions having a selected mass-to-charge ratio.

24. The method of claim 23, wherein the time-dependent electric field resonantly excites the ions having the selected mass-to-charge ratio.

25. The method of claim 1, wherein the rotating of the transverse excitation comprises generating an electric field that couples the transverse excitation to ion motion along the axial coordinate.

26. The method of claim 25, wherein the electric field that couples the transverse excitation to the ion motion along the axial coordinate corresponds to an electric potential in a central region of the ion trap, the electric potential comprising a spatial dependence of the form $(\alpha x+\beta y)\,z$ with respect to an origin in the central region, where $\alpha$ and $\beta$ are constants, at least one of which is non-zero, x and y are the transverse coordinates, and z is the axial coordinate.

27. The method of claim 25, wherein the electric field comprises a frequency component equal to an absolute difference between a frequency of the transverse excitation and a frequency for axial motion in the ion trap for the transversely excited subset of ions.

28. The method of claim 25, wherein the electric field is maintained for a time sufficient to rotate the transverse excitation to the axial excitation.

29. The method of claim 1, wherein the transferred ions comprise ions having a selected mass-to-charge ratio.

30. The method of claim 1, wherein the transferring of at least some of the axially excited ions comprises lowering a gate potential at one end of the ion trap.

31. The method of claim 30, wherein the lowered gate potential prevents the confined ions other than the axially excited ions from escaping the ion trap through the one end.

32. The method of claim 1, further comprising confining the transferred ions in a second ion trap.

33. The method of claim 32, further comprising fragmenting at least some of the ions confined in the second trap.

34. The method of claim 33, wherein the fragmenting comprises electromagnetically exciting the ions in the second trap.

35. The method of claim 1, wherein the ion trap is extended along the axial coordinate relative to the transverse coordinate.

36. An apparatus comprising:

a housing comprising a chamber for receiving ions and multiple electrodes surrounding the chamber, wherein the multiple electrodes define transverse and axial coordinates for ion motion within the chamber;

a set of power supplies coupled to the multiple electrodes; and an electronic controller coupled to the set of power supplies, wherein during operation the electronic controller causes the set of power supplies to generate a series of electric fields in the chamber that: i) confines ions to stable trajectories within the chamber; ii) excites a subset of the ions along at least one of the transverse coordinates; iii) rotates the transverse excitation into an excitation along the axial coordinate; and iv) transfers at least some of the axially excited ions from the ion trap along the axial coordinate.

37. The apparatus of claim 36, wherein the power supplies comprise radio frequency (RF) and direct current (DC) sources for confining the ions to the stable trajectories.

38. The apparatus of claim 37, wherein the power supplies further comprise at least one alternating current (AC) source for exciting the subset of ions along the transverse coordinate and the rotating the transverse excitation to the axial excitation.

39. The apparatus of claim 38, wherein the electrodes coupled to the RF source are isolated from the electrodes coupled to any of the AC and DC sources.

40. The apparatus of claim 36, wherein during operation the electronic controller causes the electrodes surrounding the chamber to define a harmonic linear trap.

41. The apparatus of claim 36, wherein the housing is extended along the axial coordinate relative to the transverse coordinate.

42. The apparatus of claim 41, wherein the set power supplies are configured to generate the transverse time-dependent electric field at a first frequency selected by the electronic controller and generate the coupling time-dependent electric field at a second frequency selected by the electronic controller.

43. An apparatus comprising:

a housing comprising a chamber for receiving ions and multiple electrodes surrounding the chamber, wherein the multiple electrodes define transverse and axial coordinates for ion motion within the chamber;

a set of power supplies coupled to the multiple electrodes; and a electronic controller coupled to the set of power supplies, wherein during operation the electronic controller is configured to cause the set of power supplies to generate a time-dependent electric field along at least one of the transverse coordinates, and further configured to cause the set of power supplies to generate a time-dependent electric field that couples the axial coordinate to the transverse coordinate.

44. The apparatus of claim 43, wherein the electric field that couples the transverse excitation to the axial coordinate corresponds to an electric potential in a central region of the chamber, the electric potential comprising a spatial dependence of the form $(\alpha x+\beta y)z$ with respect to an origin in the central region, where $\alpha$ and $\beta$ are constants, at least one of which is non-zero, x and y are the transverse coordinates, and z is the axial coordinate.

45. The apparatus of claim 43, wherein the housing is extended along the axial coordinate relative to the transverse coordinate.

46. The apparatus of claim 43, wherein electronic controller is further configured to cause the power supplies to generate electric fields in the chamber that define a harmonic linear trap.

47. A method comprising:

generating an axially extended RF trapping field to transversely confine ions;

providing a spatially localized modification in the extended RF trapping field, wherein the modification imparts an axial force on incident ions that varies with a mass-to-charge ratio of each incident ion; and directing ions from a first trapping region to the spatially localized modification to allow some of the ions from the first trapping region to penetrate though the spatially localized modification and not others.

48. The method of claim 47, wherein the directing of the ions comprises imparting kinetic energy to the ions in the direction of the spatially localized modification.

49. The method of claim 48, wherein imparting the kinetic energy comprises adjusting DC potentials between the first trapping region and the spatially localized modification.

50. The method of claim 47, wherein the first ion trapping region is a linear ion trap (LIT).

51. The method of claim 47, further comprising:

confining the ions that penetrate through the spatially localized modification in a second ion trapping region adjacent the spatially localized modification.

52. The method of claim 51, wherein the first and second ion trapping regions are linear ion traps that are axially aligned with one another.

53. The method of claim 51, further comprising:

directing the ions in the second ion trapping regio back to the spatially localized modification to allow some of the ions from the second ion trapping region to penetrate through the it and others of the ions to reflect from it and remain confined in the second ion trapping region.

54. The method of claim 53, wherein the directing of the ions from the first trapping region to the spatially localized modification comprises imparting a first amount of kinetic energy to the ions in the direction of the spatially localized modification and wherein the directing of the ions from the second trapping region to the spatially localized modification comprises imparting a second amount of kinetic energy to the ions in the direction of the spatially localized modification.

55. The method of claim 54, wherein the first and second amounts differ.

56. The method of claim 54, further comprising adjusting the strength of the axial force prior to directing the ions in the second trapping region back to the first trapping region.

57. The method of claim 54, wherein the first amount of kinetic energy causes ions having a mass-to-charge ratio above a first threshold to penetrate through the spatially localized modification, the second amount of kinetic energy causes ions having a mass-to-charge ratio above a second threshold greater than the first threshold to penetrate through the spatially localized modification, and the ions remaining in the second ion trap have mass-to-charge ratios between the first and second thresholds.

58. The method of claim 47, wherein the axial force increases as the mass-to-charge ratio decreases.

59. The method of claim 58, wherein the ions that penetrate through the spatially localized modification have a mass-to-charge ratio above a threshold value.

60. The method of claim 47, wherein providing the spatially localized modification comprises applying an RF potential to electrodes on at least opposite sides of the spatially localized modification.

61. The method of claim 60, wherein providing the spatially localized modification further comprises applying an RF potential to additional electrodes surrounding regions extending transversely from the spatially localized modification relative to an axis defined by the first ion trapping region.

62. The method of claim 47, wherein providing the spatially localized modification comprises providing holes in axially extended electrodes used to generate the RF trapping field.

63. The method of claim 47, wherein providing the spatially localized modification comprises providing deformations in axially extended electrodes used to generate the RF trapping field.

64. The method of claim 63, wherein the deformations extend inwardly toward the RF trapping field.

65. An apparatus comprising:

electrodes configured to produce an axially extended RF trapping field that transversely confines ions, wherein the electrodes are modified to produce a spatially localized region in the axially extended RF trapping field that imparts an axial force on incident ions that varies with a mass-to-charge ratio of each incident ion;

a set of power supplies including at least direct current (DC) and RF power supplies coupled to the electrodes; and an electronic controller coupled to the set of power supplies, wherein during operation the electronic controller causes the set of power supplies to: i) generate the axially extended RF trapping field and the spatially localized region in the axially extended RF trapping field; and ii) direct ions from a first trapping region to the spatially localized region to allow some of the ions from the first trapping region to penetrate though the spatially localized region and not others.

66. A method comprising:

generating an axially extended RF trapping field to transversely confine ions;

providing a spatially localized modification in the extended RF trapping field, wherein the modification imparts an axial force on incident ions that varies with a transverse displacement of each incident ion;

increasing a transverse oscillation amplitude of a subset of the ions from a first ion trapping region, wherein the subset of ions comprises ions having a selected mass-to-charge ratio; and directing the ions toward the spatially localized modification to cause some of the ions to penetrate through it and not others.

67. The method of claim 66, wherein the magnitude of the axial force decreases with the transverse displacement of the incident ions, and wherein the ions that penetrate through the spatially localized modification comprise the subset of ions whose transverse oscillation amplitude was increased.

68. The method of claim 66, wherein the magnitude of the axial force increases with the transverse displacement of the incident ions, wherein the ions that do not penetrate through the spatially localized modification comprise the subset of ions whose transverse oscillation amplitude was increased.

69. The method of claim 66, wherein the first ion trap is a linear ion trap (LIT).

70. The method of claim 66, wherein the increasing of the transverse oscillation amplitude of a subset of the ions comprises generating time-varying electric field along at least one of the transverse coordinates, wherein the time-varying electric field has spectral intensity at a frequency corresponding to the stable trajectory of the ions having the selected mass-to-charge ratio along the transverse coordinate.

71. The method of claim 66, wherein the directing of the ions comprises imparting kinetic energy to the confined ions in the direction of the spatially localized modification.

72. The method of claim 71, wherein imparting the kinetic energy comprises lowering a gate potential between a first ion trapping region and the spatially localized modification.

73. The method of claim 66, further comprising:

confining the ions that penetrated through the spatially localized modification in a second ion trapping region adjacent the spatially localized modification.

74. The method of claim 73, wherein the first and second ion trapping regions are linear ion traps that are axially aligned with one another.

75. The method of claim 66, wherein generating the spatially localized modification comprises applying an RF potential to electrodes on at least opposite sides of the spatially localized modification.

76. The method of claim 75, wherein generating the spatially localized modification further comprises applying an RF potential to additional electrodes surrounding regions extending transversely from the spatially localized modification relative to an axis defined by the first ion trapping region.

77. The method of claim 66, wherein providing the spatially localized modification comprises providing holes in axially extended electrodes used to generate the RF trapping field.

78. The method of claim 66, wherein providing the spatially localized modification comprises providing deformations in axially extended electrodes used to generate the RF trapping field.

79. The method of claim 78, wherein the deformations extend inwardly toward the RF trapping field.

80. An apparatus comprising:

electrodes configured to produce an axially extended RF trapping field that transversely confines ions, wherein the electrodes are modified to produce a spatially localized region in the axially extended RF trapping field that imparts an axial force on incident ions that varies with a transverse displacement of each incident ion;

a set of power supplies including at least direct current (DC) and RF power supplies coupled to the electrodes; and an electronic controller coupled to the set of power supplies, wherein during operation the electronic controller causes the set of power supplies to: i) generate the axially extended RF trapping field and the spatially localized region in the axially extended RF trapping field; ii) increase a transverse oscillation amplitude of a subset of the ions from a first ion trapping region, wherein the subset of ions comprises ions having a selected mass-to-charge ratio; and iii) direct the ions toward the spatially localized modification to cause some of the ions to penetrate through it and not others.

81. An apparatus comprising:

electrodes configured to produce an axially extended RF trapping field that transversely confines ions, wherein the electrodes are modified to produce a spatially localized region within the axially extended RF trapping field that imparts an axial force on incident ions, wherein the axial force varies with a mass-to-charge ratio of each incident ion; and a set of power supplies including at least direct current (DC) and RF power supplies coupled to the electrodes.

82. The apparatus of claim 81, wherein the axial force also varies with a transverse displacment of each incident ion.

83. The apparatus of claim 81, wherein the electrodes further define first and second ion trapping regions on opposite sides of the spatially localized modifications, wherein the first and second trapping regions are linear ion traps (LITs).

84. The apparatus of claim 81, wherein the spatially localized modification comprises electrodes on at least opposite sides of the spatially localized modification and additional electrodes surrounding regions extending transversely from the spatially localized modification relative to an axis defined by the axially extended RF trapping field.

85. The apparatus of claim 81, wherein the spatially localized modification comprises holes in axially extended electrodes used to generate the RF trapping field.

86. The apparatus of claim 81, wherein the spatially localized modification comprises deformations in axially extended electrodes used to generate the RF trapping field.

87. The apparatus of claim 86, wherein the deformations extend inwardly toward the RF trapping field.

* * * * *